US010543395B2

(12) United States Patent
Powell et al.

(10) Patent No.: US 10,543,395 B2
(45) Date of Patent: Jan. 28, 2020

(54) OFFSETTING TREADMILL DECK WEIGHT DURING OPERATION

(71) Applicant: ICON Health & Fitness, Inc., Logan, UT (US)

(72) Inventors: Wade A. Powell, Logan, UT (US); Dale Alan Buchanan, Nibley, UT (US); Christopher J. Salvesen, Mendon, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 126 days.

(21) Appl. No.: 15/830,294

(22) Filed: Dec. 4, 2017

(65) Prior Publication Data

US 2018/0154208 A1 Jun. 7, 2018

Related U.S. Application Data

(60) Provisional application No. 62/429,981, filed on Dec. 5, 2016.

(51) Int. Cl.
*A63B 22/00* (2006.01)
*A63B 22/02* (2006.01)
(Continued)

(52) U.S. Cl.
CPC ..... *A63B 22/0023* (2013.01); *A63B 22/025* (2015.10); *A63B 24/0087* (2013.01); *A63B 71/0622* (2013.01); *A63B 21/225* (2013.01); *A63B 24/0062* (2013.01); *A63B 24/0075* (2013.01); *A63B 71/0686* (2013.01); *A63B 2024/009* (2013.01); *A63B 2071/063* (2013.01); *A63B 2071/065* (2013.01); *A63B 2071/068* (2013.01); *A63B 2071/0625* (2013.01); *A63B 2071/0638* (2013.01); *A63B 2071/0675* (2013.01); *A63B 2071/0691* (2013.01); *A63B 2220/13* (2013.01); *A63B 2220/20* (2013.01); *A63B 2225/093* (2013.01);
(Continued)

(58) Field of Classification Search
None
See application file for complete search history.

(56) References Cited

U.S. PATENT DOCUMENTS 232,022 A 9/1880 Gifford
284,294 A 9/1883 Graves
(Continued)

FOREIGN PATENT DOCUMENTS

CN 100354017 12/2007
KR 1020050087181 8/2005
(Continued)

OTHER PUBLICATIONS

English Translation and original of Office Action and Search Report issued in Taiwan Application 106135812.
(Continued)

*Primary Examiner* — Stephen R Crow
(74) *Attorney, Agent, or Firm* — Ray Quinney & Nebeker

(57) ABSTRACT

A treadmill includes a deck, an incline mechanism attached to the deck, and a lift assist mechanism that offloads a portion of the lifting force from the incline mechanism when the incline mechanism changes an elevation of a portion of the deck.

20 Claims, 9 Drawing Sheets

(51) Int. Cl.

| | |
|---|---|
| ***A63B 71/06*** | (2006.01) |
| ***A63B 24/00*** | (2006.01) |
| *A63B 21/22* | (2006.01) |

(52) U.S. Cl.

CPC ..... *A63B 2225/50* (2013.01); *A63B 2230/00* (2013.01); *A63B 2230/015* (2013.01); *A63B 2230/06* (2013.01); *A63B 2230/75* (2013.01)

(56) References Cited

U.S. PATENT DOCUMENTS

| | | | |
|---|---|---|---|
| 321,388 | A | 6/1885 | Ruebsam |
| 339,638 | A | 4/1886 | Goldie |
| 421,779 | A | 2/1890 | Steven |
| 447,780 | A | 3/1891 | Luge |
| 450,792 | A | 4/1891 | Dodd |
| 659,216 | A | 10/1900 | Dowling |
| 663,486 | A | 12/1900 | Boren |
| 674,391 | A | 5/1901 | Baker |
| 683,284 | A | 9/1901 | Honey |
| 766,930 | A | 8/1904 | Clemons |
| 881,521 | A | 3/1908 | Wilson |
| 897,722 | A | 9/1908 | Day |
| 931,394 | A | 8/1909 | Day |
| 937,795 | A | 10/1909 | Hackney |
| 1,016,729 | A | 2/1912 | Barrett |
| 1,020,777 | A | 3/1912 | Peterson |
| 1,064,968 | A | 6/1913 | Hagen |
| 1,082,940 | A | 12/1913 | Flora |
| 1,211,765 | A | 1/1917 | Schmidt |
| 1,570,482 | A | 1/1926 | Hale |
| 1,580,530 | A | 4/1926 | Rambo |
| 1,585,748 | A | 5/1926 | Wendelken |
| 1,715,870 | A | 6/1929 | Spain |
| 1,766,089 | A | 6/1930 | Wood |
| 1,778,635 | A | 10/1930 | Heisler |
| 1,824,406 | A | 9/1931 | Petersime |
| 1,850,530 | A | 3/1932 | Brown |
| 1,893,728 | A | 1/1933 | Bullis |
| 1,902,694 | A | 3/1933 | Edwards |
| 1,919,627 | A | 7/1933 | Fitz Gerald |
| 1,928,089 | A | 9/1933 | Blickman |
| 1,973,945 | A | 9/1934 | Chavin |
| 1,978,579 | A | 10/1934 | Hooks |
| 1,982,843 | A | 12/1934 | Traver |
| 2,067,136 | A | 1/1937 | Bridenbaugh |
| 2,117,957 | A | 5/1938 | Ritter |
| 2,165,700 | A | 7/1939 | Glynn |
| 2,177,957 | A | 10/1939 | Stewart |
| 2,219,219 | A | 10/1940 | Boger |
| 2,247,946 | A | 7/1941 | Hein et al. |
| 2,255,864 | A | 9/1941 | Stephens |
| 2,315,485 | A | 4/1943 | Le Roy Jones |
| 2,399,915 | A | 5/1946 | Drake |
| 2,440,644 | A | 4/1948 | Powell |
| 2,569,007 | A | 9/1951 | Klyce |
| 2,632,645 | A | 3/1953 | Barkschat |
| 2,645,539 | A | 7/1953 | Thompson |
| 2,646,282 | A | 7/1953 | Ringman |
| 2,648,540 | A | 8/1953 | Hunter |
| 2,674,453 | A | 4/1954 | Hummert |
| 2,743,623 | A | 5/1956 | Wells |
| 2,746,822 | A | 5/1956 | Copenhaver |
| 2,842,365 | A | 7/1958 | Kelley |
| 2,855,200 | A | 10/1958 | Blickman |
| 2,874,971 | A | 2/1959 | Devery |
| 2,969,060 | A | 1/1961 | Swanda |
| 2,984,594 | A | 5/1961 | Runton |
| 3,035,671 | A | 5/1962 | Sicherman |
| 3,059,312 | A | 10/1962 | Jamieson |
| 3,068,950 | A | 12/1962 | Davidson |
| 3,072,426 | A | 1/1963 | Gilbert |
| 3,112,108 | A | 11/1963 | Hanke |
| 3,127,171 | A | 3/1964 | Noland et al. |
| 3,179,071 | A | 4/1965 | Johnston |
| 3,193,287 | A | 7/1965 | Robinson |
| 3,205,888 | A | 9/1965 | Stroop |
| 3,316,898 | A | 5/1967 | Brown |
| 3,319,273 | A | 5/1967 | Solin |
| 3,342,485 | A | 9/1967 | Gaul |
| 3,345,067 | A | 10/1967 | Smith |
| 3,358,813 | A | 12/1967 | Kohlhagen |
| 3,378,259 | A | 4/1968 | Kupchinski |
| 3,408,067 | A | 10/1968 | Armstrong |
| 3,408,069 | A | 10/1968 | Lewis |
| 3,411,497 | A | 11/1968 | Rickey et al. |
| 3,416,174 | A | 12/1968 | Novitske |
| 3,430,507 | A | 3/1969 | Hurst et al. |
| 3,438,627 | A | 4/1969 | La Lanne |
| 3,444,830 | A | 5/1969 | Doetsch |
| 3,446,503 | A | 5/1969 | Lawton |
| 3,501,140 | A | 3/1970 | Eichorn |
| 3,511,500 | A | 5/1970 | Dunn |
| 3,514,110 | A | 5/1970 | Thomander |
| 3,518,985 | A | 7/1970 | Quinton |
| 3,547,435 | A | 12/1970 | Scott |
| 3,554,541 | A | 1/1971 | Seaman |
| 3,563,541 | A | 2/1971 | Sanquist |
| 3,566,861 | A | 3/1971 | Weiss |
| 3,567,219 | A | 3/1971 | Foster |
| 3,568,669 | A | 3/1971 | Stites |
| 3,572,700 | A | 3/1971 | Mastropaolo |
| 3,583,465 | A | 6/1971 | Youngs et al. |
| 3,586,322 | A | 6/1971 | Kverneland |
| 3,589,715 | A | 6/1971 | Mark |
| 3,592,466 | A | 7/1971 | Parsons |
| 3,598,404 | A | 8/1971 | Bowman |
| 3,602,502 | A | 8/1971 | Hampl |
| 3,606,320 | A | 9/1971 | Erwin, Jr. |
| 3,608,898 | A | 9/1971 | Berlin |
| 3,614,097 | A | 10/1971 | Blickman |
| 3,628,654 | A | 12/1971 | Haracz |
| 3,628,791 | A | 12/1971 | Garcia |
| 3,634,895 | A | 1/1972 | Childers |
| 3,636,577 | A | 1/1972 | Nissen |
| 3,638,941 | A | 2/1972 | Kulkens |
| 3,640,528 | A | 2/1972 | Proctor |
| 3,641,601 | A | 2/1972 | Sieg |
| 3,642,279 | A | 2/1972 | Cutter |
| 3,643,943 | A | 2/1972 | Erwin, Jr. et al. |
| 3,650,529 | A | 3/1972 | Salm |
| 3,658,327 | A | 4/1972 | Thiede |
| 3,659,845 | A | 5/1972 | Quinton |
| 3,664,666 | A | 5/1972 | Lloyd |
| 3,686,776 | A | 8/1972 | Dahl |
| 3,689,066 | A | 9/1972 | Hagen |
| 3,703,284 | A | 11/1972 | Hesen |
| 3,708,166 | A | 1/1973 | Annas |
| 3,709,197 | A | 1/1973 | Moseley |
| 3,731,917 | A | 5/1973 | Townsend |
| 3,738,649 | A | 6/1973 | Miller |
| 3,741,538 | A | 6/1973 | Useldinger |
| 3,751,033 | A | 8/1973 | Rosenthal |
| 3,756,595 | A | 9/1973 | Hague |
| 3,767,195 | A | 10/1973 | Dimick |
| 3,788,412 | A | 1/1974 | Vincent |
| 3,792,860 | A | 2/1974 | Selnes |
| 3,809,393 | A | 5/1974 | Jones |
| 3,814,420 | A | 6/1974 | Encke |
| 3,822,488 | A | 7/1974 | Johnson |
| 3,826,491 | A | 7/1974 | Elder |
| 3,848,467 | A | 11/1974 | Flavell |
| 3,851,874 | A | 12/1974 | Wilkin |
| 3,858,938 | A | 1/1975 | Kristensson et al. |
| 3,861,215 | A | 1/1975 | Bradley |
| 3,869,121 | A | 3/1975 | Flavell |
| 3,870,297 | A | 3/1975 | Elder |
| 3,874,657 | A | 4/1975 | Niebojewski |
| 3,880,274 | A | 4/1975 | Bechtloff |
| 3,883,922 | A | 5/1975 | Fleischhauer |
| 3,892,404 | A | 7/1975 | Martucci |
| 3,901,379 | A | 8/1975 | Bruhm |
| 3,903,613 | A | 9/1975 | Bisberg |
| 3,904,196 | A | 9/1975 | Berlin |

(56) References Cited

U.S. PATENT DOCUMENTS 3,909,857 A 10/1975 Herrera
3,912,263 A 10/1975 Yatso
3,918,710 A 11/1975 Niebojewski
3,926,430 A 12/1975 Good
3,929,026 A 12/1975 Hofmann
3,938,400 A 2/1976 Konyha
3,941,377 A 3/1976 Lie
3,948,513 A 4/1976 Pfotenhauer
3,963,101 A 6/1976 Stadelmann et al.
3,977,451 A 8/1976 Duba
3,981,500 A 9/1976 Ryan
4,012,015 A 3/1977 Nelson et al.
4,024,949 A 5/1977 Kleysteuber et al.
4,026,545 A 5/1977 Schonenberger
4,033,567 A 7/1977 Lipfert
4,056,265 A 11/1977 Ide
4,063,726 A 12/1977 Wilson
4,063,727 A 12/1977 Hall
4,066,257 A 1/1978 Moller
4,066,259 A 1/1978 Brentham
4,067,372 A 1/1978 Masson
4,072,309 A 2/1978 Wilson
4,077,626 A 3/1978 Newman
4,082,267 A 4/1978 Flavell
4,093,196 A 6/1978 Bauer
4,094,330 A 6/1978 Jong
4,111,417 A 9/1978 Gardner
4,113,071 A 9/1978 Muller et al.
4,120,294 A 10/1978 Wolfe
4,141,158 A 2/1979 Benseler et al.
4,146,222 A 3/1979 Hribar
4,149,714 A 4/1979 Lambert, Jr.
4,151,988 A 5/1979 Nabinger
4,151,994 A 5/1979 Stalberger, Jr.
4,161,998 A 7/1979 Trimble
4,167,938 A 9/1979 Remih
4,168,061 A 9/1979 Gordon
4,171,805 A 10/1979 Abbott
4,179,134 A 12/1979 Atkinson
4,183,156 A 1/1980 Rudy
4,183,494 A 1/1980 Cleveland
4,188,030 A 2/1980 Hooper
4,199,139 A 4/1980 Mahnke
4,204,673 A 5/1980 Speer, Sr.
4,208,049 A 6/1980 Wilson
4,215,516 A 8/1980 Huschle et al.
4,216,856 A 8/1980 Moring et al.
4,227,689 A 10/1980 Keiser
4,235,437 A 11/1980 Ruis et al.
4,240,627 A 12/1980 Brentham
4,248,476 A 2/1981 Phelps
4,249,725 A 2/1981 Mattox
4,251,932 A 2/1981 Love
4,253,661 A 3/1981 Russell
4,258,821 A 3/1981 Wendt
4,258,913 A 3/1981 Brentham
4,274,625 A 6/1981 Gaetano
4,278,095 A 7/1981 Lapeyre
4,278,249 A 7/1981 Forrest
4,286,782 A 9/1981 Fuhrhop
4,290,601 A 9/1981 Mittelstadt
4,300,761 A 11/1981 Howard
4,313,602 A 2/1982 Sullivan
4,313,603 A 2/1982 Simjian
4,324,501 A 4/1982 Herbenar
4,333,978 A 6/1982 Kocher
4,334,676 A 6/1982 Schonenberger
4,334,695 A 6/1982 Ashby
4,337,283 A 6/1982 Haas, Jr.
4,342,452 A 8/1982 Summa
4,344,616 A 8/1982 Ogden
4,349,597 A 9/1982 Fine et al.
4,350,336 A 9/1982 Hanford
4,358,105 A 11/1982 Sweeney, Jr.
4,363,480 A 12/1982 Fisher et al.
4,363,486 A 12/1982 Chaudhry
4,367,895 A 1/1983 Pacitti et al.
4,369,081 A 1/1983 Curry et al.
4,370,766 A 2/1983 Teague, Jr.
4,374,587 A 2/1983 Ogden
4,377,045 A 3/1983 Aurensan
4,383,684 A 5/1983 Schliep
4,383,714 A 5/1983 Ishida
4,397,462 A 8/1983 Wilmarth
4,406,451 A 9/1983 Gaetano
4,408,613 A 10/1983 Relyea
4,422,635 A 12/1983 Herod
4,422,636 A 12/1983 de Angeli
4,423,864 A 1/1984 Wiik
4,426,077 A 1/1984 Becker
4,431,181 A 2/1984 Baswell
4,434,981 A 3/1984 Norton
4,441,708 A 4/1984 Brentham
4,445,684 A 5/1984 Ruff
4,452,448 A 6/1984 Ausherman
4,453,766 A 6/1984 DiVito
4,461,472 A 7/1984 Martinez
4,465,277 A 8/1984 Dittrich
4,476,582 A 10/1984 Strauss et al.
4,477,071 A 10/1984 Brown et al.
4,489,933 A 12/1984 Fisher
4,491,318 A 1/1985 Francke
4,494,662 A 1/1985 Clymer
4,496,147 A 1/1985 DeCloux et al.
4,499,784 A 2/1985 Shum
4,502,679 A 3/1985 De Lorenzo
4,505,474 A 3/1985 Mattox
4,505,475 A 3/1985 Olschansky et al.
4,509,510 A 4/1985 Hook
4,512,567 A 4/1985 Phillips
4,512,571 A 4/1985 Hermelin
4,522,394 A 6/1985 Broussard
4,529,194 A 7/1985 Haaheim
4,533,136 A 8/1985 Smith et al.
4,536,244 A 8/1985 Greci et al.
4,538,805 A 9/1985 Parviainen
4,542,899 A 9/1985 Hendricks
4,544,152 A 10/1985 Taitel
4,544,153 A 10/1985 Babcock
4,546,971 A 10/1985 Raasoch
4,549,733 A 10/1985 Salyer
4,556,216 A 12/1985 Pitkanen
4,563,001 A 1/1986 Terauds
4,563,003 A 1/1986 Bugallo et al.
4,564,193 A 1/1986 Stewart
4,566,689 A 1/1986 Ogden
4,566,732 A 1/1986 Ostergaard, Sr.
4,569,518 A 2/1986 Fulks
4,571,682 A 2/1986 Silverman et al.
4,572,500 A 2/1986 Weiss
4,572,504 A 2/1986 DiBartolo
4,576,352 A 3/1986 Ogden
4,576,376 A 3/1986 Miller
4,577,860 A 3/1986 Matias et al.
4,580,983 A 4/1986 Cassini et al.
4,581,269 A 4/1986 Tilman
4,582,320 A 4/1986 Shaw
4,589,656 A 5/1986 Baldwin
4,591,147 A 5/1986 Smith et al.
4,592,544 A 6/1986 Smith et al.
4,600,196 A 7/1986 Jones
4,601,142 A 7/1986 Frommelt
4,602,779 A 7/1986 Ogden
4,610,449 A 9/1986 Diercks, Jr.
4,614,337 A 9/1986 Schonenberger
4,616,822 A 10/1986 Trulaske
4,618,139 A 10/1986 Haaheim
4,618,140 A 10/1986 Brown
4,619,454 A 10/1986 Walton
4,621,623 A 11/1986 Wang
4,624,457 A 11/1986 Silberman et al.
4,625,962 A 12/1986 Street
4,627,614 A 12/1986 De Angeli
4,627,615 A 12/1986 Nurkowski

(56) References Cited

U.S. PATENT DOCUMENTS 4,627,616 A 12/1986 Kauffman
4,630,817 A 12/1986 Buckley
4,632,385 A 12/1986 Geraci
4,632,386 A 12/1986 Beech
4,632,390 A 12/1986 Richey
4,634,127 A 1/1987 Rockwell
4,635,927 A 1/1987 Shu
4,635,928 A 1/1987 Ogden et al.
4,637,605 A 1/1987 Ritchie
4,638,523 A 1/1987 Todd
4,638,969 A 1/1987 Brown
4,641,833 A 2/1987 Trethewey
4,642,080 A 2/1987 Takano et al.
4,643,418 A 2/1987 Bart
4,645,197 A 2/1987 Mcfee
4,645,200 A 2/1987 Hix
4,645,201 A 2/1987 Evans
4,645,917 A 2/1987 Penney et al.
4,647,041 A 3/1987 Whiteley
4,650,067 A 3/1987 Brule
4,650,184 A 3/1987 Brebner
4,650,185 A 3/1987 Cartwright
4,651,581 A 3/1987 Svensson
4,659,074 A 4/1987 Taitel et al.
4,659,077 A 4/1987 Stropkay
4,659,078 A 4/1987 Blome
4,662,630 A 5/1987 Dignard et al.
4,664,371 A 5/1987 Viander
4,664,373 A 5/1987 Hait
4,664,646 A 5/1987 Rorabaugh
4,673,177 A 6/1987 Szymski
4,674,740 A 6/1987 Iams et al.
4,674,743 A 6/1987 Hirano
4,678,185 A 7/1987 Mahnke
4,679,787 A 7/1987 Guilbault
4,684,121 A 8/1987 Nestegard
4,685,670 A 8/1987 Zinkin
4,687,195 A 8/1987 Potts
4,697,809 A 10/1987 Rockwell
4,700,946 A 10/1987 Breunig
4,702,475 A 10/1987 Elstein et al.
4,705,267 A 11/1987 Jackson
4,708,337 A 11/1987 Shyu
4,709,917 A 12/1987 Yang
4,709,918 A 12/1987 Grinblat
4,709,920 A 12/1987 Schnell
4,711,447 A 12/1987 Mansfield
4,714,248 A 12/1987 Koss
4,718,207 A 1/1988 Frommelt
4,720,093 A 1/1988 Del Mar
4,720,099 A 1/1988 Carlson
4,720,789 A 1/1988 Hector et al.
4,721,303 A 1/1988 Fitzpatrick
4,725,057 A 2/1988 Shifferaw
4,726,581 A 2/1988 Chang
4,729,558 A 3/1988 Kuo
4,729,562 A 3/1988 Pipasik
4,733,858 A 3/1988 Lan
4,743,009 A 5/1988 Beale
4,743,015 A 5/1988 Marshall
4,744,559 A 5/1988 Mahnke et al.
4,746,115 A 5/1988 Lahman
4,749,184 A 6/1988 Tobin
4,750,736 A 6/1988 Watterson
4,751,755 A 6/1988 Carey, Jr. et al.
4,756,098 A 7/1988 Boggia
4,757,987 A 7/1988 Allemand
4,759,540 A 7/1988 Yu et al.
4,771,148 A 9/1988 Bersonnet
4,772,015 A 9/1988 Carlson et al.
4,773,170 A 9/1988 Moore et al.
4,776,582 A 10/1988 Ramhorst
4,779,884 A 10/1988 Minati
4,786,049 A 11/1988 Lautenschlager
4,786,050 A 11/1988 Geschwender
4,790,528 A 12/1988 Nakao et al.
4,792,134 A 12/1988 Chen
4,797,968 A 1/1989 Wenzlick
4,798,760 A 1/1989 Diaz-Kotti
4,799,475 A 1/1989 Iams et al.
4,799,671 A 1/1989 Hoggan et al.
4,801,079 A 1/1989 Gonella
4,804,178 A 2/1989 Friedebach
4,805,901 A 2/1989 Kulick
4,807,874 A 2/1989 Little
4,809,804 A 3/1989 Houston et al.
4,809,972 A 3/1989 Rasmussen et al.
4,813,667 A 3/1989 Watterson
4,813,668 A 3/1989 Solloway
4,813,743 A 3/1989 Mizelle
4,817,939 A 4/1989 Augspurger et al.
4,818,175 A 4/1989 Kimura
4,819,583 A 4/1989 Guerra
4,822,029 A 4/1989 Sarno
4,822,034 A 4/1989 Shields
4,824,104 A 4/1989 Bloch
4,826,153 A 5/1989 Schalip
4,826,157 A 5/1989 Fitzpatrick
4,826,158 A 5/1989 Fields, Jr.
4,826,159 A 5/1989 Hersey
4,828,255 A 5/1989 Lahman
4,828,257 A 5/1989 Dyer et al.
4,830,362 A 5/1989 Bull
4,832,332 A 5/1989 Dumbser
4,836,530 A 6/1989 Stanley, Jr.
4,838,543 A 6/1989 Armstrong et al.
4,838,544 A 6/1989 Sasakawa et al.
4,842,266 A 6/1989 Sweeney, Sr.
4,842,274 A 6/1989 Oosthuizen
4,844,449 A 7/1989 Truslaske
4,844,450 A 7/1989 Rodgers, Jr.
4,848,737 A 7/1989 Ehrenfield
4,850,585 A 7/1989 Dalebout
4,861,023 A 8/1989 Wedman
4,861,025 A 8/1989 Rockwell
4,863,161 A 9/1989 Telle
4,865,344 A 9/1989 Romero, Sr. et al.
4,867,443 A 9/1989 Jensen
4,869,493 A 9/1989 Johnston
4,869,494 A 9/1989 Lambert, Sr.
4,869,497 A 9/1989 Stewart et al.
4,875,676 A 10/1989 Zimmer
4,877,239 A 10/1989 Dela Rosa
4,878,662 A 11/1989 Chern
4,878,663 A 11/1989 Luquette
4,880,227 A 11/1989 Sowell
4,883,272 A 11/1989 Lay
4,886,266 A 12/1989 Trulaske
4,891,764 A 1/1990 McIntosh
4,894,933 A 1/1990 Tonkel et al.
4,898,379 A 2/1990 Shiba
4,898,381 A 2/1990 Gordon
4,900,012 A 2/1990 Fu
4,900,017 A 2/1990 Bold, Jr.
4,900,018 A 2/1990 Ish, III
4,902,006 A 2/1990 Stallings, Jr.
4,904,829 A 2/1990 Berthaud et al.
4,905,330 A 3/1990 Jacobs
4,907,795 A 3/1990 Shaw et al.
4,907,797 A 3/1990 Gezari et al.
4,907,798 A 3/1990 Burchatz
4,909,504 A 3/1990 Yang
4,911,438 A 3/1990 Van Straaten
4,913,396 A 4/1990 Dalebout et al.
4,913,423 A 4/1990 Farran
4,915,377 A 4/1990 Malnke et al.
4,915,379 A 4/1990 Sapp
4,917,376 A 4/1990 Lo
4,919,418 A 4/1990 Miller
4,919,419 A 4/1990 Houston
4,921,242 A 5/1990 Watterson
4,921,247 A 5/1990 Sterling
4,923,193 A 5/1990 Pitzen et al.
4,925,183 A 5/1990 Kim

(56) References Cited

U.S. PATENT DOCUMENTS 4,925,724 A 5/1990 Ogden
4,927,136 A 5/1990 Leask
4,928,546 A 5/1990 Walters
4,928,957 A 5/1990 Lanier et al.
4,930,768 A 6/1990 Lapcevic
4,930,769 A 6/1990 Nenoff
4,934,690 A 6/1990 Bull
4,934,692 A 6/1990 Owens
4,938,473 A 7/1990 Lee
4,940,233 A 7/1990 Bull
4,941,652 A 7/1990 Nagano et al.
4,941,673 A 7/1990 Bennett
4,948,121 A 8/1990 Haaheim et al.
4,949,954 A 8/1990 Hix
4,949,958 A 8/1990 Richey
4,952,265 A 8/1990 Yamanaka et al.
4,953,415 A 9/1990 Lehtonen
4,953,858 A 9/1990 Zelli
4,955,466 A 9/1990 Almes et al.
4,958,832 A 9/1990 Kim
4,960,276 A 10/1990 Feuer et al.
4,964,632 A 10/1990 Rockwell
4,968,028 A 11/1990 Wehrell
4,971,316 A 11/1990 Dalebout et al.
4,974,831 A 12/1990 Dunham
4,974,832 A 12/1990 Dalebout
4,976,424 A 12/1990 Sargeant et al.
4,976,428 A 12/1990 Ghazi
4,976,435 A 12/1990 Shatford
4,984,810 A 1/1991 Stearns et al.
4,986,261 A 1/1991 Iams et al.
4,989,860 A 2/1991 Iams et al.
4,998,725 A 3/1991 Watterson et al.
5,000,440 A 3/1991 Lynch
5,000,442 A 3/1991 Dalebout et al.
5,001,632 A 3/1991 Hall-Tipping
5,002,271 A 3/1991 Gonzales
5,004,224 A 4/1991 Wang
5,007,630 A 4/1991 Real et al.
5,007,631 A 4/1991 Wang
5,013,031 A 5/1991 Bull
5,016,870 A 5/1991 Bulloch et al.
5,020,793 A 6/1991 Loane
5,024,441 A 6/1991 Rousseau
5,026,049 A 6/1991 Goodman
5,027,303 A 6/1991 Witte
5,029,801 A 7/1991 Dalebout et al.
5,031,455 A 7/1991 Cline
5,031,901 A 7/1991 Saarinen
5,034,576 A 7/1991 Dalebout et al.
RE33,662 E 8/1991 Blair et al.
5,037,084 A 8/1991 Flor
5,037,089 A 8/1991 Spagnuolo
5,039,089 A 8/1991 Lapcevic
5,039,091 A 8/1991 Johnson
5,042,799 A 8/1991 Stanley
5,046,382 A 9/1991 Steinberg
5,046,722 A 9/1991 Antoon
5,048,823 A 9/1991 Bean
5,051,638 A 9/1991 Pyles
5,054,770 A 10/1991 Bull
5,058,881 A 10/1991 Measom
5,058,882 A 10/1991 Dalebout et al.
5,058,888 A 10/1991 Walker et al.
5,062,626 A 11/1991 Dalebout et al.
5,062,629 A 11/1991 Vaughan
5,066,000 A 11/1991 Dolan
5,067,710 A 11/1991 Watterson et al.
5,071,115 A 12/1991 Welch
5,072,928 A 12/1991 Stearns et al.
5,072,929 A 12/1991 Peterson et al.
5,074,550 A 12/1991 Sloan
5,077,916 A 1/1992 Beneteau
5,080,353 A 1/1992 Tench
5,081,991 A 1/1992 Chance
5,085,426 A 2/1992 Wanzer et al.
5,085,427 A 2/1992 Finn
5,087,047 A 2/1992 McConnell
5,088,729 A 2/1992 Dalebout
5,094,249 A 3/1992 Marras et al.
5,094,447 A 3/1992 Wang
5,096,225 A 3/1992 Osawa
5,102,122 A 4/1992 Piane, Jr.
5,102,380 A 4/1992 Jacobson et al.
5,104,119 A 4/1992 Lynch
5,104,120 A 4/1992 Watterson et al.
5,108,093 A 4/1992 Watterson
5,109,778 A 5/1992 Berkowitz et al.
5,110,117 A 5/1992 Fisher et al.
5,112,045 A 5/1992 Mason et al.
5,114,388 A 5/1992 Trulaske
5,114,391 A 5/1992 Pitzen et al.
5,123,629 A 6/1992 Takeuchi
5,123,885 A 6/1992 Shields
5,123,886 A 6/1992 Cook
5,129,872 A 7/1992 Dalton et al.
5,131,895 A 7/1992 Rogers, Jr.
5,135,458 A 8/1992 Huang
5,137,501 A 8/1992 Mertesdorf
5,138,730 A 8/1992 Masuda
5,141,480 A 8/1992 Lennox et al.
5,142,358 A 8/1992 Jason
5,145,475 A 9/1992 Cares
5,145,481 A 9/1992 Friedebach
5,147,266 A 9/1992 Ricard
5,149,084 A 9/1992 Dalebout et al.
5,149,312 A 9/1992 Croft et al.
5,158,520 A 10/1992 Lemke et al.
5,162,029 A 11/1992 Schine
5,167,159 A 12/1992 Lucking
5,167,597 A 12/1992 David
5,171,196 A 12/1992 Lynch
5,178,593 A 1/1993 Roberts
5,178,599 A 1/1993 Scott
5,181,894 A 1/1993 Shieng
5,184,295 A 2/1993 Mann
5,184,988 A 2/1993 Dunham
5,186,697 A 2/1993 Rennex
5,192,255 A 3/1993 Dalebout et al.
5,192,257 A 3/1993 Panasewicz
5,192,258 A 3/1993 Keller
5,195,781 A 3/1993 Osawa
5,195,935 A 3/1993 Fencel
5,195,937 A 3/1993 Engel et al.
5,199,931 A 4/1993 Easley et al.
5,201,694 A 4/1993 Zappel
5,203,229 A 4/1993 Chen
5,203,800 A 4/1993 Meredith
5,203,826 A 4/1993 Dalebout
5,205,798 A 4/1993 Lekhtman
5,205,800 A 4/1993 Grant
5,207,489 A 5/1993 Miller
5,207,622 A 5/1993 Wilkinson et al.
5,207,625 A 5/1993 White
5,207,628 A 5/1993 Graham
5,211,617 A 5/1993 Millen
5,215,510 A 6/1993 Baran
5,217,422 A 6/1993 Domzalski
5,226,866 A 7/1993 Engel et al.
5,232,422 A 8/1993 Bishop, Jr.
5,234,392 A 8/1993 Clark
5,240,417 A 8/1993 Smithson et al.
5,242,339 A 9/1993 Thornton
5,242,340 A 9/1993 Jerome
5,242,343 A 9/1993 Miller
5,242,347 A 9/1993 Keeton
5,247,853 A 9/1993 Dalebout
5,250,012 A 10/1993 Brangi
5,250,013 A 10/1993 Brangi
5,254,067 A 10/1993 Habing et al.
5,256,117 A 10/1993 Potts et al.
5,256,118 A 10/1993 Chen
5,256,126 A 10/1993 Grotstein
5,257,701 A 11/1993 Edelson

(56) References Cited

U.S. PATENT DOCUMENTS 5,257,964 A 11/1993 Petters
5,261,864 A 11/1993 Fitzpatrick
5,269,736 A 12/1993 Roberts
5,271,416 A 12/1993 Lepley
5,273,285 A 12/1993 Long
5,277,678 A 1/1994 Friedebach et al.
5,279,528 A 1/1994 Dalebout et al.
5,279,529 A 1/1994 Eschenbach
5,279,531 A 1/1994 Jen-Huey
5,282,776 A 2/1994 Dalebout
5,284,461 A 2/1994 Wilkinson et al.
5,290,205 A 3/1994 Densmore et al.
5,290,211 A 3/1994 Stearns
5,292,293 A 3/1994 Schumacher
5,295,928 A 3/1994 Rennex
5,295,935 A 3/1994 Wang
5,299,992 A 4/1994 Wilkinson
5,299,993 A 4/1994 Habing
5,302,162 A 4/1994 Pasero
5,306,221 A 4/1994 Itaru
5,308,075 A 5/1994 Theriault
5,308,304 A 5/1994 Habing
5,310,392 A 5/1994 Lo
5,313,852 A 5/1994 Arena
5,314,390 A 5/1994 Westing et al.
5,314,391 A 5/1994 Potash et al.
5,314,392 A 5/1994 Hawkins et al.
5,314,394 A 5/1994 Ronan
5,318,487 A 6/1994 Golen et al.
5,320,343 A 6/1994 McKinney
5,320,588 A 6/1994 Wanzer et al.
5,320,591 A 6/1994 Harmon et al.
5,324,242 A 6/1994 Lo
5,328,422 A 7/1994 Nichols
5,328,429 A 7/1994 Potash et al.
5,330,401 A 7/1994 Walstead
5,330,402 A 7/1994 Johnson
5,334,120 A 8/1994 Rasmussen
5,336,144 A 8/1994 Rodden
5,336,145 A 8/1994 Keiser
5,342,264 A 8/1994 Gordon
5,342,271 A 8/1994 Long
RE34,728 E 9/1994 Hall-Tipping
5,344,372 A 9/1994 Hung
5,348,524 A 9/1994 Grant
5,350,344 A 9/1994 Kissel
5,352,166 A 10/1994 Chang
5,352,167 A 10/1994 Ulicny
5,352,169 A 10/1994 Eschenbach
5,353,452 A 10/1994 Rulis
5,354,248 A 10/1994 Rawls et al.
5,354,251 A 10/1994 Sleamaker
5,356,356 A 10/1994 Hildebrandt et al.
5,358,461 A 10/1994 Bailey, Jr.
5,359,986 A 11/1994 Magrath, III et al.
5,362,069 A 11/1994 Hall-Tipping
5,362,295 A 11/1994 Nurge
5,364,327 A 11/1994 Graham
5,368,532 A 11/1994 Farnet
5,372,556 A 12/1994 Ropp
5,372,559 A 12/1994 Dalebout et al.
5,372,560 A 12/1994 Chang
5,372,564 A 12/1994 Spirito
5,374,227 A 12/1994 Webb
5,378,212 A 1/1995 Pin-Kuo
5,380,258 A 1/1995 Hawley, Jr.
5,382,207 A 1/1995 Skowronski et al.
5,382,208 A 1/1995 Hu
5,382,209 A 1/1995 Pasier
5,383,827 A 1/1995 Stern
5,383,828 A 1/1995 Sands et al.
5,385,346 A 1/1995 Carroll et al.
5,385,519 A 1/1995 Hsu
5,387,169 A 2/1995 Wang
5,387,170 A 2/1995 Rawls et al.
5,387,171 A 2/1995 Casey et al.
5,394,922 A 3/1995 Colson et al.
5,396,876 A 3/1995 Liscio et al.
5,398,948 A 3/1995 Mathis
5,401,226 A 3/1995 Stearns
5,403,251 A 4/1995 Belsito et al.
5,403,252 A 4/1995 Leon et al.
5,403,253 A 4/1995 Gaylord
5,403,254 A 4/1995 Lundin et al.
5,403,255 A 4/1995 Johnston
5,406,661 A 4/1995 Pekar
5,407,403 A 4/1995 Coleman
5,407,408 A 4/1995 Wilkinson
5,409,435 A 4/1995 Daniels
RE34,959 E 5/1995 Potts
5,410,971 A 5/1995 Golden et al.
5,417,643 A 5/1995 Taylor
5,419,570 A 5/1995 Bollotte
5,419,571 A 5/1995 Vaughan
5,419,751 A 5/1995 Byrd et al.
5,423,729 A 6/1995 Eschenbach
5,423,730 A 6/1995 Hirsch
5,429,563 A 7/1995 Engel et al.
5,429,569 A 7/1995 Gunnari
5,431,612 A 7/1995 Holden
5,433,679 A 7/1995 Szymczak et al.
5,435,315 A 7/1995 McPhee et al.
5,435,798 A 7/1995 Habing et al.
5,441,467 A 8/1995 Stevens
5,441,468 A 8/1995 Deckers et al.
5,449,334 A 9/1995 Kingsbury
5,454,772 A 10/1995 Rodden
5,454,773 A 10/1995 Blanchard et al.
5,456,648 A 10/1995 Edinburg
5,460,586 A 10/1995 Wilkinson
5,462,503 A 10/1995 Benjamin et al.
5,462,504 A 10/1995 Trulaske et al.
5,466,200 A 11/1995 Ulrich et al.
5,466,203 A 11/1995 Chen
5,470,298 A 11/1995 Curtis
5,471,405 A 11/1995 Marsh
5,474,087 A 12/1995 Nashner
5,474,510 A 12/1995 Chen
5,476,430 A 12/1995 Lee et al.
5,484,358 A 1/1996 Wang et al.
5,484,362 A 1/1996 Skowronski et al.
5,487,707 A 1/1996 Sharf et al.
5,489,249 A 2/1996 Brewer et al.
5,489,250 A 2/1996 Densmore et al.
5,490,818 A 2/1996 Haber et al.
5,492,514 A 2/1996 Daum
5,492,520 A 2/1996 Brown
5,496,235 A 3/1996 Stevens
5,496,236 A 3/1996 Buonauito
5,496,238 A 3/1996 Taylor
5,496,239 A 3/1996 Kallman
5,499,956 A 3/1996 Habing et al.
5,505,011 A 4/1996 Bleimhofer
5,507,271 A 4/1996 Actor
5,509,870 A 4/1996 Lloyd
5,512,025 A 4/1996 Dalebout et al.
5,512,029 A 4/1996 Barnard
5,514,053 A 5/1996 Hawkins et al.
5,518,471 A 5/1996 Hettinger et al.
5,518,473 A 5/1996 Miller
5,520,599 A 5/1996 Chen
5,522,783 A 6/1996 Gordon
5,527,245 A 6/1996 Dalebout et al.
5,529,554 A 6/1996 Eschenbach
5,531,658 A 7/1996 L. S. C.
5,533,899 A 7/1996 Young
5,533,948 A 7/1996 Wilkinson
5,533,951 A 7/1996 Chang
5,538,489 A 7/1996 Magid
5,542,892 A 8/1996 Buhler
5,545,112 A 8/1996 Densmore et al.
5,549,052 A 8/1996 Hoffman
5,549,536 A 8/1996 Clark
5,551,934 A 9/1996 Binette

(56) References Cited

U.S. PATENT DOCUMENTS 5,551,937 A 9/1996 Kwo
5,554,033 A 9/1996 Bizzi et al.
5,554,083 A 9/1996 Chen
5,556,362 A 9/1996 Whipps
5,562,572 A 10/1996 Carmein
5,562,574 A 10/1996 Miller
5,563,487 A 10/1996 Davis
5,568,993 A 10/1996 Potzick
5,569,128 A 10/1996 Dalebout
5,569,138 A 10/1996 Wang et al.
5,573,485 A 11/1996 Geschwender
5,575,740 A 11/1996 Piaget
5,577,985 A 11/1996 Miller
5,577,987 A 11/1996 Brown
5,580,249 A 12/1996 Jacobsen et al.
5,582,563 A 12/1996 Fan
5,584,700 A 12/1996 Feldman et al.
5,584,779 A 12/1996 Knecht
5,585,561 A 12/1996 Bahl et al.
5,586,736 A 12/1996 Mollet
5,588,938 A 12/1996 Schneider et al.
5,590,893 A 1/1997 Robinson et al.
5,591,104 A 1/1997 Andrus et al.
5,591,106 A 1/1997 Dalebout et al.
5,591,107 A 1/1997 Rodgers, Jr.
5,591,908 A 1/1997 Reid
5,593,372 A 1/1997 Rodgers, Jr.
5,593,380 A 1/1997 Bittikofer
5,595,556 A 1/1997 Dalebout et al.
5,599,261 A 2/1997 Easley et al.
5,600,310 A 2/1997 Whipple, III et al.
5,603,675 A 2/1997 Wu
5,603,678 A 2/1997 Wilson
5,607,375 A 3/1997 Dalebout
5,613,216 A 3/1997 Galler
5,613,856 A 3/1997 Hoover
5,616,103 A 4/1997 Lee
5,622,527 A 4/1997 Watterson et al.
5,625,577 A 4/1997 Kunii et al.
5,626,539 A 5/1997 Piaget
5,630,566 A 5/1997 Case
5,632,209 A 5/1997 Sakakibara
5,634,870 A 6/1997 Wilkinson
5,643,142 A 7/1997 Salerno et al.
5,643,144 A 7/1997 Trulaske
5,643,147 A 7/1997 Huang
5,643,152 A 7/1997 Simonson
5,643,153 A 7/1997 Nylen et al.
5,643,157 A 7/1997 Seliber
5,645,509 A 7/1997 Brewer et al.
5,645,914 A 7/1997 Horowitz
5,649,882 A 7/1997 Parikh et al.
5,650,709 A 7/1997 Rotunda et al.
5,653,662 A 8/1997 Rodgers, Jr.
5,655,997 A 8/1997 Greenberg et al.
5,656,003 A 8/1997 Robinson et al.
5,658,227 A 8/1997 Stearns
5,662,557 A 9/1997 Watterson et al.
5,665,031 A 9/1997 Hsieh
5,665,033 A 9/1997 Palmer
5,667,459 A 9/1997 Su
5,669,833 A 9/1997 Stone
5,669,857 A 9/1997 Watterson et al.
5,669,865 A 9/1997 Gordon
5,672,140 A 9/1997 Watterson et al.
5,674,156 A 10/1997 Watterson et al.
5,674,453 A 10/1997 Watterson et al.
5,676,624 A 10/1997 Watterson et al.
5,679,047 A 10/1997 Engel
5,679,101 A 10/1997 Magid
5,683,332 A 11/1997 Watterson et al.
5,685,804 A 11/1997 Whan-Tong et al.
5,688,209 A 11/1997 Trulaske et al.
5,688,216 A 11/1997 Mauriello
5,690,582 A 11/1997 Ulrich et al.
5,690,587 A 11/1997 Gruenangerl
5,690,589 A 11/1997 Rodgers, Jr.
5,692,994 A 12/1997 Eschenbach
5,695,436 A 12/1997 Huang
5,702,325 A 12/1997 Watterson et al.
5,704,879 A 1/1998 Watterson et al.
5,707,319 A 1/1998 Riley
5,708,355 A 1/1998 Schrey
5,709,632 A 1/1998 Socwell
5,709,633 A 1/1998 Sokol
5,711,745 A 1/1998 Yang
5,711,749 A 1/1998 Miller
5,713,549 A 2/1998 Shieh
5,713,821 A 2/1998 Nissen
5,716,308 A 2/1998 Lee
5,718,657 A 2/1998 Dalebout et al.
5,718,660 A 2/1998 Chen
5,720,200 A 2/1998 Anderson et al.
5,720,474 A 2/1998 Sugiyama
5,722,917 A 3/1998 Olschansky et al.
5,722,920 A 3/1998 Bauer
5,722,922 A 3/1998 Watterson et al.
5,725,459 A 3/1998 Rexach
5,730,236 A 3/1998 Miller et al.
5,733,228 A 3/1998 Stevens
5,733,229 A 3/1998 Dalebout et al.
5,735,586 A 4/1998 Cheng
5,735,773 A 4/1998 Vittone
5,735,776 A 4/1998 Swezey
5,738,612 A 4/1998 Tsuda
5,741,205 A 4/1998 Doll et al.
5,743,193 A 4/1998 Kakuta et al.
5,743,832 A 4/1998 Sands et al.
5,743,833 A 4/1998 Watterson et al.
5,743,835 A 4/1998 Trotter
5,746,682 A 5/1998 Hung
5,749,372 A 5/1998 Allen
5,749,787 A 5/1998 Jank
5,749,807 A 5/1998 Webb
5,749,809 A 5/1998 Lin
5,749,813 A 5/1998 Domzalski
5,752,879 A 5/1998 Berdut
5,752,897 A 5/1998 Skowronski et al.
5,755,642 A 5/1998 Miller
5,755,645 A 5/1998 Miller et al.
5,755,651 A 5/1998 Homyonfer
5,759,136 A 6/1998 Chen
5,760,353 A 6/1998 Rapp
5,761,831 A 6/1998 Cho
5,762,587 A 6/1998 Dalebout et al.
5,762,588 A 6/1998 Chen
5,769,759 A 6/1998 Alter
5,771,152 A 6/1998 Dalebout et al.
5,772,522 A 6/1998 Nesbit
5,772,558 A 6/1998 Rodgers, Jr.
5,772,560 A 6/1998 Watterson et al.
5,776,582 A 7/1998 Needham
5,779,599 A 7/1998 Chen
5,779,607 A 7/1998 Harris
5,782,639 A 7/1998 Beal
5,782,723 A 7/1998 Kuo
5,785,630 A 7/1998 Bobick et al.
5,788,609 A 8/1998 Miller
5,788,610 A 8/1998 Eschenbach
5,788,611 A 8/1998 Kuo
5,792,027 A 8/1998 Gvoich
5,792,031 A 8/1998 Alton
5,795,270 A 8/1998 Woods et al.
5,797,578 A 8/1998 Graffeo
5,803,874 A 9/1998 Wilkinson
5,803,877 A 9/1998 Franey
5,803,882 A 9/1998 Habing et al.
5,807,210 A 9/1998 Devlin
5,810,697 A 9/1998 Joiner
5,810,698 A 9/1998 Hullett et al.
5,813,142 A 9/1998 Demon
5,813,947 A 9/1998 Densmore
5,813,953 A 9/1998 Whipple
5,816,981 A 10/1998 Hung

(56) References Cited

U.S. PATENT DOCUMENTS

| | | | |
|---|---|---|---|
| 5,820,478 | A | 10/1998 | Wood et al. |
| 5,823,618 | A | 10/1998 | Fox et al. |
| 5,827,155 | A | 10/1998 | Jensen et al. |
| 5,827,158 | A | 10/1998 | Drecksel |
| 5,830,107 | A | 11/1998 | Brigliadoro |
| 5,830,113 | A | 11/1998 | Coody et al. |
| 5,830,114 | A | 11/1998 | Halfen et al. |
| 5,833,577 | A | 11/1998 | Hurt |
| 5,833,583 | A | 11/1998 | Chuang |
| 5,833,587 | A | 11/1998 | Strong et al. |
| 5,836,770 | A | 11/1998 | Powers |
| 5,839,990 | A | 11/1998 | Virkkala |
| 5,839,993 | A | 11/1998 | Fox |
| 5,842,961 | A | 12/1998 | Davis |
| 5,846,166 | A | 12/1998 | Kuo |
| 5,848,954 | A | 12/1998 | Stearns et al. |
| 5,852,264 | A | 12/1998 | Muller |
| 5,855,537 | A | 1/1999 | Coody et al. |
| 5,855,538 | A | 1/1999 | Argabright |
| 5,857,939 | A | 1/1999 | Kaufman |
| 5,857,940 | A | 1/1999 | Husted |
| 5,857,941 | A | 1/1999 | Maresh |
| 5,857,943 | A | 1/1999 | Murray |
| 5,860,893 | A | 1/1999 | Watterson et al. |
| 5,860,894 | A | 1/1999 | Dalebout et al. |
| 5,860,899 | A | 1/1999 | Rassman |
| 5,865,710 | A | 2/1999 | Wilson-Hyde |
| 5,868,108 | A | 2/1999 | Schmitz et al. |
| 5,868,648 | A | 2/1999 | Coody et al. |
| 5,871,421 | A | 2/1999 | Trulaske et al. |
| 5,876,095 | A | 3/1999 | Johnston |
| 5,879,271 | A | 3/1999 | Stearns et al. |
| 5,879,273 | A | 3/1999 | Wei |
| 5,879,276 | A | 3/1999 | Miller |
| 5,882,281 | A | 3/1999 | Stearns et al. |
| 5,885,197 | A | 3/1999 | Barton |
| 5,888,172 | A | 3/1999 | Andrus et al. |
| 5,890,562 | A | 4/1999 | Bartels et al. |
| 5,890,995 | A | 4/1999 | Bobick et al. |
| 5,891,001 | A | 4/1999 | Carnes et al. |
| 5,891,003 | A | 4/1999 | Deac et al. |
| 5,895,339 | A | 4/1999 | Maresh |
| 5,895,340 | A | 4/1999 | Keller |
| 5,897,457 | A | 4/1999 | Mackovjak |
| 5,897,459 | A | 4/1999 | Habing et al. |
| 5,897,460 | A | 4/1999 | McBride et al. |
| 5,897,461 | A | 4/1999 | Socwell |
| 5,899,833 | A | 5/1999 | Ryan et al. |
| 5,899,834 | A | 5/1999 | Dalebout et al. |
| 5,902,214 | A | 5/1999 | Makikawa et al. |
| 5,904,398 | A | 5/1999 | Farricielli |
| 5,904,636 | A | 5/1999 | Chen |
| 5,906,269 | A | 5/1999 | Zabron et al. |
| 5,906,564 | A | 5/1999 | Jacobsen |
| 5,910,070 | A | 6/1999 | Henry et al. |
| 5,910,072 | A | 6/1999 | Rawls et al. |
| 5,911,132 | A | 6/1999 | Sloane |
| 5,913,751 | A | 6/1999 | Eschenbach |
| 5,916,064 | A | 6/1999 | Eschenbach |
| 5,916,069 | A | 6/1999 | Wang |
| 5,917,692 | A | 6/1999 | Schmitz et al. |
| 5,919,118 | A | 7/1999 | Stearns |
| 5,921,892 | A | 7/1999 | Easton |
| 5,921,896 | A | 7/1999 | Boland |
| 5,925,001 | A | 7/1999 | Hoyt et al. |
| 5,938,551 | A | 8/1999 | Warner |
| 5,938,565 | A | 8/1999 | Bernacki |
| 5,938,570 | A | 8/1999 | Maresh |
| 5,938,571 | A | 8/1999 | Stevens |
| 5,938,575 | A | 8/1999 | Stearns |
| 5,940,502 | A | 8/1999 | Hirai et al. |
| 5,940,911 | A | 8/1999 | Wang |
| 5,941,807 | A | 8/1999 | Cassidy |
| 5,943,794 | A | 8/1999 | Gelsomini |
| 5,944,641 | A | 8/1999 | Habing |
| 5,947,869 | A | 9/1999 | Shea |
| 5,947,872 | A | 9/1999 | Ryan et al. |
| 5,951,444 | A | 9/1999 | Webber |
| 5,951,447 | A | 9/1999 | Butler |
| 5,951,449 | A | 9/1999 | Oppriecht |
| 5,961,423 | A | 10/1999 | Sellers |
| 5,961,430 | A | 10/1999 | Zuckerman et al. |
| 5,967,944 | A | 10/1999 | Vittone et al. |
| 5,967,954 | A | 10/1999 | Habing |
| 5,967,955 | A | 10/1999 | Westfall et al. |
| 5,971,902 | A | 10/1999 | Robertson et al. |
| 5,976,039 | A | 11/1999 | Epel et al. |
| 5,976,061 | A | 11/1999 | Moon et al. |
| 5,980,430 | A | 11/1999 | Wang |
| 5,980,432 | A | 11/1999 | Ahman |
| 5,984,798 | A | 11/1999 | Gilmour |
| 5,984,839 | A | 11/1999 | Corkum |
| 5,989,161 | A | 11/1999 | Wang et al. |
| 5,989,163 | A | 11/1999 | Rodgers, Jr. |
| 5,989,168 | A | 11/1999 | See |
| 5,991,143 | A | 11/1999 | Wright et al. |
| 5,993,358 | A | 11/1999 | Gureghian et al. |
| 5,993,359 | A | 11/1999 | Eschenbach |
| 5,993,362 | A | 11/1999 | Ghobadi |
| 5,997,447 | A | 12/1999 | Giannelli et al. |
| 5,997,450 | A | 12/1999 | Wilkinson |
| 6,003,481 | A | 12/1999 | Pischinger et al. |
| 6,004,244 | A | 12/1999 | Simonson |
| 6,006,379 | A | 12/1999 | Hensley |
| 6,010,432 | A | 1/2000 | Vawter |
| 6,012,591 | A | 1/2000 | Brandenberg |
| 6,012,772 | A | 1/2000 | Conde et al. |
| 6,013,011 | A | 1/2000 | Moore et al. |
| 6,015,367 | A | 1/2000 | Scaramucci |
| 6,015,368 | A | 1/2000 | Clem |
| 6,027,429 | A | 2/2000 | Daniels |
| 6,027,430 | A | 2/2000 | Stearns et al. |
| 6,027,432 | A | 2/2000 | Cheng |
| 6,029,858 | A | 2/2000 | Srokose |
| 6,030,320 | A | 2/2000 | Stearns |
| 6,030,323 | A | 2/2000 | Fontenot |
| 6,033,344 | A | 3/2000 | Trulaske et al. |
| 6,033,347 | A | 3/2000 | Dalebout et al. |
| 6,033,350 | A | 3/2000 | Krull |
| 6,036,622 | A | 3/2000 | Gordon |
| 6,042,512 | A | 3/2000 | Eschenbach |
| 6,042,514 | A | 3/2000 | Abelbeck |
| 6,042,515 | A | 3/2000 | Wang |
| 6,042,516 | A | 3/2000 | Norton |
| 6,042,518 | A | 3/2000 | Hildebrandt et al. |
| 6,042,523 | A | 3/2000 | Graham |
| 6,045,487 | A | 4/2000 | Miller |
| 6,045,488 | A | 4/2000 | Eschenbach |
| 6,045,491 | A | 4/2000 | McNergney et al. |
| 6,050,920 | A | 4/2000 | Ehrenfried |
| 6,050,921 | A | 4/2000 | Wang |
| 6,050,922 | A | 4/2000 | Wang |
| 6,050,923 | A | 4/2000 | Yu |
| 6,053,844 | A | 4/2000 | Clem |
| 6,053,847 | A | 4/2000 | Stearns et al. |
| 6,053,848 | A | 4/2000 | Eschenbach |
| 6,055,747 | A | 5/2000 | Lombardino |
| 6,056,678 | A | 5/2000 | Giannelli et al. |
| 6,059,692 | A | 5/2000 | Hickman |
| 6,059,695 | A | 5/2000 | Hung |
| 6,063,009 | A | 5/2000 | Stearns |
| 6,066,075 | A | 5/2000 | Poulton |
| 6,068,578 | A | 5/2000 | Wang |
| 6,068,579 | A | 5/2000 | Killian et al. |
| 6,071,031 | A | 6/2000 | Bailey |
| 6,071,216 | A | 6/2000 | Giannelli et al. |
| 6,075,525 | A | 6/2000 | Hsieh |
| 6,077,196 | A | 6/2000 | Eschenbach |
| 6,077,198 | A | 6/2000 | Eschenbach |
| 6,077,199 | A | 6/2000 | Hsu |
| 6,077,200 | A | 6/2000 | Lin |
| 6,080,091 | A | 6/2000 | Habing et al. |
| 6,086,520 | A | 7/2000 | Rodriquez |
| 6,090,014 | A | 7/2000 | Eschenbach |

(56) References Cited

U.S. PATENT DOCUMENTS

| | | | |
|---|---|---|---|
| 6,090,016 | A | 7/2000 | Kuo |
| 6,095,951 | A | 8/2000 | Skowronski et al. |
| 6,099,439 | A | 8/2000 | Ryan et al. |
| 6,102,412 | A | 8/2000 | Staffaroni |
| 6,102,832 | A | 8/2000 | Tani |
| 6,110,076 | A | 8/2000 | Hurt |
| 6,110,077 | A | 8/2000 | Yu |
| 6,113,188 | A | 9/2000 | Stewart et al. |
| 6,113,522 | A | 9/2000 | Montgomery |
| 6,117,049 | A | 9/2000 | Lowe |
| 6,120,421 | A | 9/2000 | Kuo |
| 6,123,646 | A | 9/2000 | Colassi |
| 6,123,647 | A | 9/2000 | Mitchell |
| 6,123,648 | A | 9/2000 | Stevens |
| 6,123,649 | A | 9/2000 | Lee |
| 6,123,650 | A | 9/2000 | Birrell |
| 6,125,851 | A | 10/2000 | Walker et al. |
| 6,126,574 | A | 10/2000 | Stearns et al. |
| 6,126,575 | A | 10/2000 | Wang |
| 6,126,576 | A | 10/2000 | Wang |
| 6,129,962 | A | 10/2000 | Quigley et al. |
| 6,132,340 | A | 10/2000 | Wang |
| 6,135,924 | A | 10/2000 | Gibbs et al. |
| 6,135,925 | A | 10/2000 | Liu |
| 6,142,870 | A | 11/2000 | Wada et al. |
| 6,142,913 | A | 11/2000 | Ewert |
| 6,142,914 | A | 11/2000 | Crawford et al. |
| 6,142,915 | A | 11/2000 | Eschenbach |
| 6,146,313 | A | 11/2000 | Whan-Tong et al. |
| 6,146,315 | A | 11/2000 | Schonenberger |
| 6,149,551 | A | 11/2000 | Pyles et al. |
| 6,149,552 | A | 11/2000 | Chen |
| 6,152,856 | A | 11/2000 | Studor et al. |
| 6,152,859 | A | 11/2000 | Stearns |
| 6,162,183 | A | 12/2000 | Hoover |
| 6,163,451 | A | 12/2000 | Chiu |
| 6,165,107 | A | 12/2000 | Birrell |
| 6,168,551 | B1 | 1/2001 | Mcguinness |
| 6,171,216 | B1 | 1/2001 | Wang |
| 6,174,267 | B1 | 1/2001 | Dalebout |
| 6,174,268 | B1 | 1/2001 | Novak |
| 6,176,814 | B1 | 1/2001 | Ryan et al. |
| 6,179,753 | B1 | 1/2001 | Barker et al. |
| 6,181,647 | B1 | 1/2001 | Tipton et al. |
| 6,183,397 | B1 | 2/2001 | Stearns et al. |
| 6,186,290 | B1 | 2/2001 | Carlson |
| 6,186,460 | B1 | 2/2001 | Lin |
| 6,186,929 | B1 | 2/2001 | Endelman et al. |
| 6,189,846 | B1 | 2/2001 | Wang |
| 6,190,289 | B1 | 2/2001 | Pyles et al. |
| 6,193,635 | B1 | 2/2001 | Webber et al. |
| 6,203,474 | B1 | 3/2001 | Jones |
| 6,206,795 | B1 | 3/2001 | Ou |
| 6,210,305 | B1 | 4/2001 | Eschenbach |
| 6,213,919 | B1 | 4/2001 | Wang |
| 6,215,870 | B1 | 4/2001 | Hirai et al. |
| 6,217,487 | B1 | 4/2001 | Reinert |
| 6,220,990 | B1 | 4/2001 | Crivello |
| 6,220,995 | B1 | 4/2001 | Chen |
| 6,224,516 | B1 | 5/2001 | Disch |
| 6,224,519 | B1 | 5/2001 | Doolittle |
| 6,230,047 | B1 | 5/2001 | McHugh |
| 6,230,460 | B1 | 5/2001 | Huyett |
| 6,231,946 | B1 | 5/2001 | Brown, Jr. et al. |
| 6,234,935 | B1 | 5/2001 | Chu |
| 6,234,936 | B1 | 5/2001 | Wang |
| 6,237,583 | B1 | 5/2001 | Ripley et al. |
| 6,238,323 | B1 | 5/2001 | Simonson |
| 6,241,638 | B1 | 6/2001 | Hurt |
| 6,244,988 | B1 | 6/2001 | Delman |
| 6,244,992 | B1 | 6/2001 | James |
| 6,245,001 | B1 | 6/2001 | Siaperas |
| 6,251,047 | B1 | 6/2001 | Stearns et al. |
| 6,251,048 | B1 | 6/2001 | Kaufman |
| 6,254,514 | B1 | 7/2001 | Maresh et al. |
| 6,254,515 | B1 | 7/2001 | Carman et al. |
| 6,261,209 | B1 | 7/2001 | Coody |
| 6,264,586 | B1 | 7/2001 | Webber |
| 6,267,710 | B1 | 7/2001 | Liu |
| 6,273,842 | B1 | 8/2001 | Wang |
| 6,273,843 | B1 | 8/2001 | Lo |
| 6,276,749 | B1 | 8/2001 | Okazawa et al. |
| 6,277,054 | B1 | 8/2001 | Kuo |
| 6,277,056 | B1 | 8/2001 | McBride et al. |
| 6,280,361 | B1 | 8/2001 | Harvey et al. |
| 6,280,362 | B1 | 8/2001 | Dalebout et al. |
| 6,280,367 | B1 | 8/2001 | Arsenault |
| 6,282,816 | B1 | 9/2001 | Rosendahl |
| 6,283,896 | B1 | 9/2001 | Grunfeld |
| 6,287,240 | B1 | 9/2001 | Trabbic |
| 6,293,375 | B1 | 9/2001 | Chen |
| 6,299,959 | B1 | 10/2001 | Squires et al. |
| 6,302,815 | B1 | 10/2001 | Shishido et al. |
| 6,302,826 | B1 | 10/2001 | Lee |
| 6,302,828 | B1 | 10/2001 | Martin et al. |
| 6,302,829 | B1 | 10/2001 | Schmidt |
| 6,302,830 | B1 | 10/2001 | Stearns |
| 6,302,833 | B1 | 10/2001 | Ellis et al. |
| 6,306,108 | B1 | 10/2001 | Butler |
| 6,307,167 | B1 | 10/2001 | Kajio et al. |
| 6,312,363 | B1 | 11/2001 | Watterson et al. |
| 6,314,667 | B1 | 11/2001 | Rife et al. |
| 6,315,486 | B1 | 11/2001 | Lunz |
| 6,322,059 | B1 | 11/2001 | Kelm et al. |
| 6,322,481 | B1 | 11/2001 | Krull |
| 6,325,745 | B1 | 12/2001 | Yu |
| 6,325,746 | B1 | 12/2001 | Wang |
| 6,328,676 | B1 | 12/2001 | Alessandri |
| 6,328,677 | B1 | 12/2001 | Drapeau |
| 6,334,624 | B1 | 1/2002 | Giglio |
| 6,344,986 | B1 | 2/2002 | Jain et al. |
| 6,347,603 | B1 | 2/2002 | Felger |
| 6,348,028 | B1 | 2/2002 | Cragg |
| 6,350,218 | B1 | 2/2002 | Dalebout et al. |
| 6,352,494 | B2 | 3/2002 | McAlonan |
| 6,357,077 | B1 | 3/2002 | Jones, Jr. et al. |
| 6,361,476 | B1 | 3/2002 | Eschenbach |
| 6,368,252 | B1 | 4/2002 | Stearns |
| 6,368,254 | B1 | 4/2002 | Wall |
| 6,371,738 | B2 | 4/2002 | Jones |
| 6,371,895 | B1 | 4/2002 | Endelman et al. |
| 6,375,580 | B1 | 4/2002 | Schmidt |
| 6,379,289 | B1 | 4/2002 | Gossie |
| 6,382,627 | B1 | 5/2002 | Lundberg |
| 6,383,120 | B1 | 5/2002 | Lo |
| 6,387,015 | B1 | 5/2002 | Watson |
| 6,387,016 | B1 | 5/2002 | Lo |
| 6,390,953 | B1 | 5/2002 | Maresh |
| 6,390,955 | B1 | 5/2002 | Wang |
| 6,394,239 | B1 | 5/2002 | Carlson |
| 6,397,797 | B1 | 6/2002 | Kolmanovsky et al. |
| 6,398,695 | B2 | 6/2002 | Miller |
| 6,402,666 | B2 | 6/2002 | Krull |
| 6,409,632 | B1 | 6/2002 | Eschenbach |
| 6,409,633 | B1 | 6/2002 | Abelbeck |
| 6,413,197 | B2 | 7/2002 | McKechnie et al. |
| 6,416,442 | B1 | 7/2002 | Stearns et al. |
| 6,416,444 | B1 | 7/2002 | Lim |
| 6,419,611 | B1 | 7/2002 | Levine et al. |
| 6,422,976 | B1 | 7/2002 | Eschenbach |
| 6,422,983 | B1 | 7/2002 | Weck |
| 6,428,449 | B1 | 8/2002 | Apseloff |
| 6,430,997 | B1 | 8/2002 | French et al. |
| 6,432,026 | B1 | 8/2002 | Wang |
| 6,435,466 | B1 | 8/2002 | Adams |
| 6,436,007 | B1 | 8/2002 | Eschenbach |
| 6,436,008 | B1 | 8/2002 | Skowronski et al. |
| 6,440,013 | B1 | 8/2002 | Brown |
| 6,440,042 | B2 | 8/2002 | Eschenbach |
| 6,443,875 | B1 | 9/2002 | Golen, Jr. et al. |
| 6,447,424 | B1 | 9/2002 | Ashby et al. |
| 6,447,430 | B1 | 9/2002 | Webb et al. |
| 6,450,284 | B1 | 9/2002 | Sakyo et al. |
| 6,450,922 | B1 | 9/2002 | Henderson et al. |

(56) References Cited

U.S. PATENT DOCUMENTS

| | | | |
|---|---|---|---|
| 6,450,923 | B1 | 9/2002 | Vatti |
| 6,450,925 | B1 | 9/2002 | Kuo |
| 6,454,679 | B1 | 9/2002 | Radow |
| 6,454,682 | B1 | 9/2002 | Kuo |
| 6,455,960 | B1 | 9/2002 | Trago et al. |
| 6,458,060 | B1 | 10/2002 | Watterson et al. |
| 6,461,275 | B1 | 10/2002 | Wang et al. |
| 6,461,279 | B1 | 10/2002 | Kuo |
| 6,466,460 | B1 | 10/2002 | Rein et al. |
| 6,468,189 | B2 | 10/2002 | Alessandri |
| 6,471,622 | B1 | 10/2002 | Hammer et al. |
| 6,475,121 | B2 | 11/2002 | Wang |
| 6,478,721 | B1 | 11/2002 | Hunter |
| 6,482,128 | B1 | 11/2002 | Michalow |
| 6,482,130 | B1 | 11/2002 | Pasero et al. |
| 6,482,132 | B2 | 11/2002 | Eschenbach |
| 6,485,397 | B1 | 11/2002 | Manderbacka |
| 6,488,020 | B1 | 12/2002 | Rosas-Magallan |
| 6,491,610 | B1 | 12/2002 | Henn |
| 6,494,814 | B1 | 12/2002 | Wang |
| 6,494,817 | B2 | 12/2002 | Lake |
| 6,500,097 | B1 | 12/2002 | Hall |
| 6,503,173 | B2 | 1/2003 | Clem |
| 6,505,503 | B1 | 1/2003 | Teresi et al. |
| 6,513,669 | B2 | 2/2003 | Ozawa et al. |
| 6,514,180 | B1 | 2/2003 | Rawls |
| 6,520,891 | B1 | 2/2003 | Stephens, Jr. |
| 6,527,674 | B1 | 3/2003 | Clem |
| 6,527,678 | B1 | 3/2003 | Wang |
| 6,527,685 | B2 | 3/2003 | Endelman et al. |
| 6,527,796 | B1 | 3/2003 | Magovern |
| 6,530,864 | B1 | 3/2003 | Parks |
| 6,533,707 | B2 | 3/2003 | Wang |
| 6,537,184 | B2 | 3/2003 | Kim |
| 6,539,931 | B2 | 4/2003 | Trajkovic et al. |
| 6,543,247 | B2 | 4/2003 | Strauss |
| 6,544,146 | B1 | 4/2003 | Stearns et al. |
| 6,547,701 | B1 | 4/2003 | Eschenbach |
| 6,547,702 | B1 | 4/2003 | Heidecke |
| 6,551,218 | B2 | 4/2003 | Goh |
| 6,551,223 | B2 | 4/2003 | Cheng |
| 6,554,749 | B2 | 4/2003 | Iund et al. |
| 6,558,301 | B1 | 5/2003 | Jackson |
| 6,561,960 | B2 | 5/2003 | Webber |
| 6,563,489 | B1 | 5/2003 | Latypov et al. |
| 6,569,061 | B2 | 5/2003 | Stearns et al. |
| 6,569,062 | B2 | 5/2003 | Wang |
| 6,572,511 | B1 | 6/2003 | Volpe |
| 6,572,512 | B2 | 6/2003 | Anderson et al. |
| 6,572,513 | B1 | 6/2003 | Whan-Tong et al. |
| 6,575,878 | B1 | 6/2003 | Choy |
| 6,579,210 | B1 | 6/2003 | Stearns et al. |
| 6,582,342 | B2 | 6/2003 | Kaufman |
| 6,582,344 | B2 | 6/2003 | Tang |
| 6,585,624 | B1 | 7/2003 | Chen |
| 6,585,626 | B2 | 7/2003 | McBride |
| 6,589,138 | B2 | 7/2003 | Dyer et al. |
| 6,592,502 | B1 | 7/2003 | Phillips |
| 6,599,223 | B2 | 7/2003 | Wang |
| 6,601,016 | B1 | 7/2003 | Brown et al. |
| 6,601,358 | B2 | 8/2003 | Panatta |
| 6,601,825 | B2 | 8/2003 | Bressner et al. |
| 6,604,008 | B2 | 8/2003 | Chudley et al. |
| 6,605,020 | B1 | 8/2003 | Huang |
| 6,609,478 | B2 | 8/2003 | Del Valle |
| 6,610,063 | B2 | 8/2003 | Kumar et al. |
| 6,612,969 | B2 | 9/2003 | Eschenbach |
| 6,612,971 | B1 | 9/2003 | Morris |
| 6,619,681 | B2 | 9/2003 | Gutierrez |
| 6,620,079 | B2 | 9/2003 | Kuo |
| 6,623,407 | B2 | 9/2003 | Novak |
| 6,623,409 | B1 | 9/2003 | Abelbeck |
| 6,626,799 | B2 | 9/2003 | Watterson et al. |
| 6,626,802 | B1 | 9/2003 | Rodgers, Jr. |
| 6,626,803 | B1 | 9/2003 | Oglesby et al. |
| 6,629,902 | B2 | 10/2003 | Murphy et al. |
| 6,629,909 | B1 | 10/2003 | Stearns et al. |
| 6,629,910 | B1 | 10/2003 | Krull |
| 6,632,161 | B1 | 10/2003 | Nir |
| 6,634,996 | B2 | 10/2003 | Jacobsen |
| 6,637,811 | B2 | 10/2003 | Zheng |
| 6,637,818 | B2 | 10/2003 | Williams |
| 6,645,125 | B1 | 11/2003 | Stearns et al. |
| 6,645,126 | B1 | 11/2003 | Martin et al. |
| 6,645,130 | B2 | 11/2003 | Webber |
| 6,648,800 | B2 | 11/2003 | Stearns et al. |
| 6,648,801 | B2 | 11/2003 | Stearns et al. |
| 6,648,802 | B2 | 11/2003 | Ware |
| 6,652,424 | B2 | 11/2003 | Dalebout |
| 6,652,425 | B1 | 11/2003 | Martin et al. |
| 6,652,429 | B2 | 11/2003 | Bushnell |
| 6,660,949 | B2 | 12/2003 | Kamino et al. |
| 6,661,136 | B1 | 12/2003 | Lee |
| 6,663,127 | B2 | 12/2003 | Miller |
| 6,663,498 | B2 | 12/2003 | Stipan |
| 6,663,500 | B2 | 12/2003 | Huang |
| 6,666,800 | B2 | 12/2003 | Krull |
| 6,666,801 | B1 | 12/2003 | Michalow |
| 6,668,678 | B1 | 12/2003 | Baba et al. |
| 6,669,600 | B2 | 12/2003 | Warner |
| 6,669,609 | B2 | 12/2003 | Gerschefske et al. |
| 6,671,975 | B2 | 1/2004 | Hennessey |
| 6,672,991 | B2 | 1/2004 | O'Malley |
| 6,672,992 | B1 | 1/2004 | Lo et al. |
| 6,672,994 | B1 | 1/2004 | Stearns et al. |
| 6,676,530 | B2 | 1/2004 | Lochtefeld |
| 6,676,572 | B2 | 1/2004 | Wang |
| 6,676,579 | B1 | 1/2004 | Lin |
| 6,679,816 | B1 | 1/2004 | Krull |
| 6,679,820 | B2 | 1/2004 | Barkus et al. |
| 6,681,704 | B1 | 1/2004 | Brookhiser |
| 6,681,728 | B2 | 1/2004 | Haghgooie |
| 6,682,460 | B2 | 1/2004 | Lo |
| 6,682,461 | B2 | 1/2004 | Wang |
| 6,685,601 | B1 | 2/2004 | Knapp |
| 6,685,602 | B2 | 2/2004 | Colosky, Jr. et al. |
| 6,685,607 | B1 | 2/2004 | Olson |
| 6,689,019 | B2 | 2/2004 | Ohrt et al. |
| 6,695,694 | B2 | 2/2004 | Ishikawa et al. |
| 6,698,110 | B1 | 3/2004 | Robbins |
| 6,699,159 | B2 | 3/2004 | Rouse |
| 6,699,162 | B2 | 3/2004 | Chen |
| 6,702,719 | B1 | 3/2004 | Brown et al. |
| 6,705,977 | B1 | 3/2004 | Ziak |
| 6,708,427 | B2 | 3/2004 | Sussmann et al. |
| 6,712,737 | B1 | 3/2004 | Nusbaum |
| 6,716,142 | B2 | 4/2004 | Kuo |
| 6,716,144 | B1 | 4/2004 | Shifferaw |
| 6,719,667 | B2 | 4/2004 | Wong et al. |
| 6,719,669 | B1 | 4/2004 | Wang |
| 6,723,413 | B2 | 4/2004 | Walters |
| 6,726,600 | B2 | 4/2004 | Miller |
| 6,726,601 | B1 | 4/2004 | Beutel |
| 6,726,602 | B2 | 4/2004 | Chang |
| 6,733,423 | B1 | 5/2004 | Chang |
| 6,733,424 | B2 | 5/2004 | Krull |
| 6,736,360 | B1 | 5/2004 | Buczek |
| 6,738,274 | B2 | 5/2004 | Prasad et al. |
| 6,740,009 | B1 | 5/2004 | Hall |
| 6,741,052 | B2 | 5/2004 | Fitzgibbon |
| 6,743,153 | B2 | 6/2004 | Watterson et al. |
| 6,746,371 | B1 | 6/2004 | Brown et al. |
| 6,747,427 | B1 | 6/2004 | Carson |
| 6,749,540 | B1 | 6/2004 | Pasero et al. |
| 6,749,542 | B2 | 6/2004 | Wu |
| 6,758,790 | B1 | 7/2004 | Ellis |
| 6,758,791 | B1 | 7/2004 | Kuo |
| 6,758,792 | B1 | 7/2004 | Chang |
| 6,761,387 | B2 | 7/2004 | Sloss |
| 6,761,667 | B1 | 7/2004 | Cutler et al. |
| 6,764,429 | B1 | 7/2004 | Michalow |
| 6,764,430 | B1 | 7/2004 | Fencel |
| 6,764,431 | B2 | 7/2004 | Yoss |
| 6,765,726 | B2 | 7/2004 | French et al. |

(56) References Cited

U.S. PATENT DOCUMENTS

| | | | |
|---|---|---|---|
| 6,767,314 | B2 | 7/2004 | Thompson |
| 6,770,015 | B2 | 8/2004 | Simonson |
| 6,776,740 | B1 | 8/2004 | Anderson et al. |
| 6,778,938 | B1 | 8/2004 | Ng et al. |
| 6,783,482 | B2 | 8/2004 | Oglesby et al. |
| 6,786,821 | B2 | 9/2004 | Nobe et al. |
| 6,786,847 | B1 | 9/2004 | Morgan et al. |
| 6,786,848 | B2 | 9/2004 | Yamashita et al. |
| 6,786,850 | B2 | 9/2004 | Nizamuddin |
| 6,786,852 | B2 | 9/2004 | Watterson et al. |
| 6,790,162 | B1 | 9/2004 | Ellis et al. |
| 6,793,607 | B2 | 9/2004 | Neil |
| 6,793,609 | B1 | 9/2004 | Fan |
| 6,796,159 | B2 | 9/2004 | Kelm et al. |
| 6,796,927 | B2 | 9/2004 | Toyama |
| 6,808,458 | B1 | 10/2004 | Jung |
| 6,808,475 | B2 | 10/2004 | Kehrbaum |
| 6,811,519 | B2 | 11/2004 | Kuo |
| 6,811,520 | B2 | 11/2004 | Wu |
| 6,817,117 | B1 | 11/2004 | Campbell |
| 6,817,968 | B2 | 11/2004 | Galbraith et al. |
| 6,821,230 | B2 | 11/2004 | Dalebout et al. |
| 6,824,210 | B2 | 11/2004 | Zheng |
| 6,824,502 | B1 | 11/2004 | Huang |
| 6,830,540 | B2 | 12/2004 | Watterson |
| 6,830,541 | B2 | 12/2004 | Wu |
| 6,835,166 | B1 | 12/2004 | Stearns et al. |
| 6,837,829 | B2 | 1/2005 | Eschenbach |
| 6,837,830 | B2 | 1/2005 | Eldridge |
| 6,837,838 | B2 | 1/2005 | List |
| 6,840,892 | B1 | 1/2005 | Wu |
| 6,842,928 | B2 | 1/2005 | Yang et al. |
| 6,843,732 | B1 | 1/2005 | Huang |
| 6,846,272 | B2 | 1/2005 | Rosenow et al. |
| 6,849,032 | B2 | 2/2005 | Chu |
| 6,852,068 | B2 | 2/2005 | Ogawa |
| 6,855,093 | B2 | 2/2005 | Anderson et al. |
| 6,855,097 | B2 | 2/2005 | Krull |
| 6,857,993 | B2 | 2/2005 | Yeh |
| 6,860,836 | B1 | 3/2005 | Wu |
| 6,860,839 | B1 | 3/2005 | Dice |
| 6,872,168 | B2 | 3/2005 | Wang et al. |
| 6,872,175 | B2 | 3/2005 | Lin |
| 6,875,157 | B1 | 4/2005 | Wang |
| 6,875,160 | B2 | 4/2005 | Watterson et al. |
| 6,878,101 | B2 | 4/2005 | Colley |
| 6,880,487 | B2 | 4/2005 | Reinkensmeyer et al. |
| 6,881,176 | B2 | 4/2005 | Oishi et al. |
| 6,887,185 | B1 | 5/2005 | Kuo |
| 6,887,190 | B1 | 5/2005 | Azari |
| 6,893,383 | B1 | 5/2005 | Chang et al. |
| 6,896,645 | B1 | 5/2005 | Krull |
| 6,899,657 | B2 | 5/2005 | Chuang |
| 6,899,659 | B2 | 5/2005 | Anderson et al. |
| 6,902,513 | B1 | 6/2005 | Mcclure |
| 6,902,515 | B2 | 6/2005 | Howell et al. |
| 6,905,446 | B2 | 6/2005 | Greenland |
| 6,908,416 | B2 | 6/2005 | Mercado et al. |
| 6,908,417 | B2 | 6/2005 | Jackson |
| 6,913,562 | B2 | 7/2005 | Chen |
| 6,913,563 | B2 | 7/2005 | Chen |
| 6,916,278 | B2 | 7/2005 | Webber |
| 6,918,858 | B2 | 7/2005 | Watterson et al. |
| 6,918,859 | B1 | 7/2005 | Yeh |
| 6,918,860 | B1 | 7/2005 | Nusbaum |
| 6,921,354 | B1 | 7/2005 | Shifferaw |
| 6,921,355 | B2 | 7/2005 | Campanaro et al. |
| 6,923,746 | B1 | 8/2005 | Skowronski et al. |
| 6,923,747 | B1 | 8/2005 | Chu |
| 6,926,644 | B2 | 8/2005 | Chen |
| 6,926,646 | B1 | 8/2005 | Nguyen |
| 6,932,745 | B1 | 8/2005 | Ellis |
| 6,939,271 | B1 | 9/2005 | Whan-Tong et al. |
| 6,944,294 | B2 | 9/2005 | Tsay |
| 6,945,912 | B2 | 9/2005 | Levi |
| 6,945,917 | B1 | 9/2005 | Baatz |
| 6,949,053 | B1 | 9/2005 | Stearns |
| 6,949,054 | B1 | 9/2005 | Stearns |
| 6,953,418 | B1 | 10/2005 | Chen |
| 6,964,632 | B1 | 11/2005 | Ko |
| 6,966,872 | B2 | 11/2005 | Eschenbach |
| 6,976,698 | B2 | 12/2005 | Kuiken |
| 6,979,283 | B2 | 12/2005 | Pan |
| 6,991,588 | B1 | 1/2006 | Adams |
| 6,994,306 | B1 | 2/2006 | Sweere et al. |
| 6,994,657 | B1 | 2/2006 | Eschenbach |
| 6,997,852 | B2 | 2/2006 | Watterson et al. |
| 6,997,856 | B1 | 2/2006 | Krull |
| 7,001,288 | B2 | 2/2006 | Harrell |
| 7,003,122 | B2 | 2/2006 | Chen |
| 7,004,271 | B1 | 2/2006 | Kamen et al. |
| 7,004,887 | B2 | 2/2006 | Pan et al. |
| 7,004,888 | B1 | 2/2006 | Weng |
| 7,008,359 | B2 | 3/2006 | Fan et al. |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,022,048 | B1 | 4/2006 | Fernandez |
| 7,022,049 | B2 | 4/2006 | Ryan et al. |
| 7,022,051 | B2 | 4/2006 | Ota |
| 7,032,870 | B2 | 4/2006 | Sweere et al. |
| 7,033,176 | B2 | 4/2006 | Feldman |
| 7,033,306 | B2 | 4/2006 | Graber |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,044,891 | B1 | 5/2006 | Rivera |
| 7,052,426 | B2 | 5/2006 | Battat et al. |
| 7,052,440 | B2 | 5/2006 | Pyles et al. |
| 7,052,444 | B2 | 5/2006 | Webber |
| 7,052,446 | B2 | 5/2006 | Morris et al. |
| 7,055,899 | B2 | 6/2006 | Zhurong et al. |
| 7,060,005 | B2 | 6/2006 | Carlsen et al. |
| 7,060,006 | B1 | 6/2006 | Watterson et al. |
| 7,070,542 | B2 | 7/2006 | Reyes et al. |
| 7,070,545 | B2 | 7/2006 | Lull et al. |
| 7,073,852 | B1 | 7/2006 | Zheng |
| 7,077,788 | B2 | 7/2006 | Chang |
| 7,077,791 | B2 | 7/2006 | Krull |
| 7,081,073 | B1 | 7/2006 | Smith |
| 7,082,703 | B2 | 8/2006 | Greene et al. |
| 7,086,994 | B2 | 8/2006 | Turak et al. |
| 7,090,621 | B2 | 8/2006 | Loane |
| 7,090,622 | B2 | 8/2006 | Hetrick |
| 7,097,591 | B2 | 8/2006 | Moon |
| 7,097,593 | B2 | 8/2006 | Chang |
| 7,100,517 | B1 | 9/2006 | Godwin |
| 7,101,319 | B1 | 9/2006 | Potts |
| 7,101,322 | B2 | 9/2006 | Carle |
| 7,101,330 | B2 | 9/2006 | Elbaz et al. |
| 7,104,926 | B2 | 9/2006 | Carlson |
| 7,104,937 | B2 | 9/2006 | Arbuckle |
| 7,108,641 | B2 | 9/2006 | Pertegaz-Esteban |
| 7,108,659 | B2 | 9/2006 | Ross et al. |
| 7,115,073 | B2 | 10/2006 | Nizamuddin |
| 7,125,371 | B2 | 10/2006 | Henderson |
| 7,132,939 | B2 | 11/2006 | Tyndall et al. |
| 7,140,626 | B1 | 11/2006 | Keay |
| 7,141,008 | B2 | 11/2006 | Krull et al. |
| 7,156,776 | B2 | 1/2007 | Maser |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,172,531 | B2 | 2/2007 | Rodgers, Jr. |
| 7,175,193 | B2 | 2/2007 | Wu |
| 7,179,207 | B2 | 2/2007 | Gerschefske |
| 7,179,208 | B1 | 2/2007 | Nalley |

(56) References Cited

U.S. PATENT DOCUMENTS

| | | | |
|---|---|---|---|
| 7,179,209 | B2 | 2/2007 | Sechrest et al. |
| 7,186,189 | B2 | 3/2007 | Huang |
| 7,192,387 | B2 | 3/2007 | Mendel |
| 7,192,388 | B2 | 3/2007 | Dalebout et al. |
| 7,195,568 | B2 | 3/2007 | Huang |
| 7,201,705 | B2 | 4/2007 | Rodgers, Jr. |
| 7,201,707 | B1 | 4/2007 | Moon |
| 7,204,328 | B2 | 4/2007 | LoPresti |
| 7,211,029 | B2 | 5/2007 | Kau |
| 7,217,224 | B2 | 5/2007 | Thomas |
| 7,217,225 | B2 | 5/2007 | Husted et al. |
| 7,220,219 | B2 | 5/2007 | Papadopoulos et al. |
| 7,220,221 | B2 | 5/2007 | Mosimann et al. |
| 7,223,209 | B2 | 5/2007 | Lee |
| 7,223,216 | B1 | 5/2007 | McBride |
| 7,225,694 | B2 | 6/2007 | Said |
| 7,226,402 | B1 | 6/2007 | Joya |
| 7,235,942 | B2 | 6/2007 | Nagaoka et al. |
| 7,238,147 | B2 | 7/2007 | Mills et al. |
| 7,247,128 | B2 | 7/2007 | Oga |
| 7,250,022 | B2 | 7/2007 | Dalebout |
| 7,257,468 | B1 | 8/2007 | Costa et al. |
| 7,258,651 | B2 | 8/2007 | Clarke |
| 7,264,554 | B2 | 9/2007 | Bentley |
| 7,269,038 | B2 | 9/2007 | Shekhawat |
| 7,278,934 | B2 | 10/2007 | McBride et al. |
| 7,278,955 | B2 | 10/2007 | Giannelli et al. |
| 7,278,966 | B2 | 10/2007 | Hjelt et al. |
| 7,279,868 | B2 | 10/2007 | Lanni |
| 7,285,075 | B2 | 10/2007 | Cutler et al. |
| 7,287,770 | B2 | 10/2007 | Drabant et al. |
| 7,290,760 | B1 | 11/2007 | Lindsay |
| 7,291,096 | B2 | 11/2007 | Ho |
| 7,292,151 | B2 | 11/2007 | Ferguson |
| 7,293,510 | B1 | 11/2007 | Siao |
| 7,294,094 | B1 | 11/2007 | Howle |
| 7,294,100 | B2 | 11/2007 | Bull |
| 7,303,508 | B2 | 12/2007 | Toyama et al. |
| 7,303,510 | B2 | 12/2007 | Gebhardt |
| 7,311,640 | B2 | 12/2007 | Baatz |
| 7,316,633 | B2 | 1/2008 | Liao et al. |
| 7,319,457 | B2 | 1/2008 | Lin et al. |
| 7,322,907 | B2 | 1/2008 | Bowser |
| 7,334,350 | B2 | 2/2008 | Ellis, III |
| 7,335,139 | B2 | 2/2008 | Bartholomew et al. |
| 7,335,140 | B2 | 2/2008 | Webber et al. |
| 7,335,147 | B2 | 2/2008 | Jones |
| 7,344,481 | B2 | 3/2008 | Watterson et al. |
| 7,346,935 | B1 | 3/2008 | Patterson |
| 7,347,806 | B2 | 3/2008 | Nakano et al. |
| 7,351,187 | B2 | 4/2008 | Seliber |
| 7,352,365 | B2 | 4/2008 | Trachte |
| 7,354,380 | B2 | 4/2008 | Volpe, Jr. |
| 7,357,758 | B2 | 4/2008 | Polk, III |
| 7,359,121 | B2 | 4/2008 | French et al. |
| 7,361,125 | B2 | 4/2008 | Webber et al. |
| 7,364,538 | B2 | 4/2008 | Aucamp |
| 7,366,921 | B2 | 4/2008 | Ranganathan |
| 7,367,926 | B2 | 5/2008 | Clark |
| 7,369,121 | B2 | 5/2008 | Lane |
| 7,374,522 | B2 | 5/2008 | Arnold |
| 7,384,013 | B2 | 6/2008 | Yen |
| 7,393,308 | B1 | 7/2008 | Huang |
| 7,402,145 | B1 | 7/2008 | Woggon |
| 7,413,532 | B1 | 8/2008 | Monsrud et al. |
| 7,425,189 | B1 | 9/2008 | Eschenbach |
| 7,428,760 | B2 | 9/2008 | McCrimmon |
| 7,429,236 | B2 | 9/2008 | Dalebout et al. |
| 7,432,677 | B2 | 10/2008 | Heydt et al. |
| 7,435,202 | B2 | 10/2008 | Daly et al. |
| 7,435,205 | B2 | 10/2008 | Reyes et al. |
| 7,455,621 | B1 | 11/2008 | Anthony |
| 7,455,626 | B2 | 11/2008 | Trevino et al. |
| 7,455,628 | B1 | 11/2008 | Stearns |
| 7,470,234 | B1 | 12/2008 | Elhag et al. |
| 7,475,613 | B2 | 1/2009 | Bailey |
| 7,488,277 | B1 | 2/2009 | Knapp |
| 7,494,450 | B2 | 2/2009 | Solomon |
| 7,497,784 | B2 | 3/2009 | Henry |
| 7,507,187 | B2 | 3/2009 | Dyer et al. |
| 7,507,189 | B2 | 3/2009 | Krull |
| 7,510,511 | B2 | 3/2009 | Von Detten |
| 7,517,303 | B2 | 4/2009 | Crawford et al. |
| 7,520,840 | B2 | 4/2009 | Shifferaw |
| 7,524,272 | B2 | 4/2009 | Bruck et al. |
| 7,525,293 | B1 | 4/2009 | Notohamiprodjo et al. |
| 7,537,546 | B2 | 5/2009 | Watterson et al. |
| 7,537,549 | B2 | 5/2009 | Nelson et al. |
| 7,537,550 | B1 | 5/2009 | Krull |
| 7,540,828 | B2 | 6/2009 | Watterson et al. |
| 7,540,829 | B1 | 6/2009 | Chen |
| 7,544,153 | B2 | 6/2009 | Trevino et al. |
| 7,553,260 | B2 | 6/2009 | Piaget et al. |
| 7,553,262 | B2 | 6/2009 | Piane, Jr. |
| 7,556,590 | B2 | 7/2009 | Watterson et al. |
| 7,556,591 | B2 | 7/2009 | Chuang |
| 7,559,879 | B2 | 7/2009 | Anderson et al. |
| 7,563,203 | B2 | 7/2009 | Dalebout et al. |
| 7,563,205 | B2 | 7/2009 | Alling |
| 7,569,000 | B2 | 8/2009 | Wang |
| 7,569,004 | B2 | 8/2009 | Kolomeir |
| 7,575,537 | B2 | 8/2009 | Ellis |
| 7,585,251 | B2 | 9/2009 | Doody, Jr. et al. |
| 7,585,254 | B1 | 9/2009 | Vittone |
| 7,585,258 | B2 | 9/2009 | Watson et al. |
| 7,591,770 | B2 | 9/2009 | Stewart et al. |
| 7,591,795 | B2 | 9/2009 | Whalen et al. |
| 7,594,877 | B2 | 9/2009 | Anderson et al. |
| 7,594,878 | B1 | 9/2009 | Joannou |
| 7,601,101 | B2 | 10/2009 | Jackson et al. |
| 7,602,301 | B1 | 10/2009 | Stirling et al. |
| 7,604,571 | B2 | 10/2009 | Wilkins et al. |
| 7,604,572 | B2 | 10/2009 | Stanford |
| 7,604,573 | B2 | 10/2009 | Dalebout et al. |
| 7,608,015 | B2 | 10/2009 | Radow |
| 7,608,021 | B1 | 10/2009 | Nalley |
| 7,608,023 | B2 | 10/2009 | Casagrande |
| 7,614,639 | B2 | 11/2009 | Tholkes et al. |
| 7,614,981 | B2 | 11/2009 | Cao |
| 7,618,346 | B2 | 11/2009 | Crawford et al. |
| 7,618,350 | B2 | 11/2009 | Dalebout et al. |
| 7,621,850 | B2 | 11/2009 | Piaget et al. |
| 7,621,855 | B1 | 11/2009 | Krull |
| 7,625,314 | B2 | 12/2009 | Ungari |
| 7,628,730 | B1 | 12/2009 | Watterson et al. |
| 7,628,732 | B1 | 12/2009 | Porszasz et al. |
| 7,637,847 | B1 | 12/2009 | Hickman |
| 7,637,850 | B2 | 12/2009 | Chen |
| 7,639,520 | B1 | 12/2009 | Zansky et al. |
| 7,645,212 | B2 | 1/2010 | Ashby et al. |
| 7,645,214 | B2 | 1/2010 | Lull |
| 7,645,218 | B2 | 1/2010 | Potok et al. |
| 7,647,196 | B2 | 1/2010 | Kahn et al. |
| 7,648,446 | B2 | 1/2010 | Chiles et al. |
| 7,651,442 | B2 | 1/2010 | Carlson |
| 7,654,229 | B2 | 2/2010 | Smith |
| 7,658,694 | B2 | 2/2010 | Ungari |
| 7,658,695 | B1 | 2/2010 | Amsbury et al. |
| 7,658,698 | B2 | 2/2010 | Pacheco et al. |
| 7,670,263 | B2 | 3/2010 | Ellis |
| 7,674,205 | B2 | 3/2010 | Dalebout et al. |
| 7,674,206 | B2 | 3/2010 | Jones |
| 7,677,518 | B2 | 3/2010 | Chouinard et al. |
| 7,682,286 | B2 | 3/2010 | Badarneh et al. |
| 7,682,287 | B1 | 3/2010 | Hsieh |
| 7,682,290 | B2 | 3/2010 | Liao et al. |
| 7,682,291 | B2 | 3/2010 | Gill et al. |
| 7,690,556 | B1 | 4/2010 | Kahn et al. |
| 7,695,409 | B2 | 4/2010 | Helie et al. |
| 7,704,191 | B2 | 4/2010 | Smith et al. |
| 7,704,192 | B2 | 4/2010 | Dyer et al. |
| 7,708,668 | B2 | 5/2010 | Rodgers, Jr. |
| 7,708,672 | B2 | 5/2010 | Gibson et al. |
| 7,713,172 | B2 | 5/2010 | Watterson et al. |

(56) References Cited

U.S. PATENT DOCUMENTS

| | | | |
|---|---|---|---|
| 7,713,177 | B2 | 5/2010 | Lo |
| 7,717,826 | B2 | 5/2010 | Cox et al. |
| 7,717,827 | B2 | 5/2010 | Kurunmäki et al. |
| 7,717,828 | B2 | 5/2010 | Simonson et al. |
| 7,717,830 | B1 | 5/2010 | Charniga et al. |
| 7,722,503 | B1 | 5/2010 | Smith et al. |
| 7,722,509 | B2 | 5/2010 | Eder |
| 7,731,634 | B2 | 6/2010 | Stewart et al. |
| 7,736,272 | B2 | 6/2010 | Martens |
| 7,736,273 | B2 | 6/2010 | Cox et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,740,563 | B2 | 6/2010 | Dalebout et al. |
| 7,745,716 | B1 | 6/2010 | Murphy |
| 7,749,137 | B2 | 7/2010 | Watt et al. |
| 7,753,830 | B1 | 7/2010 | Marsh et al. |
| 7,753,861 | B1 | 7/2010 | Kahn et al. |
| 7,758,469 | B2 | 7/2010 | Dyer et al. |
| 7,762,952 | B2 | 7/2010 | Lee et al. |
| 7,766,797 | B2 | 8/2010 | Dalebout |
| 7,771,319 | B1 | 8/2010 | Spoeth, Jr. et al. |
| 7,771,320 | B2 | 8/2010 | Riley et al. |
| 7,771,329 | B2 | 8/2010 | Dalebout et al. |
| 7,775,128 | B2 | 8/2010 | Roessingh et al. |
| 7,775,936 | B2 | 8/2010 | Wilkinson |
| 7,775,943 | B2 | 8/2010 | Vittone |
| 7,780,578 | B2 | 8/2010 | Packham |
| 7,789,800 | B1 | 9/2010 | Watterson et al. |
| 7,794,363 | B2 | 9/2010 | Wang |
| 7,795,824 | B2 | 9/2010 | Shen et al. |
| 7,806,780 | B1 | 10/2010 | Plunkett |
| 7,806,805 | B2 | 10/2010 | Barufka et al. |
| 7,811,209 | B2 | 10/2010 | Crawford et al. |
| 7,815,550 | B2 | 10/2010 | Watterson et al. |
| 7,815,554 | B2 | 10/2010 | Gibson et al. |
| 7,837,161 | B2 | 11/2010 | Chase |
| 7,837,595 | B2 | 11/2010 | Rice |
| 7,839,058 | B1 | 11/2010 | Churchill et al. |
| 7,846,070 | B2 | 12/2010 | Oglesby et al. |
| 7,854,669 | B2 | 12/2010 | Marty et al. |
| 7,871,355 | B2 | 1/2011 | Yeh |
| 7,871,357 | B2 | 1/2011 | Gibson et al. |
| 7,878,950 | B1 | 2/2011 | Bastian |
| 7,883,448 | B2 | 2/2011 | Wang |
| 7,887,465 | B2 | 2/2011 | Uffelman |
| 7,892,148 | B1 | 2/2011 | Stauffer et al. |
| 7,892,149 | B2 | 2/2011 | Wu |
| 7,892,150 | B1 | 2/2011 | Colley |
| 7,901,325 | B2 | 3/2011 | Henderson |
| 7,908,981 | B2 | 3/2011 | Agee |
| 7,914,420 | B2 | 3/2011 | Daly et al. |
| 7,914,421 | B2 | 3/2011 | Weier et al. |
| 7,919,950 | B2 | 4/2011 | Uno et al. |
| 7,922,635 | B2 | 4/2011 | Lull et al. |
| 7,927,253 | B2 | 4/2011 | Vincent |
| 7,931,563 | B2 | 4/2011 | Shaw et al. |
| 7,938,751 | B2 | 5/2011 | Nicolas et al. |
| 7,938,755 | B1 | 5/2011 | Dyer et al. |
| 7,942,783 | B2 | 5/2011 | Ochi |
| 7,942,788 | B2 | 5/2011 | Wu |
| 7,946,968 | B2 | 5/2011 | Kjellberg |
| 7,949,295 | B2 | 5/2011 | Kumar et al. |
| 7,951,046 | B1 | 5/2011 | Barber, Jr. |
| 7,959,124 | B2 | 6/2011 | Phifer et al. |
| 7,972,249 | B1 | 7/2011 | Napalan |
| 7,976,437 | B1 | 7/2011 | Von Detten |
| 7,978,081 | B2 | 7/2011 | Shears et al. |
| 7,985,164 | B2 | 7/2011 | Ashby |
| 7,988,600 | B2 | 8/2011 | Rodgers, Jr. |
| 8,001,472 | B2 | 8/2011 | Gilley et al. |
| 8,002,674 | B2 | 8/2011 | Piaget et al. |
| 8,002,684 | B2 | 8/2011 | Laurent |
| 8,007,409 | B2 | 8/2011 | Elllis |
| 8,012,067 | B2 | 9/2011 | Joannou |
| 8,012,068 | B1 | 9/2011 | Malcolm |
| 8,029,415 | B2 | 10/2011 | Ashby et al. |
| 8,043,173 | B2 | 10/2011 | Menalagha et al. |
| 8,047,965 | B2 | 11/2011 | Shea |
| 8,047,966 | B2 | 11/2011 | Dorogusker et al. |
| 8,047,970 | B2 | 11/2011 | Nalley |
| 8,055,469 | B2 | 11/2011 | Kulach et al. |
| 8,057,368 | B1 | 11/2011 | Lyszczarz |
| 8,062,196 | B1 | 11/2011 | Khubani |
| 8,066,514 | B2 | 11/2011 | Clarke |
| 8,079,939 | B1 | 12/2011 | Wang |
| 8,082,029 | B2 | 12/2011 | Honda |
| 8,083,693 | B1 | 12/2011 | McKeon et al. |
| 8,103,379 | B2 | 1/2012 | Biba et al. |
| 8,104,411 | B2 | 1/2012 | Fenton |
| 8,105,213 | B2 | 1/2012 | Stewart et al. |
| 8,109,858 | B2 | 2/2012 | Redmann |
| 8,113,994 | B2 | 2/2012 | Piaget et al. |
| 8,123,527 | B2 | 2/2012 | Holljes |
| 8,141,276 | B2 | 3/2012 | Ellis |
| 8,147,385 | B2 | 4/2012 | Crawford et al. |
| 8,162,804 | B2 | 4/2012 | Tagliabue |
| 8,172,729 | B2 | 5/2012 | Ellis |
| 8,177,688 | B2 | 5/2012 | Burnfield et al. |
| 8,182,399 | B2 | 5/2012 | Davis et al. |
| 8,188,700 | B2 | 5/2012 | Tseng et al. |
| 8,200,323 | B2 | 6/2012 | Dibenedetto et al. |
| 8,221,290 | B2 | 7/2012 | Vincent et al. |
| 8,221,295 | B2 | 7/2012 | Wilkins |
| 8,240,430 | B2 | 8/2012 | Downey |
| 8,241,187 | B2 | 8/2012 | Moon et al. |
| 8,251,874 | B2 | 8/2012 | Ashby et al. |
| 8,260,858 | B2 | 9/2012 | Belz et al. |
| 8,272,996 | B2 | 9/2012 | Weier |
| 8,275,265 | B2 | 9/2012 | Kobyakov et al. |
| 8,280,259 | B2 | 10/2012 | George et al. |
| 8,287,434 | B2 | 10/2012 | Zavadsky et al. |
| 8,306,635 | B2 | 11/2012 | Pryor |
| 8,315,823 | B2 | 11/2012 | Berme et al. |
| 8,320,578 | B2 | 11/2012 | Kahn et al. |
| 8,323,157 | B2 | 12/2012 | Campanaro et al. |
| 8,333,681 | B2 | 12/2012 | Schmidt |
| 8,343,016 | B1 | 1/2013 | Astilean |
| 8,360,904 | B2 | 1/2013 | Oleson et al. |
| 8,360,935 | B2 | 1/2013 | Olsen et al. |
| 8,360,936 | B2 | 1/2013 | Dibenedetto et al. |
| 8,368,329 | B1 | 2/2013 | Depew et al. |
| 8,378,647 | B2 | 2/2013 | Yonezawa et al. |
| 8,394,005 | B2 | 3/2013 | Solow et al. |
| 8,395,366 | B2 | 3/2013 | Uno |
| 8,435,160 | B1 | 5/2013 | Clum |
| 8,446,275 | B2 | 5/2013 | Utter, II |
| 8,449,620 | B2 | 5/2013 | Hakansson et al. |
| 8,454,437 | B2 | 6/2013 | Dugan |
| 8,459,479 | B2 | 6/2013 | Yourist |
| 8,475,346 | B2 | 7/2013 | Gerschefske et al. |
| 8,475,367 | B1 | 7/2013 | Yuen et al. |
| 8,480,541 | B1 | 7/2013 | Brunts |
| 8,485,944 | B2 | 7/2013 | Drazan |
| 8,485,945 | B2 | 7/2013 | Leonhard |
| 8,487,759 | B2 | 7/2013 | Hill |
| 8,505,597 | B2 | 8/2013 | Sharperson |
| 8,506,370 | B2 | 8/2013 | Homsi |
| 8,512,210 | B2 | 8/2013 | Shauli |
| 8,516,723 | B2 | 8/2013 | Ferrigan et al. |
| 8,535,247 | B2 | 9/2013 | Williams |
| 8,540,560 | B2 | 9/2013 | Crowley et al. |
| 8,550,962 | B2 | 10/2013 | Piaget et al. |
| 8,562,489 | B2 | 10/2013 | Burton et al. |
| 8,573,982 | B1 | 11/2013 | Chuang |
| 8,602,951 | B2 | 12/2013 | Morris |
| 8,608,624 | B2 | 12/2013 | Shabodyash et al. |
| 8,614,595 | B2 | 12/2013 | Acatrinei |
| 8,614,902 | B2 | 12/2013 | Pansier et al. |
| 8,617,008 | B2 | 12/2013 | Marty et al. |
| 8,655,004 | B2 | 2/2014 | Prest et al. |
| 8,657,724 | B2 | 2/2014 | Yang |
| 8,690,578 | B1 | 4/2014 | Nusbaum et al. |
| 8,690,735 | B2 | 4/2014 | Watterson et al. |

(56) References Cited

U.S. PATENT DOCUMENTS

| | | | |
|---|---|---|---|
| 8,690,738 | B1 | 4/2014 | Astilian |
| 8,701,567 | B1 | 4/2014 | Esfandiari et al. |
| 8,702,430 | B2 | 4/2014 | Dibenedetto et al. |
| 8,702,567 | B2 | 4/2014 | Hu |
| 8,708,870 | B2 | 4/2014 | Nalley |
| 8,734,157 | B1 | 5/2014 | Hummel, III |
| 8,734,301 | B2 | 5/2014 | Remelius |
| 8,734,302 | B2 | 5/2014 | Hsieh |
| 8,740,756 | B2 | 6/2014 | Shabodyash et al. |
| 8,749,380 | B2 | 6/2014 | Vock et al. |
| 8,758,201 | B2 | 6/2014 | Ashby et al. |
| 8,762,101 | B2 | 6/2014 | Yuen et al. |
| 8,764,609 | B1 | 7/2014 | Elahmadie |
| 8,777,820 | B2 | 7/2014 | Lo |
| 8,783,326 | B1 | 7/2014 | Vaninger et al. |
| 8,784,274 | B1 | 7/2014 | Chuang |
| 8,790,222 | B2 | 7/2014 | Burger |
| 8,801,581 | B2 | 8/2014 | Lai et al. |
| 8,824,697 | B2 | 9/2014 | Christoph |
| 8,825,445 | B2 | 9/2014 | Hoffman et al. |
| 8,847,988 | B2 | 9/2014 | Geisner et al. |
| 8,851,565 | B2 | 10/2014 | Hontz et al. |
| 8,864,627 | B2 | 10/2014 | Bayerlein et al. |
| 8,876,661 | B2 | 11/2014 | Lu |
| 8,888,660 | B1 | 11/2014 | Oteman |
| 8,894,551 | B2 | 11/2014 | Kerdjoudj |
| 8,920,291 | B2 | 12/2014 | Chen et al. |
| 8,926,475 | B2 | 1/2015 | Lin et al. |
| 8,926,479 | B2 | 1/2015 | Chen et al. |
| 8,956,290 | B2 | 2/2015 | Gilley et al. |
| 8,956,715 | B2 | 2/2015 | Kim |
| 8,968,163 | B1 | 3/2015 | Vidmar |
| 8,979,709 | B2 | 3/2015 | Toback et al. |
| 8,986,165 | B2 | 3/2015 | Ashby |
| 9,005,085 | B2 | 4/2015 | Astilean |
| 9,011,291 | B2 | 4/2015 | Birrell |
| 9,015,952 | B2 | 4/2015 | Magosaki |
| 9,028,368 | B2 | 5/2015 | Ashby et al. |
| 9,038,218 | B1 | 5/2015 | Heil et al. |
| 9,039,578 | B2 | 5/2015 | Dalebout |
| 9,050,491 | B2 | 6/2015 | Gordon et al. |
| 9,050,498 | B2 | 6/2015 | Lu et al. |
| 9,072,932 | B2 | 7/2015 | Piaget et al. |
| 9,089,732 | B2 | 7/2015 | Andon et al. |
| 9,095,740 | B2 | 8/2015 | Wu |
| 9,108,079 | B2 | 8/2015 | Solow et al. |
| 9,114,275 | B2 | 8/2015 | Lu et al. |
| 9,114,276 | B2 | 8/2015 | Bayerlein et al. |
| 9,119,983 | B2 | 9/2015 | Rhea |
| 9,132,051 | B2 | 9/2015 | Heil |
| 9,138,614 | B2 | 9/2015 | Lu et al. |
| 9,138,615 | B2 | 9/2015 | Olson et al. |
| 9,144,703 | B2 | 9/2015 | Dalebout et al. |
| 9,162,102 | B1 | 10/2015 | Eder et al. |
| 9,162,106 | B1 | 10/2015 | Scheiman |
| 9,168,414 | B2 | 10/2015 | Liu et al. |
| 9,174,085 | B2 | 11/2015 | Foley |
| 9,186,537 | B2 | 11/2015 | Arnold et al. |
| 9,186,549 | B2 | 11/2015 | Watterson et al. |
| 9,186,552 | B1 | 11/2015 | Deal |
| 9,192,800 | B1 | 11/2015 | Meyer et al. |
| 9,199,115 | B2 | 12/2015 | Yim et al. |
| 9,199,123 | B2 | 12/2015 | Solow |
| 9,201,458 | B2 | 12/2015 | Hunt et al. |
| 9,220,940 | B2 | 12/2015 | Al Kuwari |
| 9,221,545 | B2 | 12/2015 | Popescu et al. |
| 9,224,291 | B2 | 12/2015 | Moll-Carrillo et al. |
| 9,226,692 | B2 | 1/2016 | Haas |
| 9,289,063 | B2 | 3/2016 | Baugh et al. |
| 9,308,415 | B2 | 4/2016 | Crawford et al. |
| 9,311,802 | B1 | 4/2016 | Chin et al. |
| 9,333,388 | B2 | 5/2016 | Lee et al. |
| 9,339,681 | B1 | 5/2016 | Nalley |
| 9,339,683 | B2 | 5/2016 | Dilli et al. |
| 9,352,185 | B2 | 5/2016 | Hendrickson et al. |
| 9,352,186 | B2 | 5/2016 | Watterson |
| 9,352,187 | B2 | 5/2016 | Piaget et al. |
| 9,357,551 | B2 | 5/2016 | Gutman |
| 9,358,422 | B2 | 6/2016 | Brontman |
| 9,364,706 | B2 | 6/2016 | Lo |
| 9,364,708 | B2 | 6/2016 | Luger et al. |
| 9,364,714 | B2 | 6/2016 | Koduri et al. |
| 9,367,668 | B2 | 6/2016 | Flynt et al. |
| 9,370,687 | B2 | 6/2016 | Hao |
| 9,387,387 | B2 | 7/2016 | Dalebout |
| 9,389,718 | B1 | 7/2016 | Letourneur |
| 9,409,050 | B2 | 8/2016 | Mintz |
| 9,415,257 | B2 | 8/2016 | Habing |
| 9,452,315 | B1 | 9/2016 | Murray et al. |
| 9,452,320 | B2 | 9/2016 | Yang |
| 9,455,784 | B2 | 9/2016 | Cune et al. |
| 9,457,224 | B2 | 10/2016 | Giannelli et al. |
| 9,463,349 | B1 | 10/2016 | Chang |
| 9,480,874 | B2 | 11/2016 | Cutler |
| 9,486,658 | B2 | 11/2016 | Alexander |
| 9,498,671 | B1 | 11/2016 | Softky |
| 9,505,241 | B2 | 11/2016 | Cuzin |
| 9,539,458 | B1 | 1/2017 | Ross |
| 9,540,071 | B2 | 1/2017 | Jordan et al. |
| 9,540,174 | B2 | 1/2017 | Josserond et al. |
| 9,560,917 | B2 | 2/2017 | Roslund, Jr. |
| 9,573,017 | B2 | 2/2017 | Chang |
| 9,579,534 | B2 | 2/2017 | Sutkowski et al. |
| 9,579,544 | B2 | 2/2017 | Watterson |
| 9,582,976 | B2 | 2/2017 | Chin et al. |
| 9,604,099 | B2 | 3/2017 | Taylor |
| 9,610,475 | B1 | 4/2017 | DeKnock et al. |
| 9,623,286 | B1 | 4/2017 | Chen |
| 9,673,904 | B2 | 6/2017 | Palanisamy et al. |
| 9,681,313 | B2 | 6/2017 | Malach |
| 9,682,306 | B2 | 6/2017 | Lin et al. |
| 9,694,234 | B2 | 7/2017 | Dalebout et al. |
| 9,700,780 | B2 | 7/2017 | Riley et al. |
| 9,707,441 | B2 | 7/2017 | Yang |
| 9,707,447 | B1 | 7/2017 | Lopez Babodilla |
| 9,731,158 | B1 | 8/2017 | Lo |
| 9,737,747 | B1 | 8/2017 | Walsh et al. |
| 9,757,605 | B2 | 9/2017 | Olson et al. |
| 9,764,184 | B2 | 9/2017 | Kueker et al. |
| 9,776,039 | B1 | 10/2017 | Xu |
| 9,782,625 | B1 | 10/2017 | Blum et al. |
| 9,795,827 | B2 | 10/2017 | Wiener et al. |
| 9,808,673 | B2 | 11/2017 | Robinson |
| 9,814,927 | B2 | 11/2017 | Forystek |
| 9,814,929 | B2 | 11/2017 | Moser |
| 9,814,930 | B2 | 11/2017 | Manzke et al. |
| 9,827,458 | B2 | 11/2017 | Dalton |
| 9,829,068 | B2 | 11/2017 | Marchetti |
| 9,833,658 | B2 | 12/2017 | Wiener et al. |
| 9,849,330 | B2 | 12/2017 | Lagree |
| 9,889,334 | B2 | 2/2018 | Ashby et al. |
| 9,901,767 | B2 | 2/2018 | Kuo |
| 9,901,780 | B2 | 2/2018 | DeLuca et al. |
| 9,901,805 | B2 | 2/2018 | Hughes, Jr. |
| 9,914,011 | B2 | 3/2018 | Downey et al. |
| 9,914,014 | B2 | 3/2018 | Lagree et al. |
| 9,937,375 | B2 | 4/2018 | Zhu |
| 9,943,719 | B2 | 4/2018 | Smith et al. |
| 9,948,349 | B2 | 4/2018 | Malach |
| 9,950,209 | B2 | 4/2018 | Yim et al. |
| 9,956,450 | B2 | 5/2018 | Bayerlein et al. |
| 9,968,821 | B2 | 5/2018 | Finlayson et al. |
| 9,968,823 | B2 | 5/2018 | Cutler |
| 9,987,513 | B2 | 6/2018 | Yim et al. |
| 9,987,517 | B1 | 6/2018 | Kuo |
| 9,993,680 | B2 | 6/2018 | Gordon |
| 10,004,940 | B2 | 6/2018 | Badarneh |
| 10,022,590 | B2 | 7/2018 | Foley et al. |
| 2001/0001303 | A1 | 5/2001 | Ohsuga et al. |
| 2001/0008053 | A1 | 7/2001 | Belli |
| 2001/0024998 | A1 | 9/2001 | Novak |
| 2001/0049470 | A1 | 12/2001 | Mault et al. |
| 2001/0051564 | A1 | 12/2001 | Iund et al. |
| 2002/0016235 | A1 | 2/2002 | Ashby et al. |

(56) References Cited

U.S. PATENT DOCUMENTS

| | | | |
|---|---|---|---|
| 2002/0019298 | A1 | 2/2002 | Eschenbach |
| 2002/0024521 | A1 | 2/2002 | Goden |
| 2002/0025888 | A1 | 2/2002 | Germanton |
| 2002/0026130 | A1 | 2/2002 | West |
| 2002/0039952 | A1 | 4/2002 | Clem |
| 2002/0043909 | A1 | 4/2002 | Nielsen |
| 2002/0045519 | A1 | 4/2002 | Watterson |
| 2002/0055418 | A1 | 5/2002 | Pyles et al. |
| 2002/0055419 | A1 | 5/2002 | Hinnebusch |
| 2002/0055420 | A1 | 5/2002 | Stearns et al. |
| 2002/0055422 | A1 | 5/2002 | Airmet |
| 2002/0066735 | A1 | 6/2002 | Hewlitt et al. |
| 2002/0077221 | A1 | 6/2002 | Dalebout et al. |
| 2002/0094914 | A1 | 7/2002 | Maresh et al. |
| 2002/0107058 | A1 | 8/2002 | Namba et al. |
| 2002/0115536 | A1 | 8/2002 | Hojo |
| 2002/0128127 | A1 | 9/2002 | Chen |
| 2002/0142890 | A1 | 10/2002 | Ohrt |
| 2002/0147078 | A1 | 10/2002 | Wu |
| 2002/0151413 | A1 | 10/2002 | Dalebout |
| 2002/0160883 | A1 | 10/2002 | Dugan |
| 2002/0171070 | A1 | 11/2002 | Shim |
| 2002/0198084 | A1 | 12/2002 | Stearns et al. |
| 2003/0032524 | A1 | 2/2003 | Lamar et al. |
| 2003/0032535 | A1 | 2/2003 | Wang |
| 2003/0045406 | A1 | 3/2003 | Stone |
| 2003/0060331 | A1 | 3/2003 | Polk |
| 2003/0060344 | A1 | 3/2003 | David |
| 2003/0069108 | A1 | 4/2003 | Kaiserman et al. |
| 2003/0073545 | A1 | 4/2003 | Liu |
| 2003/0078138 | A1 | 4/2003 | Toyama |
| 2003/0092532 | A1 | 5/2003 | Giannelli et al. |
| 2003/0092540 | A1 | 5/2003 | Gillen |
| 2003/0092542 | A1 | 5/2003 | Bartholomew et al. |
| 2003/0096675 | A1 | 5/2003 | Wang |
| 2003/0097878 | A1 | 5/2003 | Farringdon et al. |
| 2003/0104908 | A1 | 6/2003 | Tung |
| 2003/0119635 | A1 | 6/2003 | Arbuckle |
| 2003/0125165 | A1 | 7/2003 | Trevino |
| 2003/0128186 | A1 | 7/2003 | Laker |
| 2003/0134714 | A1 | 7/2003 | Oishi et al. |
| 2003/0134718 | A1 | 7/2003 | Kim |
| 2003/0148853 | A1 | 8/2003 | Alessandri |
| 2003/0153434 | A1 | 8/2003 | Dalebout |
| 2003/0171189 | A1 | 9/2003 | Kaufman |
| 2003/0171190 | A1 | 9/2003 | Rice |
| 2003/0176815 | A1 | 9/2003 | Baba et al. |
| 2003/0181289 | A1 | 9/2003 | Oscar Moavro |
| 2003/0181293 | A1 | 9/2003 | Baatz |
| 2003/0183027 | A1 | 10/2003 | Koch |
| 2003/0211916 | A1 | 11/2003 | Capuano |
| 2003/0222419 | A1 | 12/2003 | Geary |
| 2003/0232707 | A1 | 12/2003 | Dalebout et al. |
| 2003/0236153 | A1 | 12/2003 | Pan et al. |
| 2004/0005958 | A1 | 1/2004 | Kamen et al. |
| 2004/0005961 | A1 | 1/2004 | Iund |
| 2004/0014567 | A1 | 1/2004 | Mendel |
| 2004/0014571 | A1 | 1/2004 | Haynes |
| 2004/0018915 | A1 | 1/2004 | Reyes |
| 2004/0018917 | A1 | 1/2004 | Corbalis |
| 2004/0018918 | A1 | 1/2004 | Reyes |
| 2004/0023759 | A1 | 2/2004 | Duncan et al. |
| 2004/0023761 | A1 | 2/2004 | Emery |
| 2004/0023762 | A1 | 2/2004 | Lull |
| 2004/0023766 | A1 | 2/2004 | Slone |
| 2004/0023778 | A1 | 2/2004 | Kusumoto et al. |
| 2004/0025754 | A1 | 2/2004 | Dye |
| 2004/0029645 | A1 | 2/2004 | Chen |
| 2004/0033865 | A1 | 2/2004 | Wu |
| 2004/0043873 | A1 | 3/2004 | Wilkinson et al. |
| 2004/0051392 | A1 | 3/2004 | Badarneh |
| 2004/0053748 | A1 | 3/2004 | Lo et al. |
| 2004/0063549 | A1 | 4/2004 | Kuo |
| 2004/0067821 | A1 | 4/2004 | Kehrbaum |
| 2004/0067833 | A1 | 4/2004 | Talish |
| 2004/0082444 | A1 | 4/2004 | Golesh |
| 2004/0092367 | A1 | 5/2004 | Corbalis |
| 2004/0097331 | A1 | 5/2004 | Zillig |
| 2004/0100484 | A1 | 5/2004 | Barrett |
| 2004/0102292 | A1 | 5/2004 | Pyles et al. |
| 2004/0103432 | A1 | 5/2004 | Barrett |
| 2004/0114768 | A1 | 6/2004 | Luo |
| 2004/0127335 | A1 | 7/2004 | Watterson |
| 2004/0132586 | A1 | 7/2004 | Leighton et al. |
| 2004/0132587 | A1 | 7/2004 | Leighton et al. |
| 2004/0136750 | A1 | 7/2004 | Yoshioka et al. |
| 2004/0138030 | A1 | 7/2004 | Wang |
| 2004/0142800 | A1 | 7/2004 | Gerschefske |
| 2004/0144626 | A1 | 7/2004 | Saeki |
| 2004/0148443 | A1 | 7/2004 | Achiwa |
| 2004/0152566 | A1 | 8/2004 | Yeh |
| 2004/0155622 | A1 | 8/2004 | Mayhew et al. |
| 2004/0160336 | A1 | 8/2004 | Hoch |
| 2004/0162189 | A1 | 8/2004 | Hickman |
| 2004/0162191 | A1 | 8/2004 | Ercanbrack |
| 2004/0163574 | A1 | 8/2004 | Schoenbach |
| 2004/0166999 | A1 | 8/2004 | Dodge |
| 2004/0171460 | A1 | 9/2004 | Park |
| 2004/0171464 | A1 | 9/2004 | Ashby et al. |
| 2004/0171465 | A1 | 9/2004 | Hald |
| 2004/0176215 | A1 | 9/2004 | Gramaccioni |
| 2004/0176217 | A1 | 9/2004 | Watterson |
| 2004/0177531 | A1 | 9/2004 | Dibenedetto et al. |
| 2004/0180719 | A1 | 9/2004 | Feldman |
| 2004/0181972 | A1 | 9/2004 | Csorba |
| 2004/0192514 | A1 | 9/2004 | Piaget et al. |
| 2004/0198555 | A1 | 10/2004 | Anderson |
| 2004/0198559 | A1 | 10/2004 | Grossi |
| 2004/0198571 | A1 | 10/2004 | Howell et al. |
| 2004/0214693 | A1 | 10/2004 | Piaget et al. |
| 2004/0224740 | A1 | 11/2004 | Ball et al. |
| 2004/0224825 | A1 | 11/2004 | Giannelli et al. |
| 2004/0224827 | A1 | 11/2004 | Ashley |
| 2004/0242378 | A1 | 12/2004 | Pan |
| 2004/0242379 | A1 | 12/2004 | Juva |
| 2004/0242380 | A1 | 12/2004 | Kuivala |
| 2004/0248699 | A1 | 12/2004 | Colley |
| 2004/0254020 | A1 | 12/2004 | Dragusin |
| 2004/0256524 | A1 | 12/2004 | Beck et al. |
| 2004/0259689 | A1 | 12/2004 | Wilkins et al. |
| 2004/0266587 | A1 | 12/2004 | Miller |
| 2005/0003931 | A1 | 1/2005 | Mills et al. |
| 2005/0003933 | A1 | 1/2005 | Kau |
| 2005/0008992 | A1 | 1/2005 | Westergaard et al. |
| 2005/0009668 | A1 | 1/2005 | Savettiere |
| 2005/0023292 | A1 | 2/2005 | Market et al. |
| 2005/0032610 | A1 | 2/2005 | Nelson |
| 2005/0032611 | A1 | 2/2005 | Webber |
| 2005/0037898 | A1 | 2/2005 | Chang |
| 2005/0037904 | A1 | 2/2005 | Chang |
| 2005/0043145 | A1 | 2/2005 | Anderson et al. |
| 2005/0043146 | A1 | 2/2005 | Lo et al. |
| 2005/0043155 | A1 | 2/2005 | Yannitte |
| 2005/0049117 | A1 | 3/2005 | Rodgers |
| 2005/0049121 | A1 | 3/2005 | Dalebout |
| 2005/0054492 | A1 | 3/2005 | Neff |
| 2005/0064994 | A1 | 3/2005 | Matsumoto |
| 2005/0075213 | A1 | 4/2005 | Arick |
| 2005/0090770 | A1 | 4/2005 | Chen |
| 2005/0096187 | A1 | 5/2005 | Hsu |
| 2005/0096189 | A1 | 5/2005 | Chen |
| 2005/0107220 | A1 | 5/2005 | Wang |
| 2005/0107226 | A1 | 5/2005 | Monda |
| 2005/0113158 | A1 | 5/2005 | Sterchi et al. |
| 2005/0124471 | A1 | 6/2005 | Wilkinson |
| 2005/0129903 | A1 | 6/2005 | Carr |
| 2005/0130807 | A1 | 6/2005 | Cutler |
| 2005/0131319 | A1 | 6/2005 | Der Meer |
| 2005/0132838 | A1 | 6/2005 | Lin |
| 2005/0143226 | A1 | 6/2005 | Heidecke |
| 2005/0143228 | A1 | 6/2005 | Lee |
| 2005/0148398 | A1 | 7/2005 | Lochtefeld et al. |
| 2005/0148439 | A1 | 7/2005 | Wu |
| 2005/0148440 | A1 | 7/2005 | Denton |

(56) References Cited

U.S. PATENT DOCUMENTS

2005/0148442 A1 7/2005 Watterson
2005/0148443 A1 7/2005 Watterson
2005/0159273 A1 7/2005 Chen
2005/0164838 A1 7/2005 Watterson
2005/0164839 A1 7/2005 Watterson
2005/0170935 A1 8/2005 Manser
2005/0170936 A1 8/2005 Quinn
2005/0172311 A1 8/2005 Hjelt et al.
2005/0178210 A1 8/2005 Lanham
2005/0181347 A1 8/2005 Barnes et al.
2005/0181911 A1 8/2005 Porth
2005/0192162 A1 9/2005 Pan
2005/0192163 A1 9/2005 Pan et al.
2005/0196737 A1 9/2005 Mann
2005/0202934 A1 9/2005 Olrik et al.
2005/0209050 A1 9/2005 Bartels
2005/0209051 A1 9/2005 Santomassimo et al.
2005/0209052 A1 9/2005 Ashby
2005/0209056 A1 9/2005 Daly
2005/0209060 A1 9/2005 Lull
2005/0209061 A1 9/2005 Crawford et al.
2005/0209062 A1 9/2005 Anderson et al.
2005/0215397 A1 9/2005 Watterson
2005/0227820 A1 10/2005 Dyer et al.
2005/0233861 A1 10/2005 Hickman
2005/0233871 A1 10/2005 Anders
2005/0239600 A1 10/2005 Liang
2005/0239607 A1 10/2005 Chang
2005/0245370 A1 11/2005 Boland
2005/0250622 A1 11/2005 Chang
2005/0266961 A1 12/2005 Shum et al.
2005/0272562 A1 12/2005 Alessandri et al.
2005/0272577 A1 12/2005 Olson
2005/0277520 A1 12/2005 Van Waes
2005/0281963 A1 12/2005 Cook
2005/0283911 A1 12/2005 Roussy
2005/0288155 A1 12/2005 Yang
2006/0003869 A1 1/2006 Huang et al.
2006/0003872 A1 1/2006 Chiles et al.
2006/0004265 A1 1/2006 Pulkkinen et al.
2006/0009332 A1 1/2006 Jones
2006/0019804 A1 1/2006 Young
2006/0035755 A1 2/2006 Dalebout
2006/0035757 A1 2/2006 Flick et al.
2006/0035758 A1 2/2006 Rogozinski
2006/0040797 A1 2/2006 Chang
2006/0040798 A1 2/2006 Weier et al.
2006/0046905 A1 3/2006 Doody, Jr.
2006/0047447 A1 3/2006 Brady et al.
2006/0052220 A1 3/2006 Jackson et al.
2006/0053586 A1 3/2006 Chase
2006/0053587 A1 3/2006 Chase
2006/0058158 A1 3/2006 McAvoy
2006/0058162 A1 3/2006 Vieno et al.
2006/0063644 A1 3/2006 Yang
2006/0068978 A1 3/2006 Moon
2006/0075544 A1 4/2006 Kriesel
2006/0079800 A1 4/2006 Martikka et al.
2006/0100069 A1 5/2006 Dibble et al.
2006/0100546 A1 5/2006 Silk
2006/0122035 A1 6/2006 Felix
2006/0122038 A1 6/2006 Chou Lin
2006/0122044 A1 6/2006 Ho
2006/0123814 A1 6/2006 Choi et al.
2006/0128534 A1 6/2006 Roque
2006/0132070 A1 6/2006 Heydt et al.
2006/0135274 A1 6/2006 Henry
2006/0135322 A1 6/2006 Rocker
2006/0148622 A1 7/2006 Chen
2006/0151303 A1 7/2006 Motoda
2006/0160665 A1 7/2006 Tai
2006/0160666 A1 7/2006 Wang
2006/0166791 A1 7/2006 Liao
2006/0166799 A1 7/2006 Boland et al.
2006/0172862 A1 8/2006 Badarneh et al.
2006/0189439 A1 8/2006 Baudhuin
2006/0189440 A1 8/2006 Gravagne
2006/0189462 A1 8/2006 Pearson et al.
2006/0194679 A1 8/2006 Hatcher
2006/0199706 A1 9/2006 Wehrell
2006/0205568 A1 9/2006 Huang
2006/0205569 A1 9/2006 Watterson
2006/0205571 A1 9/2006 Krull
2006/0217236 A1 9/2006 Watterson
2006/0217245 A1 9/2006 Golesh et al.
2006/0223680 A1 10/2006 Chang
2006/0229163 A1 10/2006 Waters
2006/0229170 A1 10/2006 Ozawa et al.
2006/0232147 A1 10/2006 Cheng
2006/0234832 A1 10/2006 Toyama et al.
2006/0240947 A1 10/2006 Qu
2006/0240951 A1 10/2006 Wang
2006/0240959 A1 10/2006 Huang
2006/0244187 A1 11/2006 Downey
2006/0247109 A1 11/2006 Powell
2006/0248965 A1 11/2006 Wyatt
2006/0252602 A1 11/2006 Brown
2006/0252608 A1 11/2006 Kang et al.
2006/0258513 A1 11/2006 Routley
2006/0258515 A1 11/2006 Kang et al.
2006/0264306 A1 11/2006 Tischler
2006/0270522 A1 11/2006 Yonehana et al.
2006/0276306 A1 12/2006 Pan et al.
2006/0279294 A1 12/2006 Cehelnik
2006/0287089 A1 12/2006 Addington et al.
2006/0287147 A1 12/2006 Kriesel
2006/0287161 A1 12/2006 Dalebout
2006/0287163 A1 12/2006 Wang
2006/0288846 A1 12/2006 Logan
2007/0004561 A1 1/2007 Yoo
2007/0004562 A1 1/2007 Pan et al.
2007/0004569 A1 1/2007 Cao
2007/0006489 A1 1/2007 Case, Jr. et al.
2007/0010383 A1 1/2007 Pertegaz-Esteban
2007/0015635 A1 1/2007 Donner
2007/0015636 A1 1/2007 Molter
2007/0027002 A1 2/2007 Clark et al.
2007/0027003 A1 2/2007 Clark
2007/0032353 A1 2/2007 Wilkins et al.
2007/0037667 A1 2/2007 Gordon
2007/0038137 A1 2/2007 Arand et al.
2007/0042868 A1 2/2007 Fisher
2007/0049462 A1 3/2007 Asukai et al.
2007/0049464 A1 3/2007 Chou
2007/0049465 A1 3/2007 Wu
2007/0049466 A1 3/2007 Hubbard
2007/0049470 A1 3/2007 Pyles et al.
2007/0054790 A1 3/2007 Dodge et al.
2007/0060449 A1 3/2007 Lo
2007/0060450 A1 3/2007 Lo
2007/0060451 A1 3/2007 Lucas
2007/0066448 A1 3/2007 Pan et al.
2007/0072748 A1 3/2007 Lee
2007/0072752 A1 3/2007 Koch
2007/0079691 A1 4/2007 Turner
2007/0087908 A1 4/2007 Pan et al.
2007/0111858 A1 5/2007 Dugan
2007/0111866 A1 5/2007 McVay et al.
2007/0117683 A1 5/2007 Ercanbrack et al.
2007/0123389 A1 5/2007 Martin
2007/0123390 A1 5/2007 Mathis
2007/0123395 A1 5/2007 Ellis
2007/0123396 A1 5/2007 Ellis
2007/0131409 A1 6/2007 Asahi
2007/0135264 A1 6/2007 Rosenberg
2007/0137331 A1 6/2007 Kachouh
2007/0142177 A1 6/2007 Simms et al.
2007/0142179 A1 6/2007 Terao et al.
2007/0142183 A1 6/2007 Chang
2007/0142187 A1 6/2007 Kolomeir
2007/0149363 A1 6/2007 Wang
2007/0151489 A1 7/2007 Byrne
2007/0155277 A1 7/2007 Amitai et al.
2007/0155495 A1 7/2007 Goo

(56) References Cited

U.S. PATENT DOCUMENTS

2007/0161466 A1 7/2007 Oglesby et al.
2007/0161468 A1 7/2007 Yanagisawa et al.
2007/0167292 A1 7/2007 Kuo
2007/0179023 A1 8/2007 Dyer
2007/0184953 A1 8/2007 Luberski et al.
2007/0190508 A1 8/2007 Dalton
2007/0191141 A1 8/2007 Weber
2007/0191190 A1 8/2007 Kuo
2007/0191197 A1 8/2007 Vittone
2007/0197274 A1 8/2007 Dugan
2007/0197345 A1 8/2007 Wallace et al.
2007/0197353 A1 8/2007 Hundley
2007/0197920 A1 8/2007 Adams
2007/0201727 A1 8/2007 Birrell et al.
2007/0204430 A1 9/2007 Chase
2007/0214630 A1 9/2007 Kim
2007/0219066 A1 9/2007 Wang
2007/0225119 A1 9/2007 Schenk
2007/0225120 A1 9/2007 Schenk
2007/0225126 A1 9/2007 Yoo
2007/0225127 A1 9/2007 Pan et al.
2007/0225622 A1 9/2007 Huang et al.
2007/0232455 A1 10/2007 Hanoun
2007/0232463 A1 10/2007 Wu
2007/0245612 A1 10/2007 Tresenfeld
2007/0247320 A1 10/2007 Morahan
2007/0249467 A1 10/2007 Hong et al.
2007/0270294 A1 11/2007 Sheets
2007/0270667 A1 11/2007 Coppi et al.
2007/0270726 A1 11/2007 Chou
2007/0281828 A1 12/2007 Rice
2007/0281831 A1 12/2007 Wang
2007/0284495 A1 12/2007 Charles
2007/0287601 A1 12/2007 Burck et al.
2007/0296313 A1 12/2007 Wang
2007/0298935 A1 12/2007 Badarneh
2007/0298937 A1 12/2007 Shah
2008/0001772 A1 1/2008 Saito
2008/0001866 A1 1/2008 Martin
2008/0004162 A1 1/2008 Chen
2008/0015094 A1 1/2008 Casagrande
2008/0018211 A1 1/2008 Dye
2008/0020898 A1 1/2008 Pyles et al.
2008/0020902 A1 1/2008 Arnold
2008/0020907 A1 1/2008 Lin
2008/0026658 A1 1/2008 Kriesel
2008/0026838 A1 1/2008 Dunstan et al.
2008/0032864 A1 2/2008 Hakki
2008/0032870 A1 2/2008 Wu
2008/0032871 A1 2/2008 Yeh
2008/0039301 A1 2/2008 Halbridge
2008/0046246 A1 2/2008 Goldstein et al.
2008/0051256 A1 2/2008 Ashby et al.
2008/0057889 A1 3/2008 Jan
2008/0058169 A1 3/2008 Fox
2008/0058170 A1 3/2008 Giannascoli et al.
2008/0067302 A1 3/2008 Olivera
2008/0070756 A1 3/2008 Chu
2008/0076637 A1 3/2008 Gilley et al.
2008/0076972 A1 3/2008 Dorogusker et al.
2008/0077619 A1 3/2008 Gilley et al.
2008/0086318 A1 4/2008 Gilley et al.
2008/0096745 A1 4/2008 Perry
2008/0103024 A1 5/2008 Habing
2008/0103034 A1 5/2008 Mihara et al.
2008/0108917 A1 5/2008 Joutras et al.
2008/0119333 A1 5/2008 Bowser
2008/0132386 A1 6/2008 Helie
2008/0139370 A1 6/2008 Charnitski
2008/0153670 A1 6/2008 Mckirdy
2008/0153682 A1 6/2008 Chen et al.
2008/0155077 A1 6/2008 James
2008/0161170 A1 7/2008 Lumpee
2008/0161653 A1 7/2008 Lin et al.
2008/0171640 A1 7/2008 Chang
2008/0171922 A1 7/2008 Teller
2008/0176717 A1 7/2008 Wang
2008/0176718 A1 7/2008 Wang
2008/0182724 A1 7/2008 Guthrie
2008/0187689 A1 8/2008 Dierkens et al.
2008/0188362 A1 8/2008 Chen
2008/0190745 A1 8/2008 Taniguchi et al.
2008/0191864 A1 8/2008 Wolfson
2008/0200287 A1 8/2008 Marty et al.
2008/0200310 A1 8/2008 Tagliabue
2008/0200314 A1 8/2008 Dalebout et al.
2008/0207407 A1 8/2008 Yeh
2008/0214358 A1 9/2008 Ogg et al.
2008/0214971 A1 9/2008 Talish
2008/0216717 A1 9/2008 Jones
2008/0228110 A1 9/2008 Berme
2008/0229875 A1 9/2008 Ray
2008/0234110 A1 9/2008 Webber et al.
2008/0234111 A1 9/2008 Packham
2008/0242511 A1 10/2008 Munoz et al.
2008/0244870 A1 10/2008 Chase
2008/0245944 A1 10/2008 Chase
2008/0248926 A1 10/2008 Cole et al.
2008/0248935 A1 10/2008 Solow
2008/0250729 A1 10/2008 Kriesel
2008/0255794 A1 10/2008 Levine
2008/0269017 A1 10/2008 Ungari
2008/0279896 A1 11/2008 Heinen et al.
2008/0280732 A1 11/2008 Jones
2008/0280733 A1 11/2008 Dickie et al.
2008/0280734 A1 11/2008 Dickie et al.
2008/0280735 A1 11/2008 Dickie et al.
2008/0287262 A1 11/2008 Chou
2008/0300110 A1 12/2008 Smith et al.
2008/0300114 A1 12/2008 Dalebout
2008/0300115 A1 12/2008 Erlandson
2008/0300116 A1 12/2008 Eder
2008/0300914 A1 12/2008 Karkanias et al.
2008/0305936 A1 12/2008 Cao
2008/0312047 A1 12/2008 Feng
2008/0318737 A1 12/2008 Chu
2009/0001831 A1 1/2009 Cho et al.
2009/0005224 A1 1/2009 Davis et al.
2009/0011907 A1 1/2009 Radow
2009/0023553 A1 1/2009 Shim
2009/0023556 A1 1/2009 Daly
2009/0027925 A1 1/2009 Kanouda et al.
2009/0029831 A1 1/2009 Weier
2009/0036276 A1 2/2009 Loach
2009/0042696 A1 2/2009 Wang
2009/0042698 A1 2/2009 Wang
2009/0047645 A1 2/2009 Dibenedetto et al.
2009/0048044 A1 2/2009 Oleson et al.
2009/0048073 A1 2/2009 Roimicher
2009/0048079 A1 2/2009 Nalley
2009/0048493 A1 2/2009 James et al.
2009/0053682 A1 2/2009 Stern
2009/0054214 A1 2/2009 Kadar
2009/0054751 A1 2/2009 Babashan et al.
2009/0062072 A1 3/2009 Packham
2009/0069159 A1 3/2009 Wang
2009/0069722 A1 3/2009 Flaction et al.
2009/0075781 A1 3/2009 Schwarzberg et al.
2009/0075784 A1 3/2009 Hoggan
2009/0080808 A1 3/2009 Hagen
2009/0082176 A1 3/2009 Watterson et al.
2009/0088301 A1 4/2009 Alling
2009/0093347 A1 4/2009 Wang
2009/0100718 A1 4/2009 Gerber
2009/0105047 A1 4/2009 Guidi et al.
2009/0105052 A1 4/2009 Dalebout et al.
2009/0105548 A1 4/2009 Bart
2009/0111664 A1 4/2009 Kau
2009/0111665 A1 4/2009 Wang
2009/0111666 A1 4/2009 Wang
2009/0111670 A1 4/2009 Williams
2009/0118098 A1 5/2009 Yeh
2009/0118103 A1 5/2009 Ellis
2009/0119032 A1 5/2009 Meyer

(56) References Cited

U.S. PATENT DOCUMENTS

2009/0120208 A1 5/2009 Meyer
2009/0120210 A1 5/2009 Phillips et al.
2009/0124463 A1 5/2009 Chen
2009/0124464 A1 5/2009 Kastelic
2009/0124465 A1 5/2009 Wang
2009/0124466 A1* 5/2009 Zhang ..... A63B 22/02 482/54
2009/0128516 A1 5/2009 Rimon et al.
2009/0137367 A1 5/2009 Hendrickson et al.
2009/0144639 A1 6/2009 Nims et al.
2009/0156363 A1 6/2009 Guidi et al.
2009/0156364 A1 6/2009 Simeoni
2009/0158871 A1 6/2009 Chuo
2009/0163326 A1 6/2009 Wang
2009/0163327 A1 6/2009 Huang et al.
2009/0163334 A1 6/2009 Gibson et al.
2009/0170663 A1 7/2009 Cox et al.
2009/0170667 A1 7/2009 Irving et al.
2009/0170672 A1 7/2009 Mcmullen
2009/0176625 A1 7/2009 Giannelli et al.
2009/0176628 A1 7/2009 Radding et al.
2009/0180646 A1 7/2009 Vulfson et al.
2009/0181829 A1 7/2009 Wu
2009/0181830 A1 7/2009 Wu
2009/0181831 A1 7/2009 Kuo
2009/0181833 A1 7/2009 Cassidy
2009/0197740 A1 8/2009 Julskjaer et al.
2009/0209393 A1 8/2009 Crater et al.
2009/0221405 A1 9/2009 Wang
2009/0221407 A1 9/2009 Hauk
2009/0227424 A1 9/2009 Hirata et al.
2009/0227432 A1 9/2009 Pacheco
2009/0232420 A1 9/2009 Eisenberg et al.
2009/0240858 A1 9/2009 Takebayashi
2009/0246746 A1 10/2009 Roerdink et al.
2009/0253554 A1 10/2009 Mcintosh
2009/0258710 A1 10/2009 Quatrochi et al.
2009/0258763 A1 10/2009 Richter
2009/0264258 A1 10/2009 Lo
2009/0264260 A1 10/2009 Piaget et al.
2009/0269728 A1 10/2009 Verstegen et al.
2009/0280964 A1 11/2009 Chen
2009/0286653 A1 11/2009 Wiber
2009/0293319 A1 12/2009 Avni
2009/0298649 A1 12/2009 Dyer et al.
2009/0312158 A1 12/2009 Trevino et al.
2010/0015585 A1 1/2010 Baker
2010/0016127 A1 1/2010 Farnsworth et al.
2010/0022354 A1 1/2010 Fisher
2010/0024590 A1 2/2010 O'neill
2010/0032533 A1 2/2010 Chen et al.
2010/0034665 A1 2/2010 Zhong et al.
2010/0035726 A1 2/2010 Fisher et al.
2010/0041516 A1 2/2010 Kodama
2010/0048358 A1 2/2010 Tchao et al.
2010/0062904 A1 3/2010 Crawford et al.
2010/0062914 A1 3/2010 Splane
2010/0063426 A1 3/2010 Planke
2010/0064255 A1 3/2010 Rottler et al.
2010/0069202 A1 3/2010 Olsen
2010/0075812 A1 3/2010 Piaget et al.
2010/0079291 A1 4/2010 Kroll et al.
2010/0081548 A1 4/2010 Labedz
2010/0087298 A1 4/2010 Zaccherini
2010/0093492 A1 4/2010 Watterson et al.
2010/0099541 A1 4/2010 Patel
2010/0105527 A1 4/2010 Johnson
2010/0113223 A1 5/2010 Chiles et al.
2010/0125026 A1 5/2010 Zavadsky et al.
2010/0130337 A1 5/2010 Stewart
2010/0137105 A1 6/2010 McLaughlin
2010/0144501 A1 6/2010 Berhanu
2010/0156625 A1 6/2010 Ruha
2010/0164579 A1 7/2010 Acatrinei
2010/0167883 A1 7/2010 Grind
2010/0173276 A1 7/2010 Vasin
2010/0173755 A1 7/2010 P Erez De Lazarraga
2010/0175634 A1 7/2010 Chang et al.
2010/0184568 A1 7/2010 Schippers
2010/0190615 A1 7/2010 Baker et al.
2010/0192715 A1 8/2010 Vauchel et al.
2010/0197462 A1 8/2010 Piane, Jr.
2010/0197465 A1 8/2010 Stevenson
2010/0197469 A1 8/2010 Wilkins
2010/0210418 A1 8/2010 Park
2010/0216599 A1 8/2010 Watterson
2010/0216600 A1 8/2010 Noffsinger
2010/0216607 A1 8/2010 Mueller
2010/0222179 A1 9/2010 Temple et al.
2010/0222182 A1 9/2010 Park
2010/0227740 A1 9/2010 Liu
2010/0234185 A1 9/2010 Watt et al.
2010/0235667 A1 9/2010 Mucignat et al.
2010/0240458 A1 9/2010 Gaiba et al.
2010/0248899 A1 9/2010 Bedell et al.
2010/0248900 A1 9/2010 Ashby
2010/0255959 A1 10/2010 Dalebout et al.
2010/0267524 A1 10/2010 Stewart et al.
2010/0279822 A1 11/2010 Ford
2010/0285933 A1 11/2010 Nalley
2010/0289466 A1 11/2010 Telefus
2010/0289772 A1 11/2010 Miller
2010/0292050 A1 11/2010 DiBenedetto et al.
2010/0292600 A1 11/2010 Dibenedetto et al.
2010/0304931 A1 12/2010 Stumpf
2010/0304932 A1 12/2010 Kolman et al.
2010/0311552 A1 12/2010 Sumners
2010/0320956 A1 12/2010 Lumsden et al.
2011/0003664 A1 1/2011 Richard
2011/0009249 A1 1/2011 Campanaro et al.
2011/0021319 A1 1/2011 Nissila et al.
2011/0021323 A1 1/2011 Wu
2011/0028282 A1 2/2011 Sbragia
2011/0034300 A1 2/2011 Hall
2011/0054359 A1 3/2011 Sazonov et al.
2011/0056328 A1 3/2011 Ko
2011/0061840 A1 3/2011 Goldmann
2011/0065371 A1 3/2011 Leff
2011/0065373 A1 3/2011 Goldmann
2011/0065504 A1 3/2011 Dugan et al.
2011/0067361 A1 3/2011 Sloan
2011/0073743 A1 3/2011 Shamie
2011/0075835 A1 3/2011 Hill
2011/0077055 A1 3/2011 Pakula et al.
2011/0082011 A1 4/2011 Ellis
2011/0082013 A1 4/2011 Bastian
2011/0086707 A1 4/2011 Loveland
2011/0087137 A1 4/2011 Hanoun
2011/0087445 A1 4/2011 Sobolewski
2011/0087446 A1 4/2011 Redmond
2011/0093100 A1 4/2011 Ramsay
2011/0098157 A1 4/2011 Whalen et al.
2011/0098615 A1 4/2011 Whalen et al.
2011/0109283 A1 5/2011 Kapels et al.
2011/0112771 A1 5/2011 French
2011/0118089 A1 5/2011 Ellis
2011/0118090 A1 5/2011 Ellis
2011/0124466 A1 5/2011 Nishimura
2011/0124476 A1 5/2011 Holley
2011/0131005 A1 6/2011 Ueshima et al.
2011/0136627 A1 6/2011 Williams
2011/0143769 A1 6/2011 Jones et al.
2011/0143898 A1 6/2011 Trees
2011/0152037 A1 6/2011 Tsou
2011/0152038 A1 6/2011 Freitag
2011/0152039 A1 6/2011 Hendrickson et al.
2011/0152635 A1 6/2011 Morris et al.
2011/0165995 A1 7/2011 Paulus
2011/0172060 A1 7/2011 Morales et al.
2011/0175744 A1 7/2011 Englert et al.
2011/0181420 A1 7/2011 Mack et al.
2011/0188269 A1 8/2011 Hosotani
2011/0197157 A1 8/2011 Hoffman et al.
2011/0199799 A1 8/2011 Hui et al.

(56) References Cited

U.S. PATENT DOCUMENTS

2011/0201481 A1 8/2011 Lo
2011/0202236 A1 8/2011 Galasso et al.
2011/0205164 A1 8/2011 Hansen et al.
2011/0221672 A1 9/2011 Osterhout et al.
2011/0237396 A1 9/2011 Lu
2011/0237399 A1 9/2011 Toback
2011/0247530 A1 10/2011 Coffman
2011/0251021 A1 10/2011 Zavadsky et al.
2011/0252597 A1 10/2011 Burris et al.
2011/0256988 A1 10/2011 Weier
2011/0257797 A1 10/2011 Burris et al.
2011/0263384 A1 10/2011 Drazan
2011/0269517 A1 11/2011 Englert et al.
2011/0269604 A1 11/2011 Tseng
2011/0275482 A1 11/2011 Brodess et al.
2011/0275489 A1 11/2011 Apau
2011/0275499 A1 11/2011 Eschenbach
2011/0281691 A1 11/2011 Ellis
2011/0283188 A1 11/2011 Farrenkopf et al.
2011/0283231 A1 11/2011 Richstein et al.
2011/0308919 A1 12/2011 Hahn
2011/0312473 A1 12/2011 Chu et al.
2011/0319229 A1 12/2011 Corbalis et al.
2012/0004075 A1 1/2012 Kissel et al.
2012/0004080 A1 1/2012 Webb
2012/0010053 A1 1/2012 Bayerlein et al.
2012/0015778 A1 1/2012 Lee et al.
2012/0015779 A1 1/2012 Powch et al.
2012/0015784 A1 1/2012 Reed
2012/0020135 A1 1/2012 McCune
2012/0021873 A1 1/2012 Brunner
2012/0021875 A1 1/2012 Karl
2012/0029666 A1 2/2012 Crowley et al.
2012/0032896 A1 2/2012 Vesely
2012/0046144 A1 2/2012 Lin et al.
2012/0071301 A1 3/2012 Kaylor et al.
2012/0088633 A1 4/2012 Crafton
2012/0088634 A1 4/2012 Heidecke
2012/0088640 A1 4/2012 Wissink
2012/0116684 A1 5/2012 Ingrassia et al.
2012/0132877 A1 5/2012 Wang
2012/0133192 A1 5/2012 Simpson
2012/0165162 A1 6/2012 Lu
2012/0169603 A1 7/2012 Peterson et al.
2012/0174833 A1 7/2012 Early
2012/0178590 A1 7/2012 Lu
2012/0178591 A1 7/2012 Remelius
2012/0187012 A1 7/2012 TeVault et al.
2012/0190502 A1 7/2012 Paulus et al.
2012/0212505 A1 8/2012 Burroughs et al.
2012/0218184 A1 8/2012 Wissmar
2012/0230504 A1 9/2012 Kuroda
2012/0242774 A1 9/2012 Numano et al.
2012/0248263 A1 10/2012 Grotenhuis
2012/0252580 A1 10/2012 Dugan
2012/0253234 A1 10/2012 Yang et al.
2012/0253489 A1 10/2012 Dugan
2012/0258433 A1 10/2012 Hope et al.
2012/0263892 A1 10/2012 Rodgers
2012/0270705 A1 10/2012 Lo
2012/0271143 A1 10/2012 Aragones et al.
2012/0277040 A1 11/2012 Vincent et al.
2012/0277891 A1 11/2012 Aragones et al.
2012/0293141 A1 11/2012 Zhang et al.
2012/0296455 A1 11/2012 Ohnemus et al.
2012/0298017 A1 11/2012 Chen
2012/0300515 A1 11/2012 Carletti et al.
2012/0302408 A1 11/2012 Burger
2012/0319604 A1 12/2012 Walters
2012/0326873 A1 12/2012 Utter, II
2013/0002533 A1 1/2013 Burroughs et al.
2013/0004010 A1 1/2013 Royer
2013/0009993 A1 1/2013 Horseman
2013/0017929 A1 1/2013 Hendrickson et al.
2013/0018494 A1 1/2013 Amini
2013/0034671 A1 2/2013 George
2013/0035612 A1 2/2013 Mason et al.
2013/0040783 A1 2/2013 Duda et al.
2013/0041590 A1 2/2013 Burich et al.
2013/0041617 A1 2/2013 Pease et al.
2013/0044521 A1 2/2013 Zhao et al.
2013/0050973 A1 2/2013 Rohrbach
2013/0053222 A1 2/2013 Lo
2013/0053990 A1 2/2013 Ackland
2013/0092647 A1 4/2013 Chen
2013/0095959 A1 4/2013 Marty
2013/0095978 A1 4/2013 Sauter
2013/0116095 A1 5/2013 Hsieh
2013/0123073 A1 5/2013 Olson et al.
2013/0130868 A1 5/2013 Hou
2013/0130869 A1 5/2013 Hou
2013/0139736 A1 6/2013 Flaherty
2013/0141235 A1 6/2013 Utter, II
2013/0143721 A1 6/2013 Dalebout
2013/0147411 A1 6/2013 Pang et al.
2013/0150214 A1 6/2013 Wu
2013/0154441 A1 6/2013 Redmond
2013/0165297 A1 6/2013 Daly
2013/0172152 A1 7/2013 Watterson
2013/0182781 A1 7/2013 Matsutani
2013/0185003 A1 7/2013 Carbeck et al.
2013/0190136 A1 7/2013 Watterson
2013/0190143 A1 7/2013 Greenhill et al.
2013/0190657 A1 7/2013 Flaction et al.
2013/0196821 A1 8/2013 Watterson et al.
2013/0196826 A1 8/2013 Colledge
2013/0196827 A1 8/2013 Chang
2013/0203561 A1 8/2013 Lee et al.
2013/0211858 A1 8/2013 Ohnemus et al.
2013/0228063 A1 9/2013 Turner
2013/0228422 A1 9/2013 Mathieu
2013/0231219 A1 9/2013 Huang
2013/0237383 A1 9/2013 Chen
2013/0245966 A1 9/2013 Burroughs et al.
2013/0263418 A1 10/2013 Johnson, Jr.
2013/0267386 A1 10/2013 Her
2013/0274040 A1 10/2013 Coza et al.
2013/0274069 A1 10/2013 Watterson et al.
2013/0274071 A1 10/2013 Wang
2013/0280682 A1 10/2013 Levine et al.
2013/0324368 A1 12/2013 Aragones et al.
2013/0325394 A1 12/2013 Yuen et al.
2013/0337981 A1 12/2013 Habing
2013/0338802 A1 12/2013 Winsper et al.
2013/0346043 A1 12/2013 Mewes et al.
2014/0011645 A1 1/2014 Johnson et al.
2014/0026788 A1 1/2014 Kallio, III et al.
2014/0031703 A1 1/2014 Rayner et al.
2014/0039840 A1 2/2014 Yuen et al.
2014/0052280 A1 2/2014 Yuen et al.
2014/0056461 A1 2/2014 Afshar
2014/0073488 A1 3/2014 Wu
2014/0077494 A1 3/2014 Sutkowski
2014/0080678 A1 3/2014 Wu
2014/0085077 A1 3/2014 Luna et al.
2014/0100464 A1 4/2014 Kaleal et al.
2014/0102340 A1 4/2014 Kooistra
2014/0121066 A1 5/2014 Huang et al.
2014/0139450 A1 5/2014 Levesque et al.
2014/0156228 A1 6/2014 Molettiere et al.
2014/0171266 A1 6/2014 Hawkins, III et al.
2014/0187383 A1 7/2014 Martin
2014/0195103 A1 7/2014 Nassef
2014/0221160 A1 8/2014 Hardy et al.
2014/0222173 A1 8/2014 Giedwoyn et al.
2014/0265690 A1 9/2014 Henderson
2014/0270375 A1 9/2014 Canavan et al.
2014/0274564 A1 9/2014 Greenbaum
2014/0274579 A1* 9/2014 Olson ..... A63B 22/0235
482/54
2014/0338120 A1 11/2014 Baugh et al.
2014/0358473 A1 12/2014 Goel et al.
2014/0360413 A1 12/2014 Schenk
2015/0001048 A1 1/2015 Koppes et al.

(56) References Cited

U.S. PATENT DOCUMENTS

| | | | |
|---|---|---|---|
| 2015/0003621 | A1 | 1/2015 | Trammell |
| 2015/0004579 | A1 | 1/2015 | Shelton |
| 2015/0016623 | A1 | 1/2015 | Trammell |
| 2015/0044648 | A1 | 2/2015 | White et al. |
| 2015/0048807 | A1 | 2/2015 | Fan et al. |
| 2015/0051051 | A1 | 2/2015 | Liu et al. |
| 2015/0065273 | A1 | 3/2015 | Lake |
| 2015/0065301 | A1 | 3/2015 | Oteman |
| 2015/0105220 | A1 | 4/2015 | Hong |
| 2015/0182782 | A1 | 7/2015 | Cutler |
| 2015/0192929 | A1 | 7/2015 | Rihn et al. |
| 2015/0199494 | A1 | 7/2015 | Koduri et al. |
| 2015/0201722 | A1 | 7/2015 | Brouard |
| 2015/0202487 | A1 | 7/2015 | Wu |
| 2015/0209610 | A1 | 7/2015 | Dalebout et al. |
| 2015/0209617 | A1 | 7/2015 | Hsiao |
| 2015/0238806 | A1 | 8/2015 | Mintz |
| 2015/0246751 | A1 | 9/2015 | Spivack et al. |
| 2015/0250304 | A1 | 9/2015 | Dalebout |
| 2015/0251047 | A1 | 9/2015 | Maanitty |
| 2015/0251048 | A1 | 9/2015 | Dalebout |
| 2015/0251055 | A1 | 9/2015 | Ashby |
| 2015/0253210 | A1 | 9/2015 | Ashby et al. |
| 2015/0265903 | A1 | 9/2015 | Kolen et al. |
| 2015/0295397 | A1 | 10/2015 | Lin et al. |
| 2015/0314184 | A1 | 11/2015 | Moya Saez |
| 2015/0335941 | A1 | 11/2015 | Lo |
| 2015/0346994 | A1 | 12/2015 | Chanyontpatanakul |
| 2015/0352396 | A1 | 12/2015 | Dalebout |
| 2015/0352401 | A1 | 12/2015 | Johnson |
| 2015/0352402 | A1 | 12/2015 | Arnold et al. |
| 2015/0367158 | A1 | 12/2015 | Pretz et al. |
| 2015/0367176 | A1 | 12/2015 | Bejestan et al. |
| 2016/0008650 | A1 | 1/2016 | Jue et al. |
| 2016/0016035 | A1 | 1/2016 | Hao |
| 2016/0027325 | A1 | 1/2016 | Malhotra |
| 2016/0038785 | A1 | 2/2016 | Netter |
| 2016/0047446 | A1 | 2/2016 | Hung |
| 2016/0066818 | A1 | 3/2016 | Cowley et al. |
| 2016/0074701 | A1 | 3/2016 | Wiener |
| 2016/0074705 | A1 | 3/2016 | Wiener |
| 2016/0096064 | A1 | 4/2016 | Gatti |
| 2016/0121161 | A1 | 5/2016 | Mountain |
| 2016/0175643 | A1 | 6/2016 | Kueker et al. |
| 2016/0184625 | A1 | 6/2016 | Chang |
| 2016/0193518 | A1 | 7/2016 | Baxter |
| 2016/0211841 | A1 | 7/2016 | Harrison |
| 2016/0219968 | A1 | 8/2016 | Martin |
| 2016/0263426 | A1 | 9/2016 | Mueller et al. |
| 2016/0287930 | A1 | 10/2016 | Moser |
| 2016/0303421 | A1 | 10/2016 | Tyger et al. |
| 2016/0317861 | A1 | 11/2016 | Dalebout |
| 2016/0367851 | A1 | 12/2016 | Astilean et al. |
| 2017/0056716 | A1 | 3/2017 | Cutler |
| 2017/0056726 | A1 | 3/2017 | Dalebout et al. |
| 2017/0065851 | A1 | 3/2017 | Deluca et al. |
| 2017/0068782 | A1 | 3/2017 | Pillai et al. |
| 2017/0113093 | A1 | 4/2017 | Bellavista et al. |
| 2017/0120102 | A1 | 5/2017 | Chen |
| 2017/0128784 | A1 | 5/2017 | Molins et al. |
| 2017/0136280 | A1 | 5/2017 | Lee |
| 2017/0136288 | A1 | 5/2017 | Huang |
| 2017/0136289 | A1 | 5/2017 | Frank |
| 2017/0136291 | A1 | 5/2017 | Huang |
| 2017/0136339 | A1 | 5/2017 | Habiche |
| 2017/0165523 | A1 | 6/2017 | Chou |
| 2017/0189744 | A1* | 7/2017 | Baker ..... A63B 22/02 |
| 2017/0189745 | A1* | 7/2017 | Hamilton ..... A63B 22/02 |
| 2017/0216660 | A1 | 8/2017 | Lernihan |
| 2017/0266483 | A1 | 9/2017 | Dalebout et al. |
| 2017/0266532 | A1 | 9/2017 | Watterson |
| 2017/0266533 | A1 | 9/2017 | Dalebout |
| 2017/0266534 | A1 | 9/2017 | Watterson |
| 2017/0266535 | A1 | 9/2017 | Watterson |
| 2017/0274242 | A1 | 9/2017 | Corbalis |
| 2017/0326411 | A1 | 11/2017 | Watterson |
| 2017/0340917 | A1 | 11/2017 | Chang |
| 2017/0368442 | A1 | 12/2017 | Baudhuin |
| 2018/0001135 | A1 | 1/2018 | Powell |
| 2018/0036585 | A1 | 2/2018 | Powell |
| 2018/0056111 | A1 | 3/2018 | Chiang et al. |
| 2018/0092603 | A1 | 4/2018 | Duan et al. |
| 2018/0099179 | A1 | 4/2018 | Chatterton et al. |
| 2018/0099180 | A1 | 4/2018 | Wilkinson |
| 2018/0099181 | A1 | 4/2018 | Powell et al. |
| 2018/0104533 | A1 | 4/2018 | Powell et al. |
| 2018/0111018 | A1 | 4/2018 | Lee |
| 2018/0117385 | A1 | 5/2018 | Watterson et al. |
| 2018/0117388 | A1 | 5/2018 | Porter |
| 2018/0117419 | A1 | 5/2018 | Jackson |
| 2018/0147440 | A1 | 5/2018 | Lin |
| 2018/0154205 | A1 | 6/2018 | Watterson |
| 2018/0154208 | A1 | 6/2018 | Powell et al. |
| 2019/0054344 | A1* | 2/2019 | Athey ..... A63B 22/02 |

FOREIGN PATENT DOCUMENTS

| | | |
|---|---|---|
| TW | M254239 | 1/2005 |
| TW | I304351 | 12/2008 |

OTHER PUBLICATIONS

International Search Report and Written Opinion issued in PCT/US2017/064529 dated Mar. 20, 2018.

* cited by examiner

OFFSETTING TREADMILL DECK WEIGHT DURING OPERATION

RELATED APPLICATIONS

This application claims priority to U.S. patent application Ser. No. 62/429,981 titled "Offsetting Treadmill Deck Weight During Operation" and filed on 5 Dec. 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical trainers, rowing machines, stepper machines, and stationary bikes to name a few.

One type of treadmill is disclosed in U.S. Pat. No. 5,772,560 issued to Scott R. Watterson, et al. In this reference, the treadmill has a tread base that is rotatably attached to and between a left upright and a right upright. The tread base is rotatable between a first position for performing exercises and an upright or storage position. A latching structure is provided to latch the tread base to the support structure. The treadmill also includes inclination structure for inclining the tread relative to the support surface when in the first position. The treadmill also includes rigid handles and in one configuration movable handles. The tread base also has a rigid undersurface or pan to fully enclose the underside of the tread base. A lift assist gas cylinder is also interconnected between the tread base and the feet attached to the uprights.

SUMMARY

In one embodiment, a treadmill includes a deck, an incline mechanism attached to the deck, and a lift assist mechanism that offloads a portion of the lifting force from the incline mechanism when the incline mechanism changes an elevation of a portion of the deck.

The treadmill may further include a base frame and a rear portion of the deck pivotally attached to the base frame.

The incline mechanism further may include a first end attached to the deck and a second end attached to the base frame.

The lift assist mechanism may include a gas spring.

The gas spring further may include a first spring end attached to the deck and a second spring end attached to the base frame.

The deck may be declinable to a decline angle between zero degrees and negative 15 degrees.

The lift assist mechanism may include a first gas spring connected to the deck and connected to a base frame, and a second gas spring connected to the deck and connected to the base frame. The first gas spring and the second gas spring may be oriented in a scissor arrangement.

The treadmill may include an upright structure and the lift assist mechanism may include a first end connected to the deck and a second end connected to the upright structure.

The lift assist mechanism may include a gas spring.

The lift assist mechanism may include a cable and a cable length adjustment mechanism. The cable, in part, may support a weight of the portion of the deck when inclined.

The lift assist mechanism may include at least one coiled spring.

The deck may be selectively engagable with the lift assist mechanism.

The deck may be engagable with the lift assist mechanism when the deck is orientated in a range of engageable angles.

The range of engageable angles may include decline angles.

In one embodiment, a treadmill includes a deck, a base frame pivotally attached to the base frame, a lift motor attached to the deck and attached to the base frame, and a gas spring that offloads a portion of the lifting force from the lift motor when the lift motor changes an elevation of a portion of the deck.

The deck may be declinable to a decline angle between zero degrees and negative 15 degrees.

The deck may be selectively engagable with the lift assist mechanism.

The deck may be engagable with the lift assist mechanism when the deck is orientated in a range of engageable angles.

The range of engageable angles may include decline angles.

In one embodiment, a treadmill includes a deck, a base frame pivotally attached to the base frame, a lift motor attached to the deck and attached to the base frame, and a gas spring that offloads a portion of the lifting force from the lift motor when the lift motor changes an elevation of a portion of the deck. The deck may be declinable to a decline angle between zero degrees and negative 15 degrees and the deck may be engagable with the lift assist mechanism when the deck is orientated in a decline angle.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. Often, the width of an object is transverse the object's length. Also for the purposes of this disclosure, the term "range of engageable angles" refers to a range of deck angles where the deck can be in contact with the lift assist mechanism. For the purposes of this disclosure, a deck angle that places a portion of the deck above the lift assist mechanism so that a gap separates the lift assist mechanism from the deck so that the lift assist mechanism and the deck are not make mechanical contact may be outside of the range of engageable angles. Further, an example of a deck angle within the range of engageable angles may include an angle that places the deck so that the deck is in mechanical contact with the lift assist mechanism. Further, an deck angle that places the deck so that the lift assist mechanism can make contact and apply a load onto the deck may also be an example of an engageable angle. Also, for the purposes of this disclosure, an "inclined angle" generally refers to a deck angle where the front portion of the deck is higher than a rear portion of the deck. Additionally, for the purposes of this disclosure, a "declined angle" generally refers to a deck angle where the rear portion of the deck is higher than a front portion of the deck.

Figure 1:
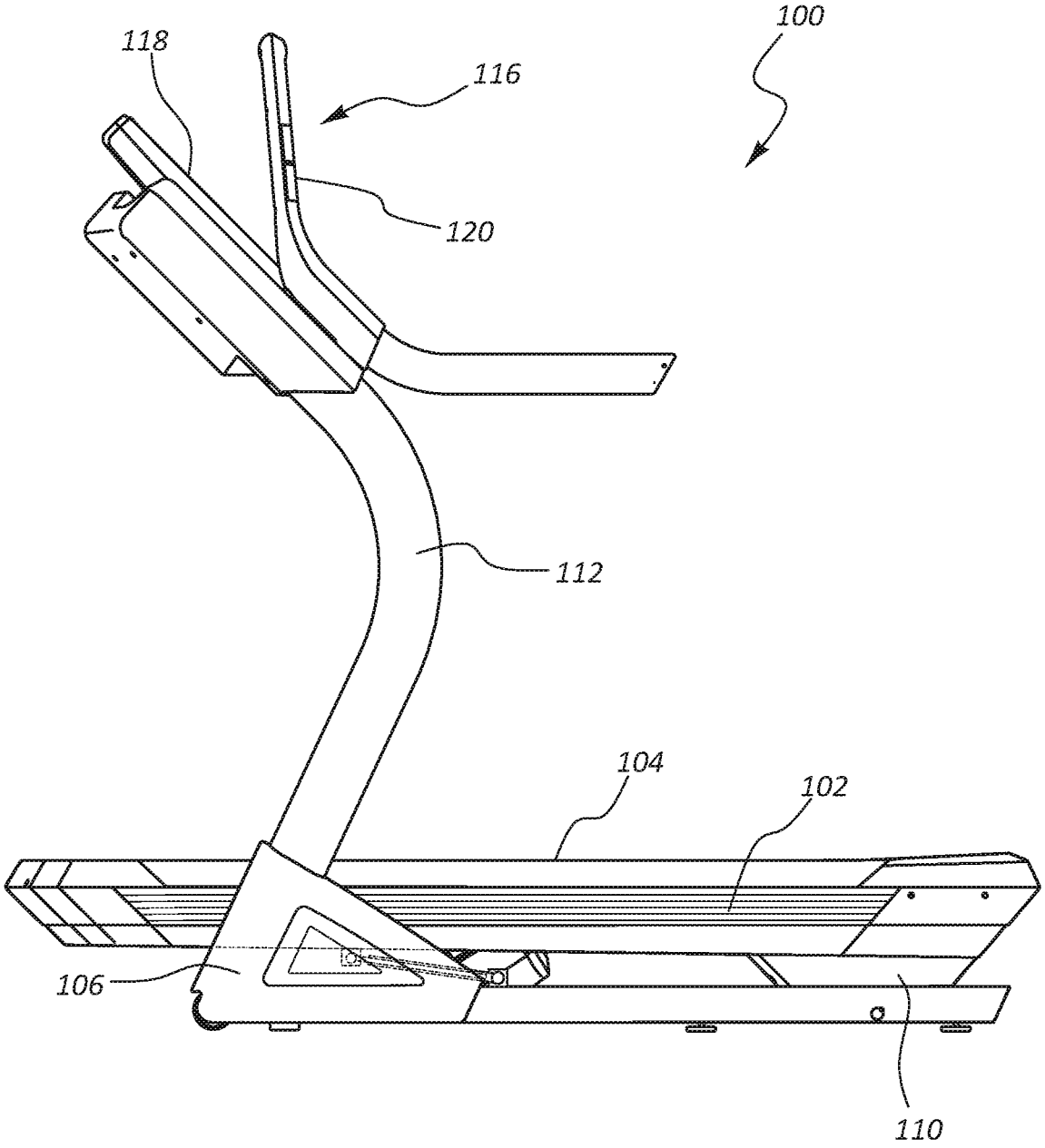
FIG. 1 depicts an example of a treadmill in accordance with aspects of the present disclosure.

FIG. 1 depicts an example of a treadmill 100 having a deck 102 with a first pulley disposed in a front portion of the deck 102 and a second pulley incorporated into a rear portion of the deck 102. A tread belt 104 surrounds the first pulley and the second pulley. A motor is in mechanical communication with either the first pulley or the second pulley. A motor (not shown) drives the tread belt 104. In this example, the deck 102 is oriented in a substantially horizontal position. The rear portion of the deck 102 is attached to a base member 106 of the treadmill's frame. A pivot connection 110 between the rear portion of the deck 102 and the base member 106 allows the front portion of the deck 102 to incline upwards or decline downwards. In this example, when the deck 102 inclines or declines, the base member 106 remains stationary.

A first side post 112 is attached to a first side of the base member 106, and a second side post is attached to a second side of the base member 106. In the example depicted in FIG. 1, the first side post 112 and the second side post remain stationary as the deck 102 inclines and/or declines. The first side post 112 and the second side post collectively support a console 116. The console 116 includes a display 118 and an input mechanism 120 for controlling the deck's incline angle.

Figure 2:
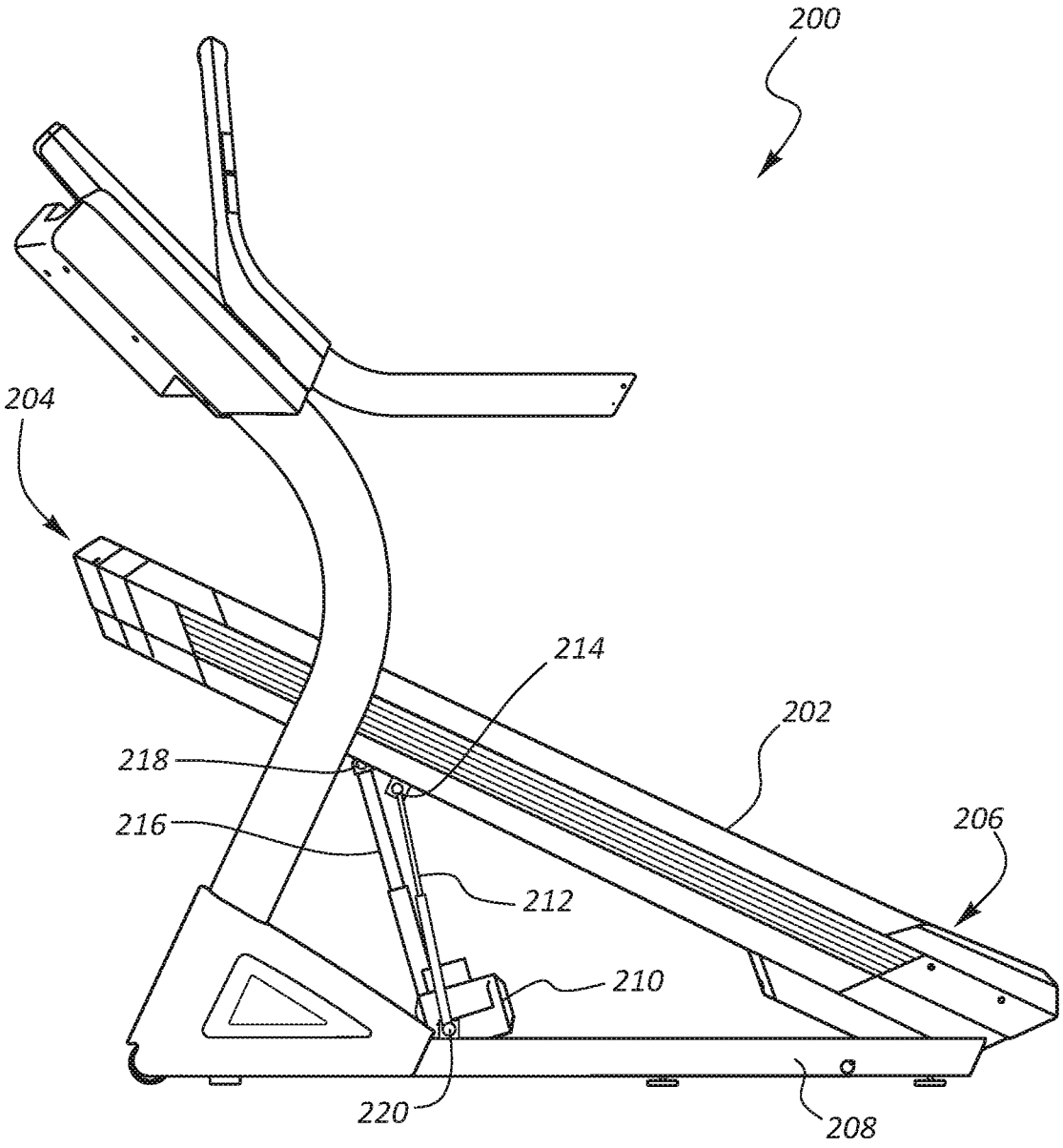
FIG. 2 depicts an example of a treadmill with a deck in an inclined position in accordance with aspects of the present disclosure.

FIG. 2 depicts an example of a treadmill 200. In this example, the deck 202 is inclined so that the front portion 204 of the deck 202 is elevated. The rear end 206 of the deck 202 is attached to a base portion 208 of the frame. At this inclined angle, the user may perform an exercise on the deck 202.

The incline mechanism for adjusting the angle of the deck 202 includes a lift motor 210. The lift motor 210 is attached to the base portion 208 of the frame. The lift motor 210 is connected to a threaded rod member 212, which is connected to the underside of the deck 202 at a first pivot connection 214. The lift motor 210 may also be pivotally connected to the base portion 208 of the frame. The deck 202 may be inclined by rotating the lift motor is a first direction which causes the threaded rod member 212 to move in a first direction.

In addition to the incline mechanism, a lift assist mechanism is incorporated into the treadmill 200 to offload a portion of the load on the incline mechanism. The lift assist mechanism may offload a portion of the load when the incline mechanism is dynamically changing the angle of the deck. In other examples, the lift assist mechanism may also offload a portion of the load from the incline mechanism when the deck is held stationary.

In some cases, the lift assist mechanism includes a gas spring 216, but any appropriate type of lift assist mechanism may be used in accordance with the principles described in the present disclosure. The gas spring 216 may include a first end 218 attached to the underside of the deck 202 and a second end 220 attached the base portion 208 of the frame.

Figure 3:
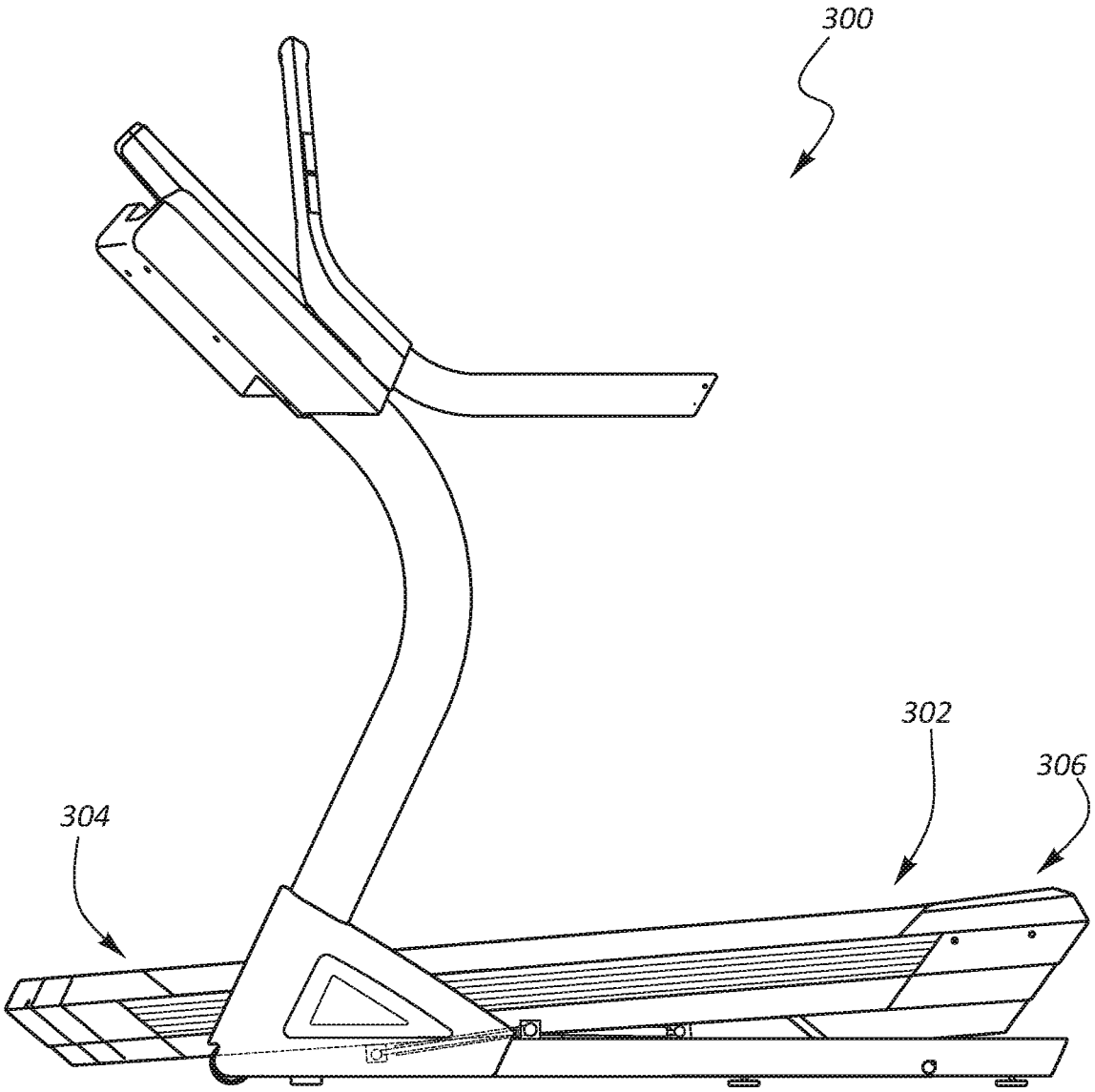
FIG. 3 depicts an example of a treadmill with a deck in a declined position in accordance with aspects of the present disclosure.

FIG. 3 depicts an example of a treadmill 300 with the deck 302 positioned at a declined angle. In this condition, the front portion 304 of the deck is lower than the rear portion 306 of the deck. The deck 302 may be declined by rotating the lift motor in a second direction.

Figure 4:
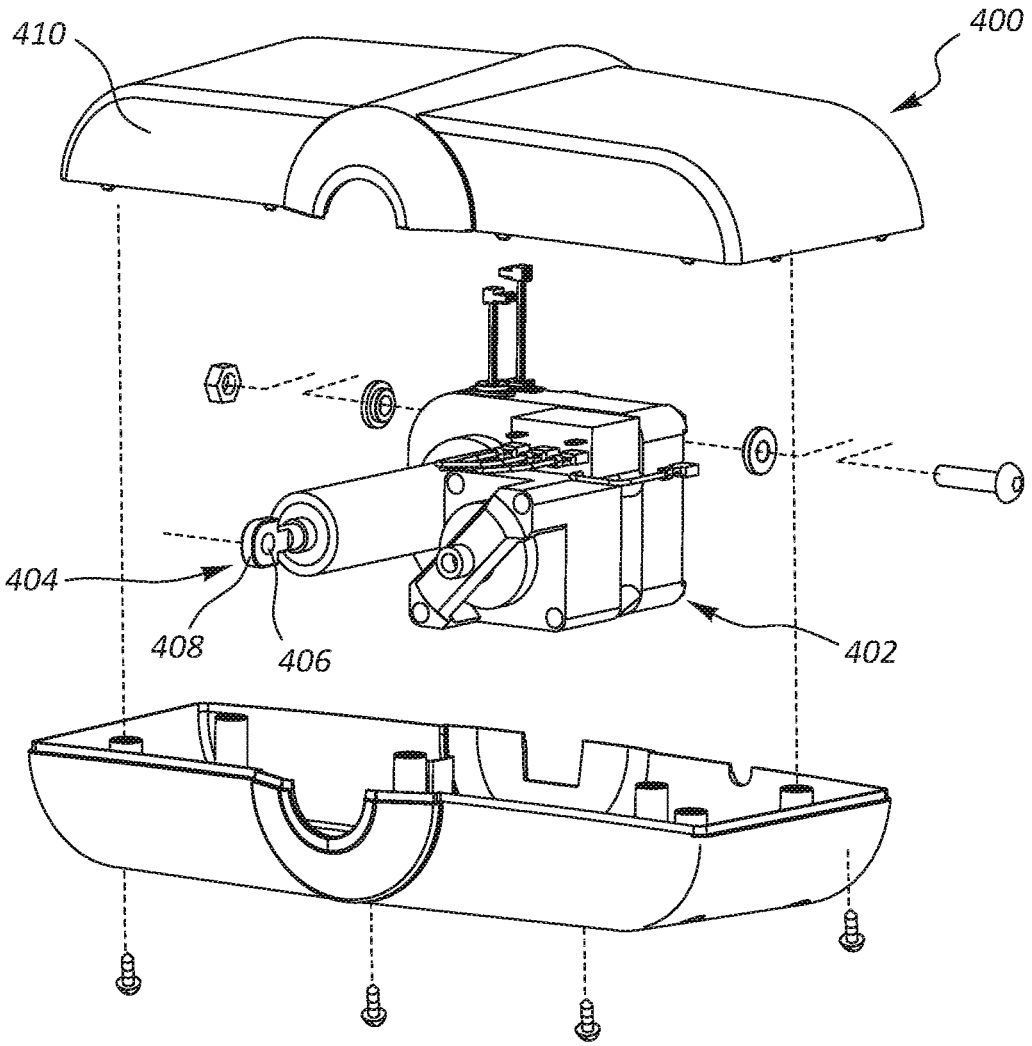
FIG. 4 depicts an example of a lift motor in accordance with aspects of the present disclosure.

FIG. 4 depicts an example of a lift motor 400. In this example, the lift motor 400 includes a motor 402 connected to a threaded rod member 404. An attachment opening 406 is defined in a first end 408 of the threaded rod member 404. A housing 410 surrounds the motor 402 and a portion of the threaded rod member 404.

Figure 5:
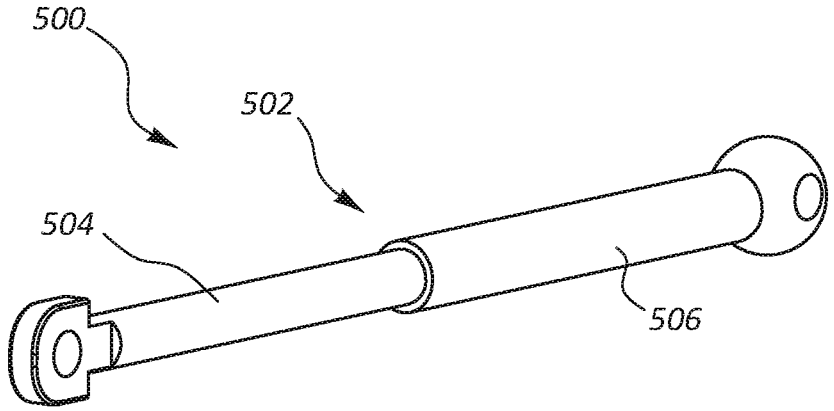
FIG. 5 depicts an example of a lift assist mechanism in accordance with aspects of the present disclosure.

FIG. 5 depicts an example of a lift assist mechanism 500. In this example, the lift assist mechanism 500 includes a gas spring 502. The gas spring 502 includes a first part 504 and a second part 506 that moves telescopically with respect to the first part 504. The gas spring 502 may include a chamber that is filled with a compressible gas. The chamber (not shown) may be collectively defined by the inside surfaces of the first part and the second part. When the first part 504 and the second part 506 are moved towards each other so that the chamber gets smaller, the gas within the chamber is compressed. The gas spring 502 may work by building up pressure inside the chamber making the internal pressure much greater than that of its surroundings.

Figure 6:
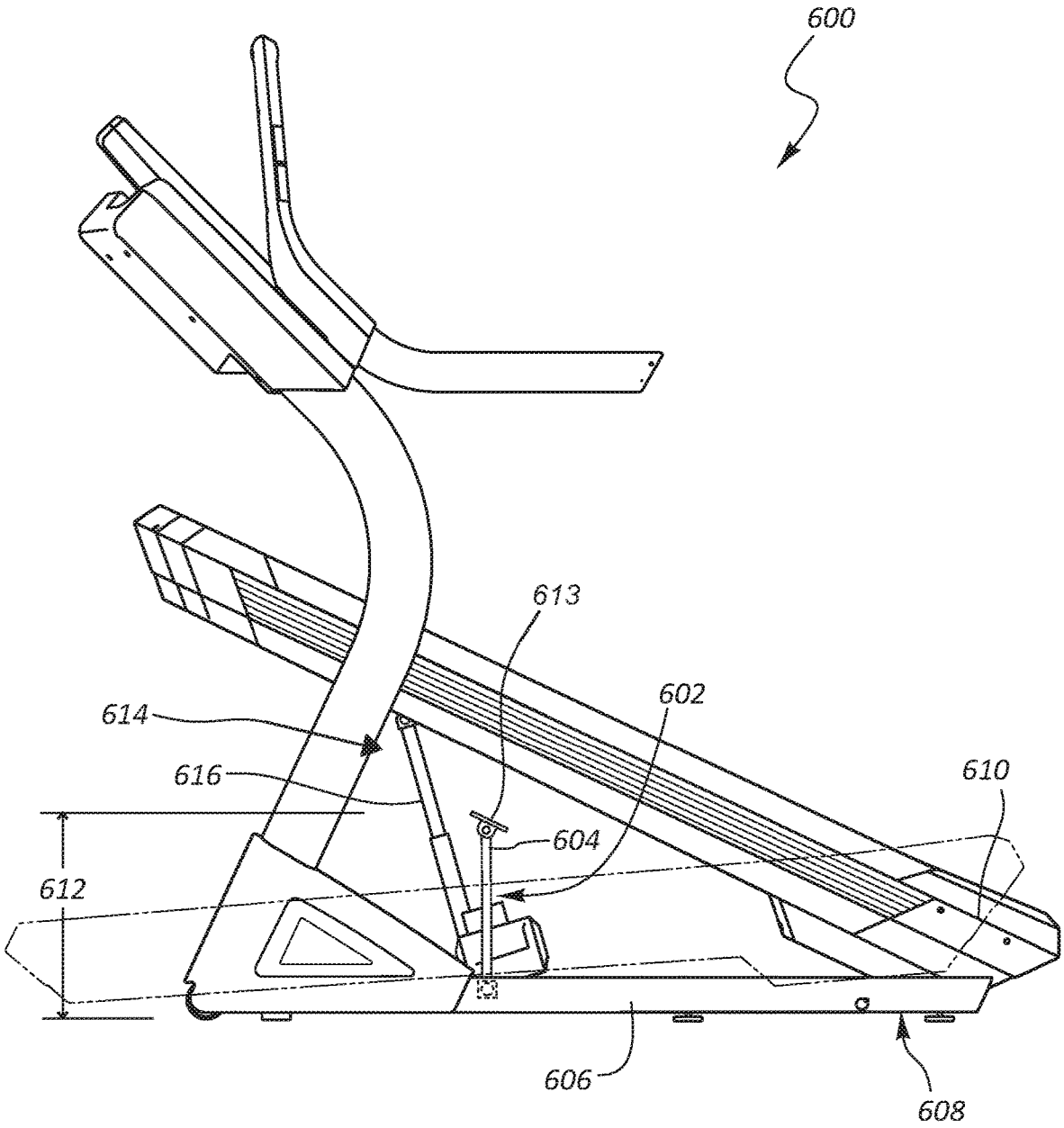
FIG. 6 depicts an example of a lift assist mechanism in accordance with aspects of the present disclosure.

FIG. 6 depicts an example of a treadmill 600 with a lift assist mechanism 602. In this example, the lift assist mechanism 602 includes a gas spring 604 that is connected to the base portion 606 of the frame. The deck 610 is connected to the frame at a connection end 608. The gas spring 604 extends towards, but does not reach, the underside of the deck 610 when the deck 610 is elevated at the height 612 depicted in FIG. 6. In this example, the lift assist mechanism includes a landing 613 where the deck 610 can land and selectively engage the underside of the deck 610.

The incline mechanism 614 is attached to the underside of the deck 610 and to the base portion 606 of the frame. Further, the incline mechanism 614 can move the deck 610 from a first angle to a second angle without assistance from the lift assist mechanism 602. When the angle of the deck 610 places the deck at angles above the lift assist mechanism 602, the deck may not contact the lift assist mechanism 602. At these higher angles, the incline mechanism may have a sufficient moment arm to move the deck due to the length of the threaded rod member 616 of the incline mechanism 614. At the lower angles, the length of the threaded rod member 616 is shorter, which increases the load on the incline motor due to a smaller moment arm. In those inclined angle ranges where the load is highest on the lift motor or other type of incline mechanism, the lift assist mechanism 602 may be engageable with the deck 610.

Figure 7:
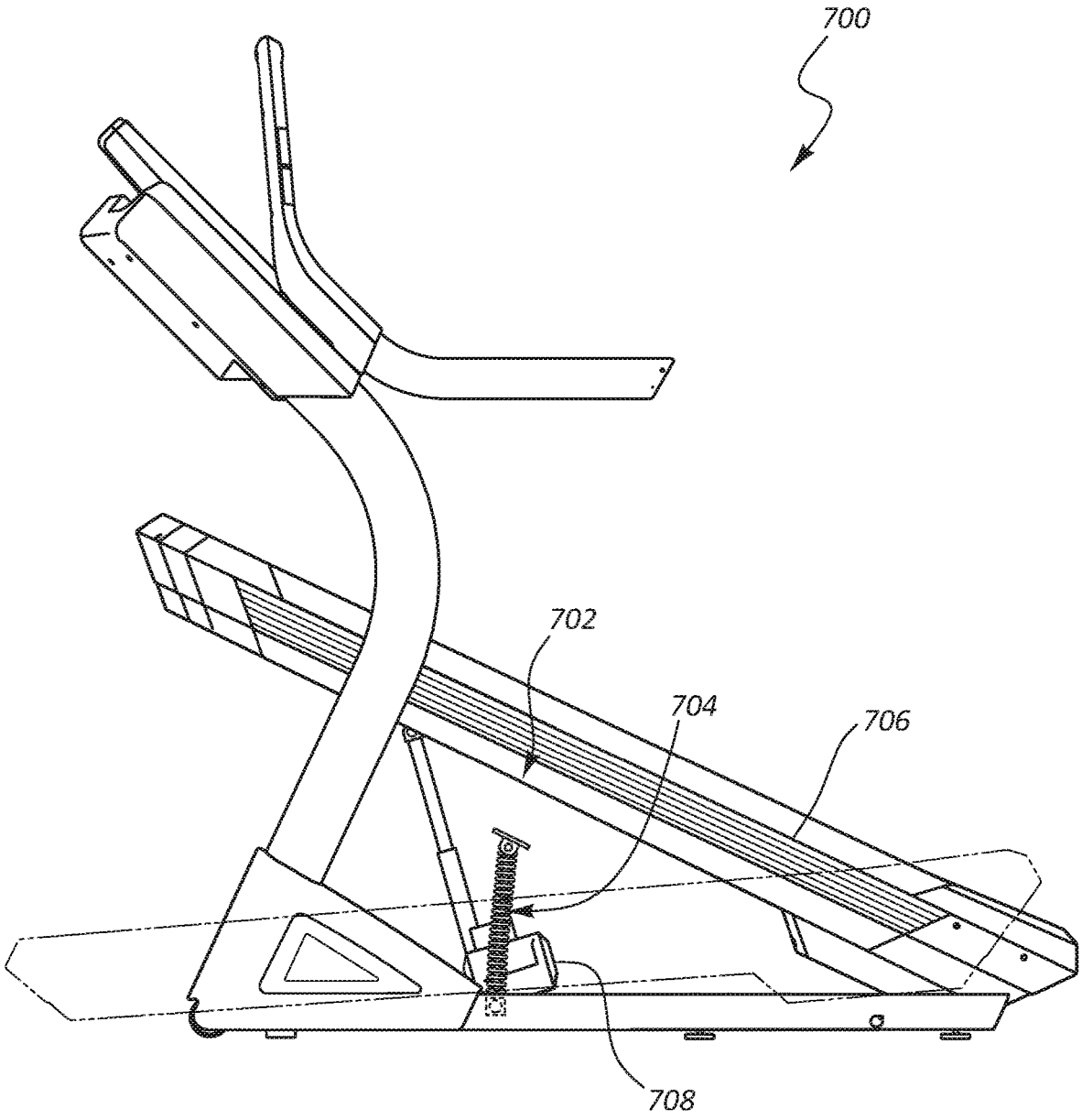
FIG. 7 depicts an example of a lift assist mechanism in accordance with aspects of the present disclosure.

FIG. 7 depicts an example of a treadmill 700 with a lift assist mechanism 702. In this example, the lift assist mechanism 702 includes a coiled spring 704. In this example, the coiled spring 704 is a compression spring. But, in other examples, the coiled spring may be tension spring.

In the illustrated example, the coiled spring 704, without an externally applied load, has a full height. When the deck 706 is lowered onto the coiled spring 704, the coiled spring 704 provides a continuous upward force on the deck 706. This upward force offloads the load on the lift motor 708 for moving or maintaining the angle of the deck 706.

Figure 8:
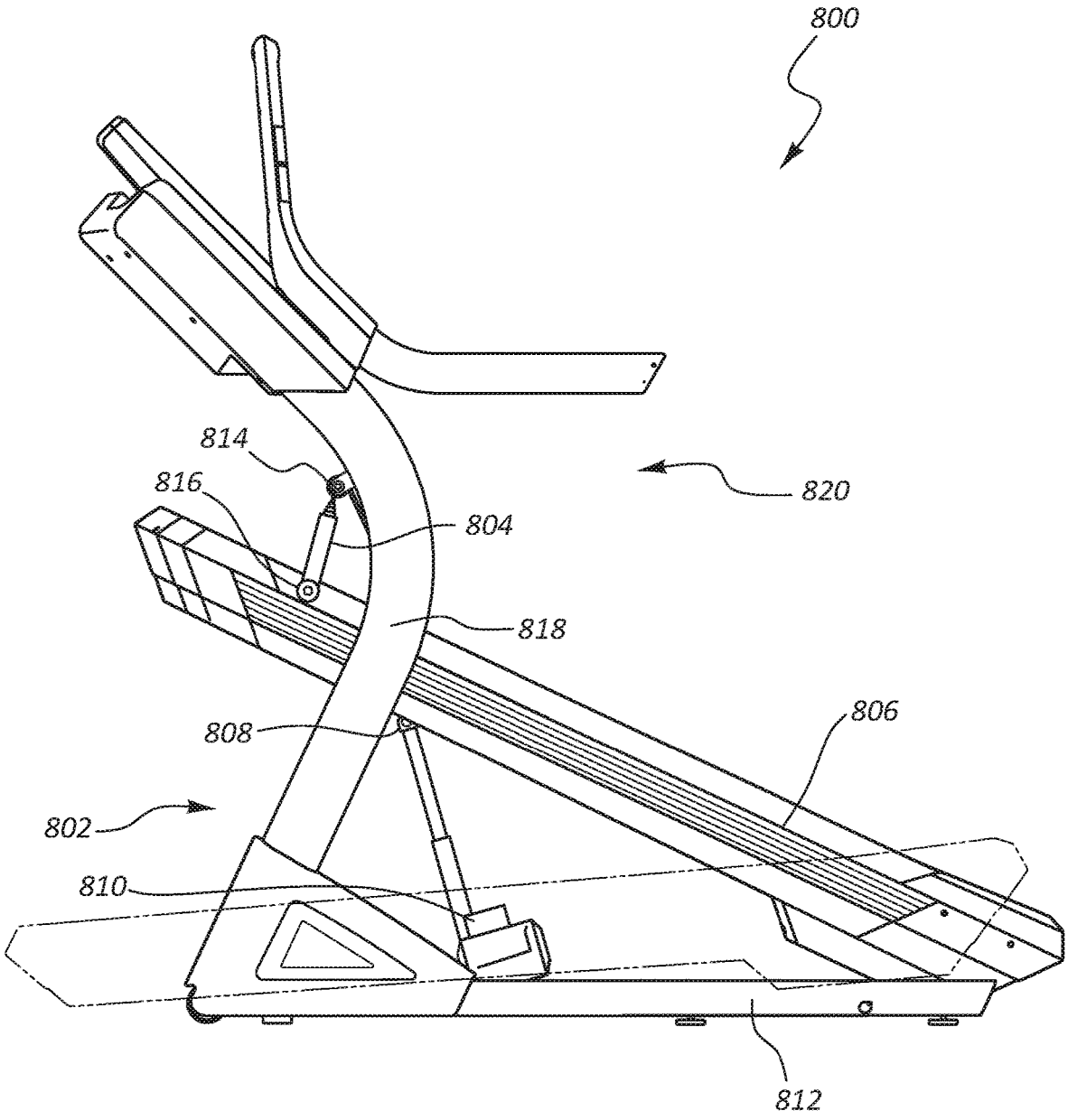
FIG. 8 depicts an example of a lift assist mechanism in accordance with aspects of the present disclosure.

FIG. 8 depicts an example of a treadmill 800 with an incline mechanism 802 and a lift assist mechanism 804. In the illustrated example, the incline mechanism 802 is located underneath the deck 806. The incline mechanism 802 has a first end 808 attached to the underside of the deck 806 and a second end 810 attached to the base portion 812 of the frame. The lift assist mechanism 804 is, at least partially, located above the deck 806. In this example, the lift assist mechanism 804 includes a first part 814 that is connected to the deck 806 and a second part 816 that is connected to at least one of the posts 818 of the upright structure 820. In this case, when the deck 806 is raised, the lift assist mechanism 804 shortens and the incline mechanism lengthens. In this case, when the deck 806 is lowered, the lift assist mechanism 804 lengthens and the incline mechanism shortens.

Figure 9:
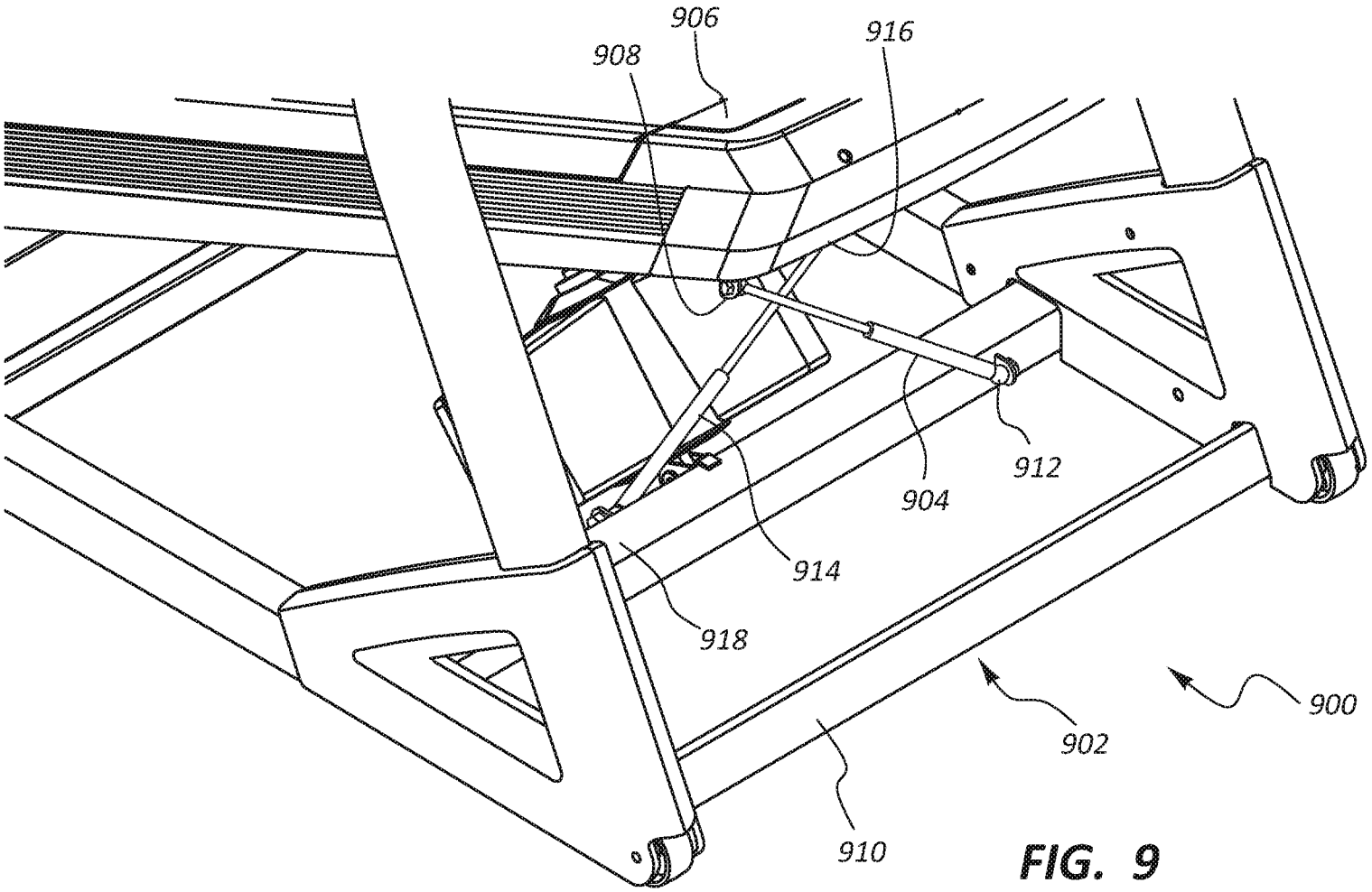
FIG. 9 depicts an example of a lift assist mechanism in accordance with aspects of the present disclosure.

FIG. 9 depicts an example of a treadmill 900 with a lift assist mechanism 902. In this example, the lift assist mechanism 902 includes multiple gas springs. A first gas spring 904 is attached to the underside of the deck 906 at a first end 908 and attached to a base portion 910 of the frame at a second end 912. Likewise, a second gas spring 914 is attached to the underside of the deck 906 at a first end 916 and attached to a base portion 910 of the frame at a second end 918. In this example, the first gas spring 904 and the second gas spring 914 are transversely arranged with respect to each other forming a cross.

Figure 10:
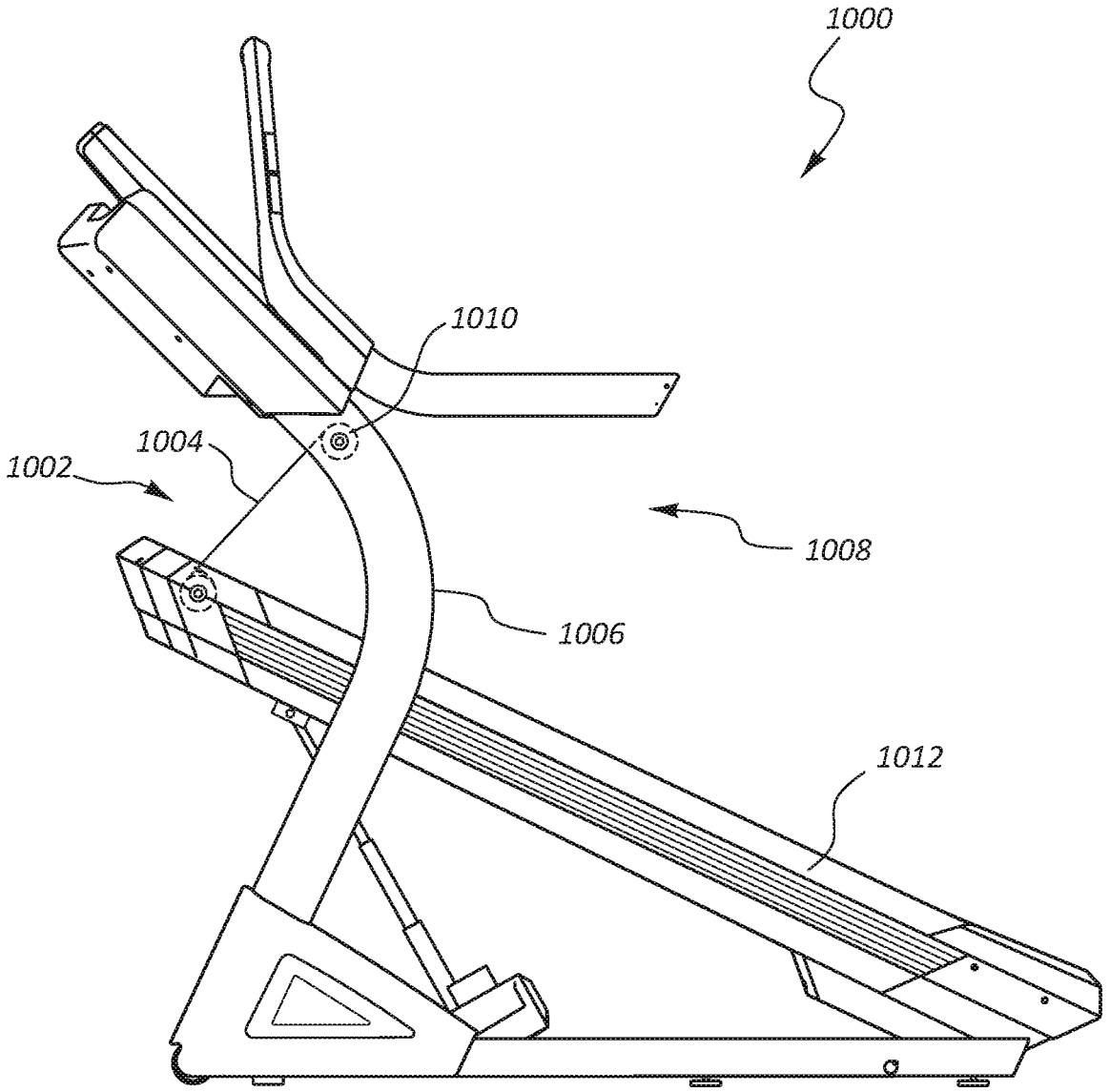
FIG. 10 depicts an example of a lift assist mechanism in accordance with aspects of the present disclosure.

FIG. 10 depicts an example of a treadmill 1000 with a lift assist mechanism 1002. In this example, the lift assist mechanism 1002 includes a cable 1004 secured to at least one of the posts 1006 of the upright structure 1008. A pulley 1010 and/or motor may be incorporated into or at least attached to the post 1006. The cable motor may cause the pulley 1010 to rotate in a first direction to provide an upward force on the deck 1012 and rotate in a second direction to allow the deck 1012 to lower.

GENERAL DESCRIPTION

In general, the invention disclosed herein may provide users with an exercise machine that lowers the load on a lift motor of a treadmill. Conventionally, a lift motor carries the weight of the deck and the user positioned on the deck when raising and lowering portions of the deck. While the weight of the user is variable, users can range from 100 to 350 pounds. When the weight of the deck and speed of changing the angle is considered, a substantial load can be exerted by the lift motor when adjusting the orientation of the deck. To prolong the useful life of the lift motor, a lift assist mechanism can be incorporated into the lift mechanism of the deck to offload at least some of the load on the lift motor when raising and lowering portions of the deck.

Some conventional treadmills include a gas spring that assists a user when the user lifts up on the rear end of the treadmill's deck to rotate the deck from a substantially horizontal, operating position to a substantially vertical, storage position. In these examples, the deck often rotates about a pivot axis located in a front portion of the deck, and the user provides the lifting force that raises the rear end of the deck. The gas spring exerts an additional force that offloads some of the force that the user has to exert to raise the rear end of the deck, but the force exerted by the gas spring is generally not sufficient to reorient the deck from the substantially horizontal, operational position to the substantially vertical, storage position by itself.

In contrast, the principles described in the present disclosure are directed towards assisting the lift motor to re-angle the deck from one operating position to another operating position. In some examples, this re-angling occurs while a user is performing an exercise on the deck. Under these circumstances, the front portion of the deck is raised or lowered while the rear end of the deck rotates about a pivot connection. The lift motor, not the user, is the power source that controls the deck angle. In those applications where the user has instructed the treadmill to execute a program that causes the deck's angle to change during the course of the exercise, the lift assist mechanism may offload the forces to be generated by the lift motor. Thus, the lift assist mechanism may prevent the lift motor from overheating and/or wearing out. In some cases, the lift motor may be prevented from raising and lowering the deck when the lift motor reaches a threshold temperature so that the lift motor can cool down. Under these circumstances, the lift motor is prevented from raising and lowering the front portion of the deck too frequently during the course of an exercise program. Thus, by providing the lift assist mechanism to offload a portion of the load exerted by the lift motor, the lift assist mechanism can increase the frequency at which the treadmill deck is reoriented, which may increase the range of exercise programs that can be executed with the treadmill. For example, certain workout programs may involve reorienting the deck frequently and would cause the lift motor to increase to a temperature where the lift motor does not operate. By incorporating the lift assist mechanism, the treadmill becomes enabled to execute these additional programs that the treadmill may not have been able to execute without the lift assist mechanism.

In some examples, the treadmill includes a frame with a base portion and an upright portion. The upright portion may include a console, handles for the user to grip during the performance of an exercise, sensors, other features, or combinations thereof. The base portion of the frame may provide beams to which the deck is movablely attached. For example, the rear portion of the deck may be pivotally attached to a base portion of the frame. In other examples, the base portion of the frame is shorter than the length of the deck. Thus, in those examples where the deck can rotate into a substantially vertical, storage position, the overall length of the treadmill deck may decrease when the deck is rotated into the storage position.

A deck may be attached to the frame, and a tread belt may be incorporated into the deck. The frame may include a base portion that supports the deck on a support surface, such as a floor. A front pulley may be connected to a front portion of the deck, and a rear pulley may be connected to a rear portion of the deck. A tread belt surrounds the front pulley and the rear pulley. A drive motor can drive either the front pulley or the rear pulley and cause the tread belt to move along a surface of the deck. The speed of the tread belt may be adjustable based on the motor's output. In some cases, the user can select the tread belt's speed through an input incorporated into the treadmill.

The motor may be located inside of a motor housing. The motor housing may also house the motor's drive shaft, a flywheel, gears, cooling mechanism, and other components. In some cases, at least a portion of the lift motor and/or lift assist mechanism are also disposed within the housing. But, alternatively, the lift motor is located outside of the housing.

The drive motor may be disposed adjacent to a pulley that moves the tread belt in a rotational direction. The drive motor may be attached to the pulley with a drive shaft. A power supply may provide power to the motor to drive the rotation of the drive shaft. The power supply may be an external source, such as an alternating current system incorporated into a residence or other building, a generator, an alternative power source, another type power source, or combinations thereof. In some instances, the power supply may be internal to the housing and/or treadmill. In some cases, a flywheel is attached to and coaxial with the drive motor. The flywheel may rotate with the drive motor.

The treadmill may include an incline mechanism that is integrated into the base portion of the frame and controls an elevation of the front portion of the deck. The rear portion of the deck may be connected to the base portion at a pivot connection. As the incline mechanism changes the elevation of the front portion of the deck, the rear portion of the deck may remain connected to the base, thus, the front portion of the deck inclines with respect to the base.

The incline mechanism may include a lift motor that is connected to the deck and to the base frame of the treadmill. When activated, the lift motor may cause a rod to extend and/or move downward, which pushes against the front portion of the deck and the base frame. This may cause the front portion of the deck to raise. In other situations, when the lift motor is activated, the rod is retracted and/or moved in an opposite direction, which causes the front portion of the deck to lower. With the movement of the rod in this direction, the lift motor may cause the front end of the deck to decline. While this example has been described with having a lift motor as part of a system for inclining the deck, any appropriate mechanism may be used to incline the deck.

In some examples, the upright structure includes a first post and a second post. The first post and the second post may include a console. The console may include an input mechanism that controls an operational parameter of the treadmill. In some cases, the console includes a cooling mechanism (e.g. fan), speakers, microphones, sensors, other features, or combinations thereof. In some cases, the console includes a display.

In some cases, the treadmill includes a console. The console may locate input mechanism within a convenient reach of the user to control the operating parameters of the exercise deck. For example, the control console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the control console, monitor the user's heart rate or other physiological parameters during the workout, perform other tasks, or combinations thereof. Buttons, levers, touch screens, voice commands, or other mechanisms may be incorporated into the control console incorporated into the treadmill and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The exercise machine may collect data about the user's physiological condition during the performance of an exercise. In some cases, sensors are incorporated into the exercise machine to gather specific types of physiological information about the user. These sensors may be located on the exercise machine where the user comes into contact with the exercise machine. For example, an electrical contact that is part of a heart rate monitoring system may be incorporated into hand rails, handles, or other types of supports incorporated into the exercise machine. The electrical contacts may detect electrical pulses transmitted through the user's body during the exercise, and these measurements may be used to determine the user's heart rate.

An input mechanism incorporated into the deck may allow the user to select the angle of the deck. In some examples, the input mechanism includes push buttons, levers, dials, touch screens, voice commend recognition, speech command recognition, other input mechanisms or combinations thereof. In some instances, in addition to controlling the lengthwise angle of the deck, the deck may also tilt from side to side, and the user may be able to control the side to side tilt.

In some cases, the treadmill may include preprogrammed workouts that simulate an outdoor route, real world route, an extra-terrestrial route, another type of route, or combinations thereof. For example, the user may input instructions through the control console, a mobile device, another type of device, or combinations thereof to select a course from a map. This map may be a map of real world roads, mountain sides, hiking trails, beaches, golf courses, scenic destinations, other types of locations with real world routes, or combinations thereof. In response to the user's selection, the display of the control console may visually depict the beginning of the selected route. The user may observe details about the location, such as the route's terrain and scenery. In some examples, the display presents a video or a still frame taken of the selected area that represents how the route looked when the video was taken. In other examples, the video or still frame is modified in the display to account for changes to the route's location, such as real time weather, recent construction, and so forth. Further, the display may also add simulated features to the display, such as simulated vehicular traffic, simulated flora, simulated fauna, simulated spectators, simulated competitors, or other types of simulated features. While the various types of routes have been described as being presented through the display of the control console, the route may be presented through another type of display, such as a home entertainment system, a nearby television, a mobile device, another type of display, or combinations thereof.

In addition to simulating the route through a visual presentation of a display, the treadmill may also modify the orientation of the running deck to match the inclines and slopes of the route. For example, if the beginning of the simulated route is on an uphill slope, the running deck may be caused to alter its orientation to raise the front portion of the running deck. Likewise, if the beginning of the simulated route is on a downward slope, the rear portion of the running deck may be caused to elevate to simulate the decline in the route. Also, if the route has a lateral tilt angle, the running deck may be tilted laterally to the appropriate side of the running deck to mimic the lateral tilt angle.

The incline mechanism may be used to raise and lower the front portion of the deck. In some cases, the incline mechanism includes a lift motor. The lift motor may include a first end that is attached to any appropriate portion of the deck, and a second end that is attached to the base portion of the frame. The lift motor may be connected to a rod that expands and/or moves resulting in displacing the front portion of the deck. In one particular example, the rod is a threaded rod member that is rotatable by the lift motor. When the lift motor is activated to rotate in a first direction, the threaded rod member moves in an upward direction and causes the front portion of the deck to raise. Similarly, when the lift motor rotates in a second direction that is opposite the first direction, the tread rod member moves in a downward direction causing the deck to lower.

The incline mechanism of the lift motor may be pivotally connected to the deck. In some cases, the first end of the incline mechanism is connected to the underside of the deck. The first end of the incline mechanism may be connected to the front portion of the deck, a middle portion of the deck, and/or a rear portion of the deck. The second end of the incline mechanism may be pivotally attached to any appropriate location on the base portion of the treadmill's frame.

The lift assist mechanism may include any appropriate type of assistance compatible with the principles described in the present disclosure. In some examples, the lift assist mechanism includes a gas spring. The gas spring may include a first part and a second part that moves telescopically or otherwise moves with respect to the first part. The gas spring may include a chamber that is filled with a compressible gas. The chamber may be collectively defined by the inside surfaces of the first part and the second part. When the first part and the second are moved towards each other so that the chamber gets smaller, the gas within the chamber is compressed. The gas spring may work by building up pressure inside the chamber making the internal pressure much greater than that of its surroundings.

The gas spring may be connected to the base portion of the frame at a connection end. In some cases, the connection end includes an opening defined in the end that can receive a fastener that connects the first end to a portion of the base frame. In some cases, the fastener is a pivot rod about which the first end can rotate. The gas spring may extend towards, but may not reach, the underside of the deck when the deck is elevated above a certain height. In this type of example, the incline mechanism may be attached to the underside of the deck and to the base portion of the frame. Further, the incline mechanism can move the deck from a first angle to a second angle without assistance from the lift assist mechanism. When the angle of the deck places the deck at angles above the lift assist mechanism, the deck may not contact the lift assist mechanism. At these higher angles, the incline mechanism may have a sufficient moment arm to move the deck due to the length of the threaded rod member of the incline mechanism. At the lower angles, the length of the threaded rod member is shorter, which increases the load on the incline motor due to a smaller moment arm. In those incline angle ranges where the load is highest on the lift motor or other type of incline mechanism, the lift assist mechanism may be engageable with the deck.

The deck may transition away from receiving support from lift assist mechanism at any appropriate transition angle. In some examples, the transition angle is between negative 15 degrees and positive 30 degrees. In other examples, the transition angle is between negative 10 degrees and positive 25 degrees. In yet another example, the transition angle is between negative 5 degrees and positive 20 degrees. In yet another example, the transition angle is between 0 degrees and positive 15 degrees. In an additional example, the transition angle is between positive 5 degrees and positive 10 degrees.

In some cases, the deck is engaged with the lift assist mechanism for those angles under positive 30 degrees, positive 25 degrees, positive 20 degrees, positive 15 degrees, positive 10 degrees, positive 5 degrees, zero degrees, negative 5 degrees, negative 10 degrees, negative 15 degrees, another appropriate degree, or combinations thereof.

In one example, the lift assist mechanism is in contact with the deck when the deck is in a range of engageable angles that includes declined angles, substantially neutral angles, and slightly inclined angles. Within this range of engageable angles, the length of the threaded rod member cause the moment arm to be small enough that a higher load is placed on the incline mechanism. The lift assist mechanism can offload some of the weight of the deck when the moment arm is lower. As the incline mechanism raises the deck, the incline mechanism may lift the deck off of the lift assist mechanism when the lift assist mechanism reaches it full length. As the deck rises, the load on the lift motor progressively lowers because the threaded rod member increases in length and the moment arm provides a mechanical advantage for lifting the deck. At the height when the deck lifts off of the lift assist mechanism, the length of the threaded rod member may be long enough that the moment arm lowers the load on the lift motor or other incline mechanism. In the other direction, the incline mechanism may move the deck above the lift assist mechanism. In those situations where the incline mechanism lowers the deck, the load on the lift motor progressively increases. As the load increases as the deck is lowered, the incline mechanism may lower the deck onto the lift assist mechanism which offloads a portion of the load on the incline mechanism.

In some cases, where the deck is in a declined angle, the threaded rod member of the incline mechanism may be aligned with the length of the deck. As a result, the lift motor may be at a mechanical disadvantage to raising the deck. In these situations, the lift assist mechanism may reduce the load on the lift motor allowing for a smaller lift motor to be incorporated into the treadmill or increasing the response time of changing the angle of the deck, especially at incline angles that are substantially level or declined.

In some examples, the lift assist mechanism includes a coiled spring in lieu of a gas spring or in combination with a gas spring. In this type of example, the coiled spring can be a compression spring, a tension spring, a torsion spring, another type of spring, or combinations thereof. The coiled spring, without an externally applied load, may have a full height. When the deck is lowered onto the coiled spring, the coiled spring provides a continuous upward force on the deck. This upward force offloads the load on the lift motor for moving or maintaining the angle of the deck.

In some examples, the incline mechanism is located underneath the deck, and the lift assist mechanism is, at least partially, located above the deck. In this example, the lift assist mechanism includes a first part that is connected to the deck and a second part that is connected to at least one of the posts of the upright structure. In this case, when the deck is raised, the lift assist mechanism shortens and the incline mechanism lengthens. In this case, when the deck is lowered, the lift assist mechanism lengthen and the incline mechanism shortens.

The lift mechanism may include multiple gas springs, multiple coil springs, other types of lift mechanisms, or combinations thereof. In one example, the lift assist mechanism includes a first gas spring attached to the underside of the deck at a first end and attached to a base portion of the frame at a second end. Further, a second gas spring is attached to the underside of the deck at a first end and attached to a base portion of the frame at a second end. The first gas spring and the second gas spring may be transversely arranged with respect to each other forming a cross, may be aligned with each other, or are otherwise arranged.

Further, in some cases, the lift assist mechanism may include a cable secured to at least one of the posts of the upright structure. A pulley and/or motor may be incorporated into or at least attached to the post. The cable motor may cause the pulley to rotate in a first direction to provide an upward force on the deck and rotate in a second direction to allow the deck to lower.

While the examples above has been described with reference to the lift assist mechanism being described with specific lift features, any appropriate type of lift assist mechanism may be incorporated into the treadmill in accordance with the principles described in the present disclosure. For example, the lift assist mechanism may be an electronically controlled lift mechanism that is activated when a sensor indicates that a threshold load is being applied to the incline mechanism. In some cases, the lift assist mechanism includes a magnetic mechanism.

While the examples above have been described with an incline mechanism that includes a threaded rod member and a lift motor, any appropriate type of incline mechanism may be used in accordance with the principles described in the present disclosure. For example, the incline mechanism may include, but not limited to, gas springs, cable and pulley systems, hydraulic springs, hydraulic mechanisms, lift motors, magnetic mechanisms, rack and pinions, gear assemblies, other incline mechanisms, or combinations thereof. Further, the incline mechanism is not necessarily disposed under the deck. In some cases, the incline mechanism is disposed at the side of the deck or above the deck. Further, while the examples above have been described with a lift motor having a threaded rod member, any appropriate type of rod may be used in accordance with the principles described herein. For example, the rod may by linearly disposed with a liquid or gas based on pressure within an internal chamber and the lift motor controls the amount of pressure within the chamber. Other types of linear actuators may be compatible with the principles described in the present disclosure.

It should be noted that the methods described above describe possible implementations, and that the operations and the steps may be rearranged or otherwise modified and that other implementations are possible. Furthermore, aspects from two or more of the methods may be combined.

Information and signals described herein may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples described herein, but is to be accorded the broadest scope consistent with the principles and novel features disclosed herein.

What is claimed is:

1. A treadmill, comprising:

a base frame;

a deck including a front portion and a rear portion, wherein a rear portion of the deck is pivotally attached to the base frame at the rear portion;

an incline mechanism attached to the deck; and a lift assist mechanism that offloads a portion of a lifting force from the incline mechanism when the incline mechanism changes an elevation of the front portion of the deck.

2. The treadmill of claim 1, wherein the incline mechanism further includes:

a first end attached to the deck; and a second end attached to the base frame.

3. The treadmill of claim 1, wherein the lift assist mechanism includes a gas spring.

4. The treadmill of claim 3, wherein the gas spring further includes:

a first spring end attached to the deck; and a second spring end attached to the base frame.

5. The treadmill of claim 1, wherein the deck is declinable where the front portion is lower than the rear portion with a decline angle between less than zero degrees and negative 15 degrees.

6. The treadmill of claim 1, wherein the lift assist mechanism includes:

a first gas spring connected to the deck and connected to a base frame; and a second gas spring connected to the deck and connected to the base frame;

the first gas spring and the second gas spring being oriented in a scissor arrangement.

7. The treadmill of claim 1, further including:

an upright structure;

the lift assist mechanism including a first end connected to the deck; and a second end connected to the upright structure.

8. The treadmill of claim 7, wherein the lift assist mechanism is a gas spring.

9. The treadmill of claim 7, wherein the lift assist mechanism includes:

a cable;

a cable length adjustment mechanism;

wherein the cable, in part, supports a weight of the portion of the deck when inclined.

10. The treadmill of claim 1, wherein the lift assist mechanism includes at least one coiled spring.

11. The treadmill of claim 1, wherein the deck is selectively engagable with the lift assist mechanism.

12. The treadmill of claim 1, wherein the deck is engaged with the lift assist mechanism when the deck is orientated in a range of engageable angles.

13. The treadmill of claim 12, wherein the range of engageable angles include decline angles where the front portion is lower than the rear portion.

14. A treadmill, comprising:

a deck including a front portion and a rear portion;

a base frame pivotally attached to the deck at the rear portion of the deck;

an incline mechanism attached to the deck and attached to the base frame; and a gas spring that offloads a portion of a lifting force from the incline mechanism when the incline mechanism changes an elevation of the front portion of the deck.

15. The treadmill of claim 14, wherein the deck is declinable where the front portion is lower than the rear portion with a decline angle between zero degrees and negative 15 degrees.

16. The treadmill of claim 14, wherein the deck is selectively engagable with the gas spring.

17. The treadmill of claim 14, wherein the deck is engagable with the gas spring when the deck is orientated in a range of engageable angles.

18. The treadmill of claim 17, wherein the range of engageable angles include decline angles.

19. A treadmill, comprising:

a deck including a front portion and a rear portion;

a base frame pivotally attached to the deck at the rear portion of the deck;

an incline mechanism attached to the deck and attached to the base frame; and a gas spring that offloads a portion of a lifting force from the incline mechanism when the incline mechanism changes an elevation of the front portion of the deck;

wherein the deck is declinable to a decline angle between zero degrees and negative 15 degrees;

wherein the deck is engagable with the gas spring when the deck is orientated in the decline angle.

20. The treadmill of claim 1, wherein the incline mechanism is located underneath the deck.

* * * * *